US006590553B1

(12) United States Patent
Kimura et al.

(10) Patent No.: US 6,590,553 B1
(45) Date of Patent: Jul. 8, 2003

(54) LIQUID CRYSTAL DISPLAY DEVICE AND METHOD FOR DRIVING THE SAME

(75) Inventors: Kazunori Kimura, Tokyo (JP); Hideki Asada, Tokyo (JP)

(73) Assignee: NEC Corporation, Tokyo (JP)

( * ) Notice: Subject to any disclaimer, the term of this patent is extended or adjusted under 35 U.S.C. 154(b) by 41 days.

(21) Appl. No.: 09/621,534

(22) Filed: Jul. 21, 2000

(30) Foreign Application Priority Data

| | | |
|---|---|---|
| Jul. 23, 1999 | (JP) | 11-208329 |
| Apr. 26, 2000 | (JP) | 2000-125055 |
| Jun. 8, 2000 | (JP) | 2000-172582 |

(51) Int. Cl.[7] ..... G09G 3/36
(52) U.S. Cl. ..... 345/92; 345/98; 345/204
(58) Field of Search ..... 345/87, 90–92, 345/97–100, 204–206, 690

(56) References Cited

U.S. PATENT DOCUMENTS

| | | | | |
|---|---|---|---|---|
| 4,781,437 A | * | 11/1988 | Shields et al. | 327/91 |
| 5,111,195 A | * | 5/1992 | Fukuoka et al. | 345/204 |
| 5,977,940 A | * | 11/1999 | Akiyama et al. | 345/205 |
| 6,107,980 A | * | 8/2000 | Hermanns et al. | 345/205 |
| 6,331,844 B1 | * | 12/2001 | Okumura et al. | 345/100 |

FOREIGN PATENT DOCUMENTS

| | | |
|---|---|---|
| JP | S59-170888 | 9/1984 |
| JP | 62-94828 A | 5/1987 |
| JP | 63-41078 B2 | 8/1988 |
| JP | H1-158417 | 6/1989 |
| JP | 1-292979 | 11/1989 |
| JP | 02-116823 A | 5/1990 |
| JP | 2-272521 | 11/1990 |
| JP | 04-44092 A | 2/1992 |
| JP | H5-80716 | 4/1993 |
| JP | 5-173175 | 7/1993 |
| JP | 05-265403 A | 10/1993 |
| JP | 05-303078 A | 11/1993 |
| JP | 6-42130 | 6/1994 |
| JP | 7-20820 | 1/1995 |
| JP | 7-114043 | 5/1995 |
| JP | 07-261145 A | 10/1995 |
| JP | 61-243429 A | 10/1996 |
| JP | 09-9180 A | 1/1997 |
| JP | 09-113879 A | 5/1997 |
| JP | 09-258163 A | 10/1997 |
| JP | 09-297564 A | 11/1997 |
| JP | 9-329806 | 12/1997 |
| JP | 10-62811 A | 3/1998 |
| JP | 10-148848 | 6/1998 |
| JP | 11-119240 | 4/1999 |
| JP | 11-259016 | 9/1999 |
| JP | 11-326946 | 11/1999 |

* cited by examiner

*Primary Examiner*—Bipin Shalwala
*Assistant Examiner*—Ricardo Osorio
(74) *Attorney, Agent, or Firm*—Sughrue Mion, PLLC

(57) ABSTRACT

A liquid crystal display device of the invention has data drive circuits provided along both of two opposite sides of a rectangular display region, and gate drive circuits provided along the other two opposite sides. With the liquid crystal display section, the gate drive circuits are formed severally divided, and each data line group respectively extending from each of the data drive circuits is electrically separated respectively by the severally divided gate drive circuits. Moreover, the liquid crystal display section comprises a color/time division incident optical system arranged so as to sequentially shine light with different chromaticity onto the display region, and a synchronizing section for synchronizing the liquid crystal display section and the color/time division incident optical system under predetermined conditions.

9 Claims, 58 Drawing Sheets a b

LIQUID CRYSTAL DISPLAY DEVICE AND METHOD FOR DRIVING THE SAME

BACKGROUND OF THE INVENTION

1. Field of the Invention

The present invention relates to a liquid crystal display device and a method for driving the same, and in particular relates to a liquid crystal display device and a drive method, for increasing the performance of a display.

2. Background Art

At present, practically all liquid crystal display elements are of the twisted nematic (TN) type display form. Liquid crystal display elements of this TN type display form use a nematic liquid crystal composition, and are largely divided into two.

One of these is an active matrix form where a switching element is provided for each pixel. For example, one (a TN-TFT form) is known which uses a thin film transistor (TFT: Thin Film Transistor) for a TN type display form. The other one is an STN (Super Twisted Nematic) form.

With this STN form, contrast and visual angle dependency are improved compared to the simple matrix form which uses the conventional TN type, but since the response speed is low, this is not suitable for moving picture display. Furthermore, this has the defect in that, compared to the active matrix form which uses the TFT, the display quality is low. This result means that at present, the TN-TFT form has become the market standard.

On the other hand, due to the requirement for further high image quality, research has started into methods of improving the angle of visibility, and practical use has been reached. As a result, with the main stream of current high performance liquid crystals displays, there are three types of TFT form active matrix liquid crystal display devices, namely a form which uses a compensating film in the TN mode, or an in plane switching (IPS) mode, or a multi domain vertical aligned (MVA) mode. With these active matrix liquid crystal display devices, normally, since the image signal involves positive and negative writing at 30 Hz, this is rewritten at 60 Hz, and the time for one field is approximately 16.7 ms (milliseconds) (the total time for both the positive and negative fields is referred to as one frame, and is approximately 33.3 ms). On the other hand, the response speed of current liquid crystals, even in the fastest state, is only about this frame time. Therefore, in the case where a projection signal comprising a moving picture is displayed, or in the case where a high-speed computer image is displayed, or in the case where a high-speed game image is displayed, a response speed higher than the current frame time is required.

On the other hand, in order to target even higher resolution, a field sequential (time sharing) color liquid crystal display where a back light serving as the illumination light for the liquid crystal display, switches time-wise between red green and blue, is also being investigated. With this form, since it is not necessary to arrange color filters spatially, high resolution three times higher than heretofore is possible. With the field sequential liquid crystal display, since it is necessary to display one color in one third of the time for one field, then the time which can be used for the display is approximately 5 ms. Consequently, for the liquid crystal itself, a response faster than 5 ms is required. As a liquid crystal which can realize this high-speed response, liquid crystals having spontaneous polarization such as ferroelectric liquid crystals or antiferroelectric liquid crystal are being studied. Furthermore, with the nematic liquid crystals also, studies are being conducted for example to increase the dielectric anisotropy, to reduce the viscosity, to make the film thinner, and to change the liquid crystal molecular orientation to a $\pi$ type orientation, or to increase speed by devising drive voltage wave forms.

Here, with an active matrix liquid crystal display element, the time where voltage or electric charge is actually written to the liquid crystal, is only the selection time (writing time) of each scanning line. This time, in the case of having 1000 lines with writing normally in one field time is 16.7 $\mu$s (microseconds), and in particular in the case where field sequential drive is performed, is approximately 5 $\mu$s. At present, a liquid crystal or a liquid crystal operation mode which completes the response within this time, is practically non existent. Even with a liquid crystal having the above-mentioned spontaneous polarization, or a high-speed nematic liquid crystal, an element which can give this fast response is not known. As a result, the liquid crystal responds after completion of writing of the signal, causing the following problems. At first, with a liquid crystal having spontaneous polarization, a depolarization field is produced due to the rotation of the spontaneous polarization, so that the voltage at both ends of the liquid crystal layer suddenly drops. Therefore, the voltage which has been written to both ends of the liquid crystal changes markedly. On the other hand, also with the high-speed nematic liquid crystal, due to the anisotropy of the dielectric constant, the change in the capacity of the liquid crystal layer becomes very large. Hence a change occurs in the holding voltage for holding the writing in the liquid crystal layer. Such a drop in the holding voltage, that is to say a drop in the effective applied voltage, lowers the contrast due to insufficient write in. Furthermore, in the case where the same signal is written in repeatedly, luminance continues to change until the holding voltage ceases to drop. Hence in order to obtain stabilized luminance, several frames are required.

Furthermore, as shown in Japanese Applied Physics, chapter 36, part 1, number 2, pages 720 to 729, in the case where the same image signal continues to be written across several frames from the frame where there has been a change in the absolute value of the signal voltage for which the image signal has changed, a phenomena called a "step response" appears. This phenomena is a phenomena where the transmittance across several frames oscillates between light and dark with respect to the signal voltage of the AC drive at the same amplitude. Subsequently, this stabilizes to a constant transmitted light quantity. An example of this phenomena is shown by the schema in FIG. 24. Part (a) shown in FIG. 24 is a wave form diagram for data voltage, part (b) shown in FIG. 24 is a wave form diagram for gate voltage, and part (c) shown in FIG. 24 is a wave form diagram for transmittance at the time. At the time of AC drive, transmittance is stable after a step response. The transmittance when stabilized is shown by a two dot chain line, and the transmittance at the time of maximum darkness is shown by a single dot chain line.

Furthermore, FIG. 25 is a timing chart for each scanning line, under drive of FIG. 24, schematically showing the luminance for the light and dark of a positive display period 102 and a negative display period 104, based on the transmittance of part (c) shown in FIG. 24. Moreover, in the figure, a time of 16.7 $\mu$s being the time for one field, is shown by the arrow. In this figure, six scanning lines are assumed. From the top scanning line in sequence, positive polarity writing 101 is performed, and after obtaining the positive display 102, then again from the top scanning line in sequence, negative polarity writing 103 is performed to obtain the negative display 104. For each scanning line, the field where the period of the positive polarity writing 101 and the positive display 102 are added, is the first field, and the field where the period of the negative polarity writing 103 and the negative display 104 are added for each scanning line, is the second field, and the total of the two fields becomes one frame. Therefore, when the data voltage of part (a) shown in FIG. 24 is applied and the TFT switch comes on with the gate voltage of part (b) shown in FIG. 24, then as in part (c) shown in FIG. 24, the transmittance oscillates between light and dark for each field. Such oscillation of the transmittance is observed as a flicker, causing deterioration in the quality of the display. Furthermore, in these figures, at two frames (four fields) after signal voltage application, the transmittance drops to a constant transmittance. As a result, the luminance change also oscillates as in FIG. 25. In this way, even if a high-speed response liquid crystal is used, since several frames are required for an actual stable luminance, the rapidity for the display image is lost.

On the other hand, with the active matrix drive, the transmittance after liquid crystal response is determined not by the applied signal voltage, but rather by the electric charge amount stored by the liquid crystal capacitance after liquid crystal response. This is because with the active drive, there is a fixed charge drive for responding to the liquid crystal due to the held charge. The charge amount supplied from the active element, ignoring slight leaks etc., is determined by the accumulation charge before predetermined signal writing, and a writing charge which is newly written. Furthermore, the accumulation charge after the liquid crystal responds also changes with pixel design values for the liquid crystal property constant, the electrical parameters, the accumulation capacity and the like. Therefore, to obtain a correspondence between the signal voltage and the transmittance, there is required for example (1) correspondence of the signal voltage to the writing charge, (2) accumulation charge prior to writing, (3) information for performing calculation of the accumulation charge after response, and actual calculation. As a result, a frame memory for storing (2) over the whole screen or a calculation part for (1) or (3) is necessary. This invites an increase in the number of parts for the system, and is thus undesirable.

As a method of solving these problems, a reset pulse method involving applying a reset pulse arranged in a predetermined liquid crystal state before new data writing, is often used. As an example, the technology disclosed in IDRC 1997, L—66 to L—69 is reported. In this document, an OCB (Optical Compensated Birefringence) mode with an attached compensation film where the orientation of a nematic liquid crystal is in a $\pi$ type orientation, is used. The response speed of this liquid crystal mode is approximately from two milliseconds to five milliseconds, which is much faster than the conventional TN mode. As a result, it can be expected that response is essentially completed inside the one frame. However as mentioned before, several frames are required until the large drop in the holding voltage due to the change in the transmittance due to the response of the liquid crystal occurs and a stable transmittance is obtained. Accordingly, a writing method which always shows black after writing a white display within one frame is shown in FIG. 26 (FIG. 5 in the above mentioned document). The X axis is time and the Y axis is luminance. The dotted lines are the luminance change in the case of normal drive, with stable luminance being reached in the third frame. According to this reset pulse method, a predetermined state always results at the time of new data writing, and hence a one to one correspondence referred to as a constant transmittance is seen with respect to a written constant signal voltage. Due to this one to one correspondence, generation of a drive signal becomes extremely simple, and at the same time the information written at the previous time is stored. Hence means such as the frame memory become unnecessary.

Furthermore, as another means of applying a reset voltage, a method is used where a positive and negative data signal voltage is generated with respect to a constant image signal, and after applying the positive (negative), a negative (positive) is applied and after that a reset voltage is applied. In this case, when positive and negative data signal voltages with equal amplitudes are simply applied, the aforementioned "step response" occurs. Therefore, application of the data signal voltage as in FIG. 27 and FIG. 28 is performed.

FIG. 27 is a waveform diagram for the data voltage, while FIG. 28 is a waveform diagram for the transmittance at that time. The waveforms shown by the dotted lines in the figures are the wave form of the data voltage with equal amplitude, and the waveform of the data voltage with equal amplitude, and the waveform of the transmittance when this is applied. In order to simplify these figures, the data voltage is shown with a common voltage subtracted (actually the common voltage corresponds to the position for zero hold voltage in the figure). In order to prevent "step response", the amplitude of the data voltage at the frame beginning (here a positive data voltage) is set low, and the amplitude of the data voltage for the frame latter half (here a negative data voltage) is made the same as the wave form of the dotted line. In this way the step response is stopped, and as shown in FIG. 28, the former half and latter half of the frame both obtain the same transmittance. After this, when the frame is completed, then by performing a reset, this is always arranged in a predetermined reset liquid crystal state. By newly applying the same wave form in the next frame, a one to one correspondence referred to as a constant transmittance is seen with respect to a constant signal voltage. Furthermore, here the reset voltage is made zero volts with respect to the common voltage. However this differs depending on the liquid crystal display mode, or the predetermined state realized with reset.

Moreover, these methods involving reset drive can be generally divided into two kinds by conditions related to the timing under which the reset of each scanning line is performed within a field. That is to say, there is the method where all of the scanning lines of the overall panel are reset at once (hereunder, whole screen en bloc reset), and the method of resetting as with scanning writing, while scanning each scanning line or scanning line block where scanning lines are multiply gathered together (hereunder, scanning reset). With the whole screen en bloc reset, at the time of reset, this can be thought of as scanning reset for all of the scanning lines in the same block (however with this way of thinking, reset scanning does not occur, and hence scanning reset and whole screen en bloc reset are different types).

FIG. 29 and FIG. 30 show timing charts for each scanning line in the respective reset methods. FIG. 29 is a timing chart for each scanning line in the whole screen en bloc reset. FIG. 30 is a timing chart for each scanning line in the scanning reset. The X axis is time and the Y axis shows the scanning line direction. Each period, namely the writing period, the response period, the display period, and the reset period is shown. In both FIG. 29 and FIG. 30, writing is performed while scanning the scanning line in sequence (here from top to bottom) in the writing period. The writing period (abbreviated to Tw as required) is shown by the necessary time tw for writing of each of the scanning lines multiplied by the number n of scanning lines (Tw=n×tw). After this, a response period (abbreviated to Tm as required) exists until the response of the liquid crystal becomes substantially stable. Then, a display only period (abbreviated to Td as required) continues until the response of the liquid crystal becomes stable and reset starts. When reset starts, a large difference occurs between FIG. 29 and FIG. 30. That is to say, with the whole screen en bloc reset of FIG. 29, all of the scanning lines are reset simultaneously. The reset period (abbreviated to Tr as required) is the sum of the time required for reset writing and the time until the liquid crystal becomes substantially steady in a predetermined state. On the other hand, with the scanning reset of FIG. 30 the scanning lines are sequentially scanned and reset. As a result, with the scanning reset method of FIG. 30, the reset period Tr and the writing period Tw are quite overlapped at parts. In this way, with the scanning reset method, there is no wastage in time distribution.

Furthermore, as a different means for solving the problems such as step response, there is proposed a drive method called a "pseudo DC drive" shown in AMLCD 97 Digest from pages 119 to 122. This technique will be explained with reference to FIG. 31. With FIG. 31, as with FIG. 24, part (a) shown in FIG. 31 is a waveform diagram for data voltage, part (b) shown in FIG. 31 is a waveform diagram for gate voltage, and part (c) shown in FIG. 31 is a waveform diagram for transmittance at the time. Furthermore, FIG. 32 is a timing chart for each scanning line, showing the luminance for the light and dark of positive and negative display periods 102 and 104, based on the transmittance of part (c) shown in FIG. 31.

Moreover, in FIG. 32, a time of 16.7 ms is shown by the arrow. With the disclosure in the document, 16.7 ms is defined as the one frame time. However since this definition is not common, this is changed in the figures of the present specification (the one frame time of the disclosure in the literature, with the present invention corresponds to the normal one field time for the conventional technology). The "pseudo DC drive" differs from the normal AC drive shown in FIG. 24, in that the data voltage for the same signal continues to be applied during a plurality of fields. After the plurality of fields, the sign of the data voltage inverts, and the electrical bias disappears. In FIG. 31, after positive writing for four fields, negative writing for four fields is performed, and display of one image signal is finished. The writing timing for each scanning line is as shown in FIG. 32. Positive data is written sequentially from the top, and after repeating four times, the writing of negative data sequentially from the top is repeated four times. With this method, a state is obtained where the applied constant DC voltage and the holding voltage for both ends of the liquid crystal are the same. As a result, the drop in the holding voltage due to response of the liquid crystal disappears. Furthermore, compared to the method as with the AC drive of FIG. 24, where the holding voltage drops due to the response of the liquid crystal, the final transmittance increases. However, the one frame time with this method becomes the total of the plurality of frames for each sign. That is to say, with the example of FIG. 31, the one frame time of this method takes four times the time for the frame of FIG. 24.

Furthermore, a technique for flashing the light source, for a different purpose to field sequencing is known. This is aimed at moving picture correspondence. This is based on the analysis results of display characteristics for two cases. The case where a display method as with a CRT where due to the properties of a fluorescent substance the luminance is reduced suddenly after high luminance is classified as an impulse type, and the case as with a liquid crystal display, where the luminance is held within one field period is classified as a hold type. This analysis is shown in the proceedings of a seminar sponsored by the LCD forum of the Japanese Liquid Crystal Society "LCDs Encroaching into the Market for CRT Monitors—from the Perspective of Moving-Image Quality" on pages 1 to 6. The results of this analysis indicate that in performing satisfactory moving picture display with the hold type, merely improving the response speed of the liquid crystal is insufficient. Moreover, it was indicated that there are problems attributable to the operating method of the hold type where the display light is held. In order to improve this, two methods have been considered, namely (1) to shorten the hold period of the display light, and (2) to arrange the display light as much as possible in the screen position along the movement of the image. With (1), as a method of shortening the hold period, on pages 21 to 23 of the same proceedings a technique is disclosed where a π cell construction which employs a compensating plate is used, and with a high-speed LCD the back light source is flashed to give display. Furthermore, there has also been discussion relating to a technique for shortening the hold period, by continually lighting the back light source and inserting a reset condition.

Furthermore, FIG. 50 shows an example of an equivalent circuit of a single pixel section of an active matrix liquid crystal display, for the case where a twisted nematic liquid crystal (TN liquid crystal) is used.

As shown in FIG. 50, a gate scanning line 5101 is connected to a gate electrode of a switching MOS type transistor (Qn) 551, a data line 5102 is connected to a source electrode, and a pixel electrode 501*e* of a liquid crystal element 501*g* is connected to a drain electrode, with the construction being such that a voltage is applied to the liquid crystal across the opposing electrode 501*f* for drive thereof.

Furthermore, normally a voltage holding capacitor 501*d* is created between the pixel electrode 501*e* and a voltage holding capacitor electrode 501*c*. A typical timing chart for the gate scanning voltage Vg, the data signal voltage Vd, and the pixel electrode voltage Vpix at this time, is shown in FIG. 51.

By having a high level VgH while the gate scanning voltage Vg is in the horizontal scanning period, the MOS type transistor 551 comes on, and the data signal Vd input to the data line is transferred to the pixel electrode 501*e* via the MOS type transistor 551.

When the horizontal scanning period is completed and the gate scanning voltage Vg becomes a low level, the MOS type transistor 551 goes off, and the data signal transferred to the pixel electrode 501*e* is held by the voltage holding capacitor 501*d* and the capacitance of the liquid crystal. At this time, with the pixel voltage Vpix, at the time when the MOS type transistor 551 goes off, a voltage shift referred to as a feed-through voltage occurs via the capacitance between the gate and source of the MOS type transistor 551. In FIG. 51, this voltage shift is shown by Vf1, Vf2 and Vf3. The amount of this voltage shift can be made smaller by increasing the value of the voltage holding capacitor 501*d*.

The pixel voltage Vpix, is held until the gate scanning voltage Vg again becomes a high level in the subsequent horizontal scanning period and the MOS type transistor 551 comes on. At this time, in the holding periods, the pixel voltage Vpix fluctuates slightly in each of the fields by respective amounts ΔV1, ΔV2, and ΔV3. This is in accordance with the liquid crystal response, and is attributable to the change in the capacitance of the liquid crystal. Normally, in order to make this change as small as possible, the voltage holding capacitor 501*d* is set to a value two to three times larger than the pixel capacitance Cpix. As described above, the TN liquid crystal can be driven by the pixel circuit configuration shown in FIG. 50.

However, even if such an accumulation capacitance is used, theoretically there is a limit to the prevention of a drop in the charge holding function. Furthermore, in a highly integrated matrix display device, the provision of a capacitor with a large surface area so as to suppress voltage fluctuations for each pixel, causes a problem in that the load increases with respect to the data signal driver, or the switching MOS type transistor 551, and there is a decrease in the pixel aperture ratio.

Furthermore, although research and development is being made into various liquid crystal materials for achieving high performance of liquid crystal displays. However with these, since a polarizer is not used, the materials are high polymer liquid crystal materials with increased light transmittance, liquid crystal materials having polarization such as ferroelectric liquid crystals and antiferroelectric liquid crystals with a high-speed response and wide viewing angle, and OCB mode liquid crystal material and the like.

However, since for example with the high polymer liquid crystal material, the resistivity is low, and the leakage current is large compared to the TN liquid crystal, the pixel voltage fluctuations during the holding period are large. Also with the liquid crystal material having polarization, similarly due to he redistribution etc. of the charge occurring due to spontaneous polarization, the pixel voltage fluctuations during the holding period are larger than for the case of the TN liquid crystal. Hence with conventional pixel construction, the practical use of a display device which uses such a liquid crystal materials is difficult.

As a method of solving such a problem, a construction, which uses a source-follower type amplifier where the pixel voltage Vpix is kept constant during the holding period, is disclosed for example in Japanese Patent Application, First Publication No. Hei 2-272521, No. Hei 7-20820, No. Hei 10-148848, No. Hei 1-292979, No. Hei 5-173175 and No. Hei 11-326946. According to these methods, the pixel voltage Vpix during the holding period can be kept constant.

FIG. 52 is a diagram showing an example of such an analog amplifier circuit attached pixel. As shown in FIG. 52, a scanning line 5101 is connected to a gate electrode of a switching MOS type transistor (Qn) 561, a data line 5102 is connected to a source electrode, a drain electrode of the MOS type transistor 561 is connected to the input electrode of an analog amplifier circuit 562, and a pixel electrode 501*e* of a liquid crystal element 501*g* is connected to an output electrode, with the construction being such that a voltage is applied to the liquid crystal across the opposing electrode 501*f* for drive thereof.

Normally, the voltage holding capacitor 501*d* is created between the pixel electrode 501*e* and the voltage holding capacitor electrode 501*c*. The power source line of the analog amplifier circuit 562 is connected to a separately provided amplifier positive power source electrode 564 and amplifier negative power source electrode 563. Alternatively, in order to simply the circuit construction, the configuration may be such that one is connected to the scanning line and one is connected to an existing electrode such as the voltage holding capacitor electrode 501*c*.

FIG. 52 shows the case where the positive power source electrode 564 and the amplifier negative power source electrode 563 are provided. The operation of this circuit is basically the same as for the case described for the circuit shown in FIG. 50 and FIG. 51. However when the switching transistor is off, a predetermined voltage continues to be applied to the liquid crystal element 501*g* by the analog amplifier circuit 562. Hence the voltage fluctuations ΔV1, ΔV2 and ΔV3 produced in FIG. 51 can be suppressed.

Furthermore, in Japanese Patent Application, First Publication No. Hei 2-272521, No. Hei 7-20820 and No. Hei 10-148848 is disclosed a construction where the positive power source (VDD) line and the negative power source (VSS) line of the source-follower type amplifier circuit are provided separate to the normal bus line.

However, with this construction, the circuit construction becomes complicated, and the aperture ratio also is reduced.

In the aforesaid Japanese Patent Application, First Publication No. Hei 10-148848, increase in the size can be avoided by common use of the power source line in a plurality of lines. However the necessity arises for an increase in the amount of wiring. On the other hand, in Japanese Patent Application, First Publication No. Hei 1-292979, No. Hei 5-173175 and No. Hei 11-326946 a construction is proposed where either one of the negative power source lines and the positive power source lines of the amplifier circuit are connected to the gate scanning line, making a special bus line unnecessary. With this method, the pixel voltage Vpix during the holding period can be kept constant, with a simple construction where the aperture ratio is lowered only slightly.

With the aforementioned pseudo DC drive, compared to the AC drive, a long frame period (in FIG. 31 and FIG. 32, this is four times that of the AC drive) is necessary, high-speed response is not activated. Furthermore, as a result a long period flicker occurs oscillating at several times the normal frame time (16.7 ms) as shown by the luminance in light and dark in FIG. 32. Due to these results there is a problem in that display coordination with a moving picture is difficult.

Furthermore, with the method which compares the accumulation charge before and after writing, as mentioned before, there is the problem in that a comparison operation section etc. in addition to the frame memory is necessary, thus causing an enlargement of the system.

Moreover, with the reset method, within one field period there exists for example a writing period, a response period (the time after writing until the response becomes stable), and a reset period (the time until becoming stable in a constant state for reset writing and resetting). The period in which the display can be actually used becomes the time from the first field time excluding these periods. As a result, with the reset pulse method, there is a problem in that the reset period part, and the time which can be used for display becomes short.

Furthermore, a problem arises in that the reset period part and the scanning period becomes short. Normally the scanning period (writing time) is approximately equal to the field time, being half of the time of the frame time, divided by the scanning line number. However, if a reset period is provided during the field time, the scanning period shown in FIG. 29 becomes that where the reset time subtracted from the field time is divided by the number of scanning lines. As a result due to reset, the scanning period is shortened. A means for combining the interlace drive and the reset so that the reset period does not impose an influence on the scanning period, is disclosed for example in Japanese Patent Application, First Publication No. 4-186217. With this method, the FLC (ferroelectric liquid crystal) panel is driven in the interlace mode, and some scanning lines are reset in the non display period. In this way, the reduction in the scanning period due to the provision of the reset period is somewhat protected. Furthermore, it is considered that since the periods for reset of the adjacent lines are shifted, the flicker is decreased due to averaging. However, with this method also, there is still a problem in that the time which can be used for the reset period part and the display, is shortened.

Such a decrease in the display period is particularly serious with the field sequential display, making it extremely difficult to ensure luminance.

Furthermore, due to the reset there is the occurrence of luminance uneveness inside the panel. As a countermeasure for this point, a slight improvement is possible with the technique disclosed in Japanese Patent Application No. 10-041689.

Moreover, if as shown in FIG. 52, the pixel construction is such that the analog amplifier circuit is used in addition to the conventional pixel construction, then not only with the TN liquid crystal, but also in low resistivity materials such as a high polymer liquid crystal, or liquid crystal materials having polarization such as ferroelectric liquid crystals or antiferroelectric liquid crystals, it is possible to suppress the voltage fluctuations in the liquid crystal pixel potential. However in the case where display is performed with this pixel construction, output deviations of the amplifier directly become display deviations of the pixels. Hence the requirement arises for making the amplifier output constant for each pixel, or for correcting the input voltage in response to the deviations in the amplifier output.

With these output deviations of the amplifier, the characteristic differences etc. of the transistors which constitute the analog amplifier circuit are the principal factor. FIG. 53 shows an equivalent circuit for one pixel to which an analog amplifier circuit is attached, showing a specific construction which uses thin film transistors. As shown in FIG. 53, the construction comprises: an n-type MOS transistor (Qn) 571 with the gate electrode connected to a scanning line 5101 and one of the source electrode and the drain electrode connected to a data line 5102, a p-type MOS transistor 572 with the gate electrode connected to the other of the source electrode and the drain electrode of the n-type MOS transistor 571, and one of the source electrode and the drain electrode connected to the scanning line 5101, and the other of the source electrode and the drain electrode connected to the pixel electrode 501*e*, a voltage holding capacitor 501*d* formed between the gate electrode of the p-type MOS transistor 572 and a voltage holding capacitor electrode 501*c*, a resistance (RL) 573 connected between the pixel electrode 501*e* and the voltage holding capacitor electrode 501*c*, and a liquid crystal 501*g*, the orientation of which is to be changed, disposed between the pixel electrode 501*e* and an opposing electrode 501*f*.

With the construction shown in FIG. 53, the pixel electrode 501*e* is driven by the analog amplifier circuit even after the horizontal scanning period is completed. Therefore, the fluctuations in the pixel voltage Vpix (=amplifier output voltage Vout) accompanying the response of the liquid crystal as described for the conventional technology, can be suppressed.

At this time, the amplifier output voltage changes due to the value of the transconductance gmp of the p-type MOS transistor, and the resistance RL. This is represented by an equation using the amplifier input voltage Va, and the threshold value Vt of the MOS type transistor used in the amplifier, that is to say:

$$Vout = Va - Vt \quad (1)$$

Therefore, in the conventional technology where only the analog amplifier circuit is fitted, the deviation of the threshold values for each of the pixels directly becomes the deviation of the pixel voltage, so that a decrease in image quality such as with irregular coloring occurs. This decrease in image quality is greater in the case of a large screen where the characteristic differences of the transistors is increased. However under present conditions where the demand for high detail and multiple gray scale is severe, there are also problems with small size screens.

Furthermore, if the pixel construction, where either one of the negative power source lines and the positive power source lines of the amplifier circuit are connected to the gate scanning line, is used, with a simple construction, the fluctuations in the liquid crystal pixel potential can be suppressed without much decrease in the aperture ratio. However in the case where display is performed with this pixel construction, the following problems arise.

In the conventional pixel construction shown in FIG. 50, all that is connected to the gate scanning line is the gate electrode of the switching transistor (Qn) 551. However, in the construction shown in FIG. 74, a current is continually supplied from the positive power source side of the amplifier to the negative power source side through the analog amplifier circuit 2302. Therefore, when the switching transistor is in the off condition, the potential of the gate scanning line shifts either to positive, for the n-type MOS, with respect to the low level side power source voltage of the gate driver, or to negative, for the p-type MOS, with respect to the high level side power source voltage of the gate driver. Since this potential shift amount increases monotonously with respect to the pixel number, then in a high resolution panel, a problem arises in that the low level of the gate scanning potential exceeds the threshold value of the switching transistor, and pixel selection is no longer normally performed.

SUMMARY OF THE INVENTION

Accordingly, it is an object of the present invention to provide a liquid crystal display device with a long period which can be actually used in the display, and a method for driving the same.

Furthermore, it is another object of the present invention to provide a liquid crystal display device with a high light utilization factor, and a method for driving the same.

Moreover, it is another object of the present invention to provide a liquid crystal display device with simplified linking with a light source, and a method for driving the same.

In addition, it is another object of the present invention to provide a liquid crystal display device where a drive method for the liquid crystal display section and the lighting method for the optical system are synchronized, and a method for driving the same.

Moreover, it is another object of the present invention to provide a liquid crystal display device where, in a pixel constructed with an analog amplifier circuit for suppressing pixel voltage fluctuations during a holding period added thereto, display fluctuations for each of the pixels which are attributable to fluctuations in the amplifier output can be suppressed.

Furthermore, it is another object of the present invention to provide a liquid crystal display device where, in a pixel circuit constructed with an analog amplifier circuit for suppressing pixel voltage fluctuations during a holding period added thereto, and a power source line of this analog amplifier circuit connected to a gate scanning line, fluctuations in the gate scanning voltage arising as mentioned above can be reduced. Moreover, it is an object to appropriately perform on and off switching of a switching transistor, to suppress fluctuations in the pixel voltage while simplifying the circuit and maintaining a high aperture ratio for the display section. Furthermore, it is an object to be able to use liquid crystal materials having polarization or liquid crystal materials with a low resistivity.

According to the present invention, the above objects are achieved by a liquid crystal display device incorporating a liquid crystal display section having data drive circuits provided along both of two opposite sides of a rectangular display region, and gate drive circuits provided along the other two opposite sides, wherein with the liquid crystal display section, the gate drive circuits are formed severally divided, and each data line group respectively extending from each of the data drive circuits is electrically separated respectively by the severally divided gate drive circuits, and there is provided a color/time division incident optical system arranged so as to sequentially shine light with different chromaticity onto the display region, and a synchronizing section for synchronizing the liquid crystal display section and the color/time division incident optical system under predetermined conditions.

To explain in more detail, the liquid crystal display device has a liquid crystal display section with data drive circuits at both the top and bottom (or the left and right) of the display region, and gate drive circuits at the left or right (or the top and bottom) of the display region. In the liquid crystal display section, each data line group respectively extending from each data drive circuit, is electrically separated at the top and bottom (or the left and right) of the display region. Furthermore, the gate drive circuits are formed divided into top and bottom (or left and right). Moreover, the color/time division incident optical system is arranged so as to sequentially shine light with different chromaticity onto the display region. The liquid crystal display section and the color/time division incident optical system are synchronized by the synchronizing section under predetermined conditions.

Moreover, with the present invention, the above objects are achieved by a liquid crystal display device incorporating a liquid crystal display section having data drive circuits provided along both of two opposite sides of a rectangular display region, and gate drive circuits provided along the other two opposite sides of the rectangular display region, wherein with the liquid crystal display section, the gate drive circuits are formed severally divided, and each data line group respectively extending from each of the data drive circuits is electrically separated respectively by the severally divided gate drive circuits, and there is provided a light and dark flashing incident optical system arranged so that flashing light (light and dark light) between dark states of a fixed period is shone onto the display region, and a synchronizing section for synchronizing the liquid crystal display section and the light and dark flashing incident optical system under predetermined conditions.

To explain in more detail, the liquid crystal display device has a liquid crystal display section with data drive circuits at both the top and bottom (or the left and right) of the display region, and gate drive circuits at the left or right (or the top and bottom) of the display region. In the liquid crystal display section, each data line group respectively extending from each data drive circuit, is electrically separated at the top and bottom (or the left and right) of the display region. Furthermore, the gate drive circuits are formed divided into top and bottom (or left and right). Moreover, the light and dark flashing incident optical system is arranged so that flashing light (light and dark light) between dark states of a fixed period is shone onto the display region. The liquid crystal display section and the light and dark flashing incident optical system are synchronized by the synchronizing section under predetermined conditions.

Moreover, with the present invention, the above objects are achieved by a drive method for a liquid crystal display device for driving the liquid crystal display device mentioned above, wherein reset is performed en bloc in each of the gate drive circuits. That is, the feature is that reset is performed en bloc in each of the gate drive circuits.

In the above manner, in the case where the power source is an en bloc lighting type, the scanning of each gate drive circuit block is started at approximately the same time. Consequently, the result is obtained in that a liquid crystal display device with a long period which can be used in the display is realized.

Furthermore, since the display period can be lengthened, and the liquid crystal display device and the light source can be linked by devising the drive method, there is the result that a liquid crystal display device is obtained with a high light utilization factor.

Moreover, with the invention, since the drive circuit is divided and the respective drive circuit units are miniaturized, this gives the result that a low cost simple construction drive circuit can be used.

Furthermore, with the invention, since the synchronization of the drive method for the light source is optimized, there is the result that an extremely high resolution picture display is obtained.

Moreover, with the invention, the above objects are achieved by a liquid crystal display device for driving pixel electrodes using MOS type transistor circuits incorporating an amplifier output transfer function and respectively disposed in the vicinity of respective intersection points of a plurality of scanning lines and a plurality of data lines, the device incorporating; a detection device for detecting the output of the amplifier output transfer function for all bits, and a compensation device for performing output compensation on the amplifier output transfer function for each pixel, based on the detection results of the detection device.

That is to say, with the liquid crystal display device described above, in an active matrix liquid crystal display device for driving pixel electrodes using MOS type transistor circuits respectively disposed in the vicinity of respective intersection points of a plurality of scanning lines and a plurality of data lines, a MOS type transistor circuit is formed from: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; a voltage holding capacitor formed between the input electrode of the MOS type analog amplifier circuit and a voltage holding capacitor electrode; and a switch with an input electrode connected to an output electrode of the MOS type analog amplifier circuit and an output electrode connected to an amplifier monitor line or the data line.

Moreover, with the liquid crystal display device described above, in the above construction there is provided; a detection device for detecting a difference of a reference voltage with respect to an amplifier output voltage which has been transferred in a predetermined sequence by the read out circuit through an amplifier monitor line or a data line, a memory for storing the difference voltage, and a voltage generating device for applying a compensation voltage based on the memory data, to an input image signal.

Furthermore, with the invention, the above objects are achieved by a liquid crystal display device for driving pixel electrodes using MOS type transistor circuits incorporating an amplifier output transfer function and respectively disposed in the vicinity of respective intersection points of a plurality of scanning lines and a plurality of data lines, wherein the MOS type transistor circuits comprise: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; a voltage holding capacitor formed between the input electrode of the MOS type analog amplifier circuit and a voltage holding capacitor electrode; and a switch with an input electrode connected to an output electrode of the MOS type analog amplifier circuit and an output electrode connected to one of an amplifier monitor line and the data line, and has: a read out circuit for reading out an output voltage of the analog amplifier circuit through one of the amplifier monitor line and data line, a detection circuit for detecting a difference between an output voltage from the analog amplifier circuit which has been transferred in a predetermined sequence by the read out circuit, and a previously set reference voltage; a conversion device for converting the difference voltage from the detection circuit into digital data; a memory for storing the difference voltage which had been digitized; and a voltage generating device for applying a compensation voltage corresponding to the storage data of the memory, to an input image signal.

That is to say, with the liquid crystal display device described above, in the aforementioned construction, in an active matrix liquid crystal display device for driving pixel electrodes using MOS type transistor circuits respectively disposed in the vicinity of respective intersection points of a plurality of scanning lines and a plurality of data lines, a MOS type transistor circuit is formed from: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; a voltage holding capacitor formed between the input electrode of the MOS type analog amplifier circuit and a voltage holding capacitor electrode; and a switch with an input electrode connected to an output electrode of the MOS type analog amplifier circuit and an output electrode connected to an amplifier monitor line or the data line.

Moreover, with the liquid crystal display device described above, in the above construction a feature is that one end of the amplifier monitor line constitutes a terminal electrode whereby measurement is possible by an external measuring device. Furthermore, with a second liquid crystal display device of the present invention, in the above construction, there is provided a non volatile memory for storing difference voltages detected by the external measuring device, and a voltage generating device for applying a compensation voltage based on data of the non volatile memory, to the input image signal.

With the aforementioned liquid crystal display device, the output from the analog amplifier circuit which is actually used in the pixel is detected for all bits, and based on this output value, output compensation for the analog amplifier circuit for each pixel is performed. Therefore, a decrease in image quality attributable to characteristic differences in the analog amplifier circuit does not arise.

Furthermore, with the invention, the above objects are achieved by an active matrix liquid crystal display device for driving pixel electrodes using MOS type transistor circuits incorporating an amplifier output transfer function and respectively disposed in the vicinity of respective intersection points of a plurality of scanning lines and a plurality of data lines, wherein the MOS type transistor circuits comprise: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; a voltage holding capacitor formed between the input electrode of the MOS type analog amplifier circuit and a voltage holding capacitor electrode; and a switch with an input electrode connected to an output electrode of the MOS type analog amplifier circuit and an output electrode connected to one of an amplifier monitor line and the data line, and incorporate: a terminal electrode connected to the end of one of the amplifier monitor line and the data line, for outputting an output from the MOS type analog amplifier circuit to the outside; a memory for storing the output voltage data from the MOS type analog amplifier circuit which has been measured outside; and a voltage generating device for applying a compensation voltage corresponding to the storage data of the memory, to an input image signal.

That is to say, the above described liquid crystal display device is characterized in that in an active matrix liquid crystal display device for driving pixel electrodes using MOS type transistor circuits respectively disposed in the vicinity of respective intersection points of a plurality of scanning lines and a plurality of data lines, and where a semiconductor layer of the MOS type transistor circuits is a thin film semiconductor layer which has been crystallized or recrystallized by laser annealing, and at the time of the laser annealing the scanning direction of the laser is parallel to or at an angle substantially the same as the scanning line, apart from display pixels each comprising: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode; there are amplifier output detection pixels formed on a scanning line of a screen edge portion.

With the amplifier output detection pixel, in the construction of the display pixel, a switch with an input electrode connected to an output electrode of the MOS type analog amplifier circuit and an output electrode connected to an amplifier monitor line or the data line, is added.

Moreover, with the liquid crystal display device described above, in the above construction there is provided; a detection device for detecting a difference of a reference voltage with respect to an amplifier output voltage which has been transferred in a predetermined sequence by the read out circuit through an amplifier monitor line or a data line, a memory for storing the difference voltage, and a voltage generating device for applying a compensation voltage based on the memory data, to an input image signal.

Furthermore, according to the invention, the object is achieved by a liquid crystal display device for driving pixel electrodes using MOS type transistor circuits incorporating an amplifier output transfer function and respectively disposed in the vicinity of respective intersection points of a plurality of scanning lines and a plurality of data lines, and where a semiconductor layer of the MOS type transistor circuits is a thin film semiconductor layer which has been subjected to either of crystallizing and recrystallizing by laser annealing, and at the time of the laser annealing the laser is scanned substantially parallel with the scanning line, the device incorporating: a detection device for detecting the output of the amplifier output transfer function, and a compensation device for performing output compensation on the amplifier output transfer function only with respect to the laser scanning direction at the time of the laser annealing, based on the detection results of the detection device; and a voltage generating device for applying a compensation voltage based on data of the non volatile memory, to the input image signal.

That is to say, with the described liquid crystal display device, the object is achieved with a liquid crystal display device where, in an active matrix liquid crystal display device for driving pixel electrodes using MOS type transistor circuits respectively disposed in the vicinity of respective intersection points of a plurality of scanning lines and a plurality of data lines, and where a semiconductor layer of the MOS type transistor circuits is a thin film semiconductor layer which has been crystallized or recrystallized by laser annealing, and at the time of the laser annealing the scanning direction of the laser is parallel to or at an angle substantially the same as the scanning line, apart from display pixels each comprising: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode; there are amplifier output detection pixels formed on a scanning line of a screen edge portion.

With the amplifier output detection pixel, in the construction of the display pixel, a switch with an input electrode connected to an output electrode of the MOS type analog amplifier circuit and an output electrode connected to an amplifier monitor line or the data line, is added. Moreover one end of the amplifier monitor line becomes a terminal electrode whereby measurement is possible by an external measuring device.

Moreover, with the liquid crystal display device described above, in the above construction there is provided a non volatile memory for storing difference voltages detected by the external measuring device, and a voltage generating device for applying a compensation voltage based on data of the non volatile memory, to the input image signal.

Moreover, according to the invention the objects are achieved by a liquid crystal display device being a liquid crystal display device for driving pixel electrodes using MOS type transistor circuits incorporating an amplifier output transfer function and respectively disposed in the vicinity of respective intersection points of a plurality of scanning lines and a plurality of data lines, and where a semiconductor layer of the MOS type transistor circuits is a thin film semiconductor layer which has been subjected to either of crystallizing and recrystallizing by laser annealing, and at the time of the laser annealing the laser is scanned substantially parallel with the scanning line, and the device incorporates: display pixels each comprising: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode; amplifier output detection pixels where a switch with an input electrode connected to an output electrode of the MOS type analog amplifier circuit and an output electrode connected to one of an amplifier monitor line and the data line is added to the construction of the display pixels; a read out circuit for reading out an output voltage of the MOS type analog amplifier circuit of the amplifier output detection pixels through one of the amplifier monitor line and data line; a detection circuit for detecting a difference between an output voltage from the MOS type analog amplifier circuit which has been transferred in a predetermined sequence by the read out circuit, and a reference voltage; a conversion device for converting the difference voltage from the detection circuit into digital data; a memory for storing the difference voltage which had been digitized by the conversion device; and a voltage generating device for applying a compensation voltage corresponding to the storage data of the memory, to an input image signal.

That is to say, the above described liquid crystal display device is characterized in that, in an active matrix liquid crystal display device for driving pixel electrodes using MOS type transistor circuits respectively disposed in the vicinity of respective intersection points of a plurality of scanning lines and a plurality of data lines, and where a semiconductor layer of the MOS type transistor circuits is a thin film semiconductor layer which has been crystallized or recrystallized by laser annealing, and at the time of the laser annealing the scanning direction of the laser is parallel to or at an angle substantially the same as the data line, apart from display pixels each comprising: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode; there are amplifier output detection pixels formed on a data line of a screen edge portion.

With the amplifier output detection pixel, in the construction of the display pixel, a switch with an input electrode connected to an output electrode of the MOS type analog amplifier circuit and an output electrode connected to an amplifier monitor line or the data line, is added.

Moreover, with the liquid crystal display device described above, in the above construction there is provided; a detection device for detecting a difference of a reference voltage with respect to an amplifier output voltage which has been transferred in a predetermined sequence by the read out circuit through an amplifier monitor line or a data line, a memory for storing the difference voltage, and a voltage generating device for applying a compensation voltage based on the memory data, to an input image signal.

Furthermore, according to the invention, the object is achieved by a liquid crystal display device where with a liquid crystal display device for driving pixel electrodes using MOS type transistor circuits incorporating an amplifier output transfer function and respectively disposed in the vicinity of respective intersection points of a plurality of scanning lines and a plurality of data lines, and where a semiconductor layer of the MOS type transistor circuits is a thin film semiconductor layer which has been subjected to either of crystallizing and recrystallizing by laser annealing, and at the time of the laser annealing the laser is scanned substantially parallel with the scanning line, the device incorporates: display pixels each comprising: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode; amplifier output detection pixels where a switch with an input electrode connected to an output electrode of the MOS type analog amplifier circuit and an output electrode connected to one of an amplifier monitor line and the data line is added to the construction of the display pixels; a terminal electrode connected to the end of one of the amplifier monitor line and the data line, for outputting an output from the MOS type analog amplifier circuit of the amplifier output detection pixel to the outside; a memory for storing the output voltage data from the MOS type analog amplifier circuit which has been measured outside; and a voltage generating device for applying a compensation voltage corresponding to the storage data of the memory, to an input image signal.

That is to say, the above described liquid crystal display device is characterized in that in that, in an active matrix liquid crystal display device for driving pixel electrodes using MOS type transistor circuits respectively disposed in the vicinity of respective intersection points of a plurality of scanning lines and a plurality of data lines, and where a semiconductor layer of the MOS type transistor circuits is a thin film semiconductor layer which has been crystallized or recrystallized by laser annealing, and at the time of the laser annealing the scanning direction of the laser is parallel to or at an angle substantially the same as the data line, apart from display pixels each comprising: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode; there are amplifier output detection pixels formed on a data line of a screen edge portion.

With the amplifier output detection pixel, in the construction of the display pixel, a switch with an input electrode connected to an output electrode of the MOS type analog amplifier circuit and an output electrode connected to an amplifier monitor line or the data line, is added. Moreover one end of the amplifier monitor line becomes a terminal electrode whereby measurement is possible by an external measuring device.

Moreover, with the liquid crystal display device described above, in the above construction there is provided a non volatile memory for storing difference voltages detected by the external measuring device, and a voltage generating device for applying a compensation voltage based on data of the non volatile memory, to the input image signal.

Furthermore, according to the above described liquid crystal display device, when a p-Si transistor comprising a thin film semiconductor layer which has been crystallized or re-crystallized by laser annealing is used, then by performing compensation of the amplifier output only with respect to the laser scanning direction for which difference in transistor characteristic are likely to occur, effective compensation can be made with a small scale compensation circuit.

Moreover, according to the invention, the object is achieved by a liquid crystal display device where with a liquid crystal display device for driving pixel electrodes using MOS type transistor circuits incorporating an amplifier output transfer function and respectively disposed in the vicinity of respective intersection points of a plurality of scanning lines and a plurality of data lines, and where a semiconductor layer of the MOS type transistor circuits is a thin film semiconductor layer which has been subjected to either of crystallizing and recrystallizing by laser annealing, and at the time of the laser annealing the laser is scanned substantially parallel with the data line, the device incorporates: display pixels each comprising: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode; amplifier output detection pixels where a switch with an input electrode connected to an output electrode of the MOS type analog amplifier circuit and an output electrode connected to one of an amplifier monitor line and the data line is added to the construction of the display pixels; a terminal electrode connected to the end of one of the amplifier monitor line and the data line, for outputting an output from the MOS type analog amplifier circuit of the amplifier output detection pixel to the outside; a memory for storing the output voltage data from the MOS type analog amplifier circuit which has been measured outside; and a voltage generating device for applying a compensation voltage corresponding to the storage data of the memory, to an input image signal.

That is to say, the liquid crystal display device described above is characterized in comprising, in an active matrix liquid crystal display device for driving pixel electrodes using MOS type transistor circuits respectively disposed in the vicinity of respective intersection points of a plurality of scanning lines and a plurality of data lines, display pixels each comprising: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode; and amplifier output detection pixels multiply provided at at least four points on an external edge portion of a screen.

With the amplifier output detection pixel, in the construction of the display pixel, a switch with an input electrode connected to an output electrode of the MOS type analog amplifier circuit and an output electrode connected to an amplifier monitor line or the data line, is added.

Moreover, with the liquid crystal display device described above, in the above construction there is provided; a detection device for detecting a difference of a reference voltage with respect to an amplifier output voltage which has been transferred in a predetermined sequence by the read out circuit through an amplifier monitor line or a data line; a first memory for storing the difference voltage; an interpolation circuit for computing compensation voltages for all bits from data of the first memory; a second memory for storing compensation voltages computed by the interpolation circuit; and a voltage generating device for applying a compensation voltage based on the second memory data, to an input image signal.

Furthermore according to the invention, the objects are achieved by a liquid crystal display device for driving pixel electrodes using MOS type transistor circuits incorporating an amplifier output transfer function and respectively disposed in the vicinity of respective intersection points of a plurality of scanning lines and a plurality of data lines, and incorporating; a detection device for detecting the output of the amplifier output transfer function for a predetermined bit set beforehand, and a compensation device which performs linear interpolation processing between pixels for which detection of the output of the amplifier output transfer function has been performed, based on the detection results of the detection device.

That is to say, the liquid crystal display device described above is characterized in comprising, in an active matrix liquid crystal display device for driving pixel electrodes using MOS type transistor circuits respectively disposed in the vicinity of respective intersection points of a plurality of scanning lines and a plurality of data lines, display pixels each comprising: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode; and amplifier output detection pixels multiply provided at at least four points on an external edge portion of a screen.

With the amplifier output detection pixel, in the construction of the display pixel, a switch with an input electrode connected to an output electrode of the MOS type analog amplifier circuit and an output electrode connected to an amplifier monitor line or the data line, is added. Moreover one end of the amplifier monitor line becomes a terminal electrode whereby measurement is possible by an external measuring device.

Moreover, with the liquid crystal display device described above, in the above construction there is provided a non volatile memory for storing amplifier output compensation voltages for all bits, which have been obtained by interpolation of difference voltages detected by the external measuring device and the aforementioned difference voltage, and a voltage generating device for applying a compensation voltage based on data of the non volatile memory, to an input image signal. In this case, linear interpolation is performed by selecting the four points of the amplifier output detection pixels closest to the bit for which the compensation voltage is computed.

Furthermore, according to the above described liquid crystal display device, in the case where amplifier output detection is not performed for all of the bits, by performing linear interpolation processing between pixels for which amplifier output detection has been performed, the compensation accuracy is improved, thus still enabling effective compensation to be made with a small scale circuit construction.

In addition, by making the memory for storing compensation voltages a non volatile memory, and using an external measuring device for one part of the detection process, then the circuit construction for the compensation from detection of the amplifier output can be simplified.

Furthermore, according to the invention, the objects are achieved by a liquid crystal display device where with a liquid crystal display device for driving pixel electrodes using MOS type transistor circuits incorporating an amplifier output transfer function and respectively disposed in the vicinity of respective intersection points of a plurality of scanning lines and a plurality of data lines, the device incorporates: display pixels each comprising: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode; amplifier output detection pixels where a switch with an input electrode connected to an output electrode of the MOS type analog amplifier circuit and an output electrode connected to one of an amplifier monitor line and the data line is added to the construction of the display pixels; a read out circuit for reading out an output voltage of the MOS type analog amplifier circuit of the amplifier output detection pixels through one of the amplifier monitor line and data line; a detection circuit for detecting a difference between an output voltage from the MOS type analog amplifier circuit which has been transferred in a predetermined sequence by the read out circuit, and a reference voltage; a conversion device for converting the difference voltage from the detection circuit into digital data; a first memory for storing the difference voltage which had been digitized by the conversion device; an interpolation device for computing by linear interpolation, compensation voltages for all bits from storage data of the first memory; a second memory for storing compensation voltages computed by the interpolation device; and a voltage generating device for applying a compensation voltage corresponding to the storage data of the second memory, to an input image signal.

Moreover, according to the invention, the objects are achieved with a liquid crystal display device where with a liquid crystal display device for driving pixel electrodes using MOS type transistor circuits incorporating an amplifier output transfer function and respectively disposed in the vicinity of respective intersection points of a plurality of scanning lines and a plurality of data lines, the device incorporates: display pixels each comprising: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode; amplifier output detection pixels where a switch with an input electrode connected to an output electrode of the MOS type analog amplifier circuit and an output electrode connected to one of an amplifier monitor line and the data line is added to the construction of the display pixels; a read out circuit for reading out an output voltage of the MOS type analog amplifier circuit of the amplifier output detection pixels through one of the amplifier monitor line and data line; a detection circuit for detecting a difference between an output voltage from the MOS type analog amplifier circuit which has been transferred in a predetermined sequence by the read out circuit, and a reference voltage; a conversion device for converting the difference voltage from the detection circuit into digital data; a memory for storing the difference voltage which had been digitized by the conversion device; an interpolation device for computing by linear interpolation, compensation voltages for all bits from storage data of the memory; and a voltage generating device for applying a compensation voltage corresponding to the storage data of the second memory, to an input image signal.

Moreover, according to the invention, the objects are achieved with a liquid crystal display device where with a liquid crystal display device for driving pixel electrodes using MOS type transistor circuits incorporating an amplifier output transfer function and respectively disposed in the vicinity of respective intersection points of a plurality of scanning lines and a plurality of data lines, the device incorporates: display pixels each comprising: a MOS transistor with a gate electrode connected to the scanning line and one of a source electrode and a drain electrode connected to the data line; a MOS type analog amplifier circuit with an input electrode connected to the other of the source electrode and the drain electrode of the MOS type transistor, and an output electrode connected to a pixel electrode; and a voltage holding capacitor formed between the input electrode of the MOS type analog amplifier circuit and a voltage holding capacitor electrode; amplifier output detection pixels where a switch with an input electrode connected to an output electrode of the MOS type analog amplifier circuit and an output electrode connected to one of an amplifier monitor line and the data line is added to the construction of the display pixels; a terminal electrode connected to the end of one of the amplifier monitor line and the data line, for outputting an output from the MOS type analog amplifier circuit of the amplifier output detection pixel to the outside; a memory for storing the output voltage data from the MOS type analog amplifier circuit which has been measured outside; and a voltage generating device for applying a compensation voltage corresponding to the storage data of the memory, to an input image signal.

As described above, with the present invention, since a MOS type analog amplifier circuit is added with an input electrode connected to a data line via a switching MOS transistor, and an output electrode connected to the pixel electrode, the effect is obtained in that it is possible to use liquid crystal materials in which voltage fluctuations occur during the holding period as with the conventional technology, such as a high polymer liquid crystal, a ferroelectric liquid crystal or antiferroelectric liquid crystal having polarization, or an OCB (Optical Compensated Birefringence) liquid crystal.

Moreover with the present invention, in a liquid crystal display device for driving pixel electrodes using MOS type transistor circuits incorporating an amplifier output transfer function and respectively disposed in the vicinity of respective intersection points of a plurality of scanning lines and a plurality of data lines, in pixels constructed with an attached analog amplifier circuit for detecting the output of the amplifier output transfer function for all of the pixels, and based on the detection results performing output compensation on the amplifier output transfer function for each pixel, to thereby suppress fluctuations in pixel voltage during a holding period, the effect is obtained that the display deviations for each pixel, attributable to fluctuations in amplifier output can be suppressed.

Moreover according to the invention, the objects are achieved with an active matrix liquid crystal display device comprising: a MOS transistor with a gate electrode connected to a scanning line, and one of a source electrode and a drain electrode connected to a data line; an analog amplifier circuit with an input electrode connected to the other of the source electrode and the drain electrode of the MOS transistor, and an output electrode connected to a pixel electrode, and one of a positive and negative power source line connected to the scanning line; a voltage holding capacitor formed between an input electrode of the analog amplifier circuit and a voltage holding capacitor electrode; and a liquid crystal element which is to be switched, disposed between the pixel electrode and an opposing electrode, wherein a material forming the scanning line contains a low resistance value metal or metal silicide.

Furthermore according to the invention, the objects are achieved with an active matrix liquid crystal display device comprising: an n-type MOS transistor with a gate electrode connected to a scanning line, and one of a source electrode and a drain electrode connected to a data line; an analog amplifier circuit with an input electrode connected to the other of the source electrode and the drain electrode of the n-type MOS transistor, and an output electrode connected to a pixel electrode, and one of a positive and negative power source line connected to the scanning line; a voltage holding capacitor formed between an input electrode of the analog amplifier circuit and a voltage holding capacitor electrode; and a liquid crystal element which is to be switched, disposed between the pixel electrode and an opposing electrode, wherein a low level side power source of a gate driver for driving the scanning line is a negative power source.

Moreover, according to the invention, the objects are achieved with an active matrix liquid crystal display device comprising: a p-type MOS transistor with a gate electrode connected to a scanning line, and one of a source electrode and a drain electrode connected to a data line; an analog amplifier circuit with an input electrode connected to the other of the source electrode and the drain electrode of the p-type MOS transistor, and an output electrode connected to a pixel electrode, and one of a positive and negative power source line connected to the scanning line; a voltage holding capacitor formed between an input electrode of the analog amplifier circuit and a voltage holding capacitor electrode; and a liquid crystal element which is to be switched, disposed between the pixel electrode and an opposing electrode, wherein a high level side power source of a gate driver for driving the scanning line can supply a voltage such that the gate scanning voltage becomes higher than a sum of a maximum value of a data signal voltage and a threshold value of the p-type MOS transistor, for all of the pixels.

Furthermore, with the present invention, an output terminal of an analog amplifier circuit is connected to a liquid crystal display element, and the input terminal is connected to a data line via between a source and a drain of a switching transistor, and a gate scanning line to which the power source line of this analog amplifier is connected is formed from a material containing at least a metal or a metal silicide. As a result, fluctuations in the voltage at the time of non selection of the gate scanning line are suppressed and normal switching operation is achieved. Moreover in a simplified construction with the power source line omitted, there is the effect that deterioration of the image quality is prevented, and liquid crystals such as high polymer liquid crystals with a low resistivity, or ferroelectric or antiferroelectric liquid crystal materials having polarization can be used.

Moreover, in the case where the switching transistor is an n-type, the low level voltage of the gate scanning line driver power source to which the analog amplifier is connected is shifted to negative, while in the case where this is a p-type, the high level voltage of the gate scanning line driver power source to which the analog amplifier circuit is connected is made sufficiently high. As a result, the shift amount of the voltage at the time of non selection of the gate scanning line is reduced, and even with a high resistance wiring material, normal switching operation is achieved. Furthermore in a simplified construction with the power source line omitted, this has the advantage that deterioration of the image quality is prevented, and liquid crystals such as high polymer liquid crystals with a low resistivity, or ferroelectric or antiferroelectric liquid crystal materials having polarization can be used.

DESCRIPTION OF THE PREFERRED EMBODIMENTS

The embodiments hereunder do not limit the invention according to the claims. Furthermore, in order to achieve the objects, combinations of all of the characteristics described in the embodiments are not necessarily required.

Next is a detailed description of embodiments of the present invention with reference to the drawings.

Figure 1:
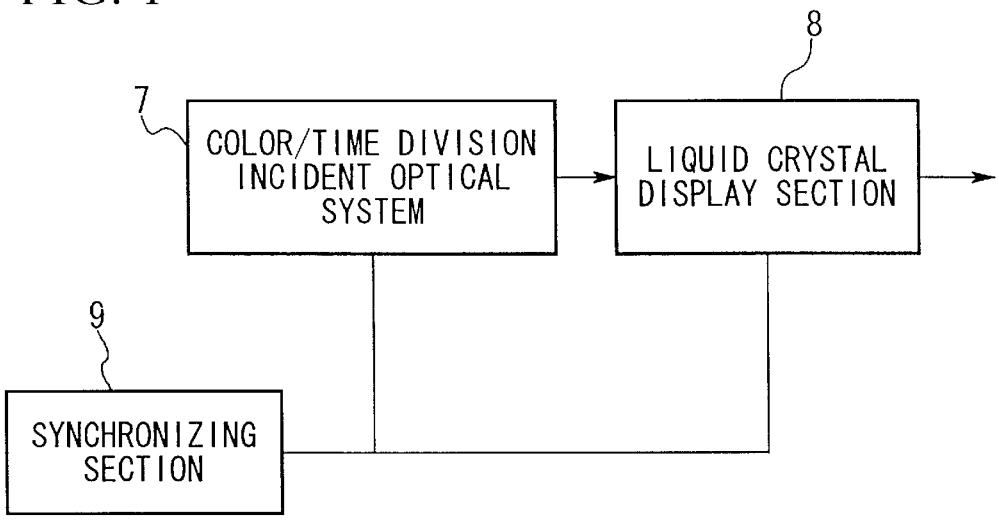
FIG. 1 is a block diagram showing the configuration of a liquid crystal display device according to a first embodiment of the present invention.

FIG. 1 is a block diagram showing the configuration of a liquid crystal display device according to a first embodiment of the present invention. This liquid crystal display device comprises a color/time division incident optical system 7 and a liquid crystal display section 8. The color/time division incident optical system 7 is arranged so as to sequentially shine light with different chromaticity onto this display region. The liquid crystal display section 8 and the color/time division incident optical system 7 are synchronized under predetermined conditions by means of a synchronizing section 9.

Figure 2:
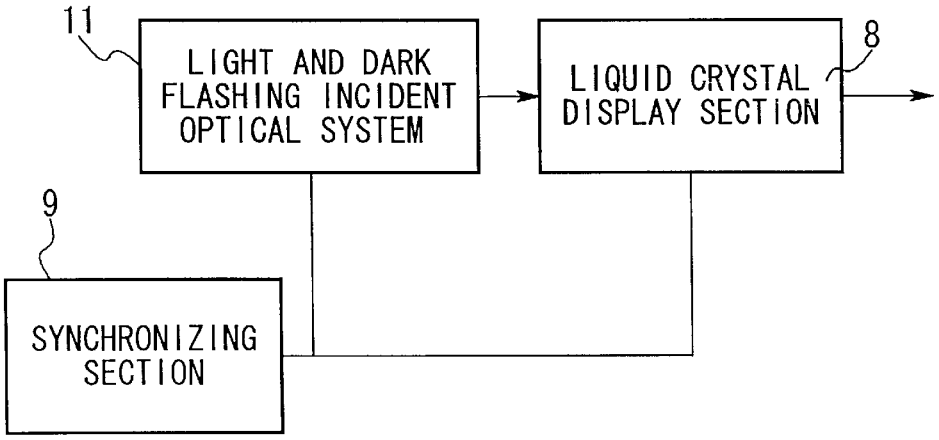
FIG. 2 is a block diagram showing the configuration of a liquid crystal display device according to a second embodiment of the present invention.

FIG. 2 is a block diagram showing the configuration of a liquid crystal display device according to a second embodiment of the present invention. With this liquid crystal display device, a liquid crystal display section 8 the same as that for the first embodiment of the liquid crystal display device shown in FIG. 1, and a light and dark flashing incident optical system 11 are arranged so that flashing light (light and dark light) between dark states of a fixed period is shone onto the display region, and the liquid crystal display section 8 and the light and dark flashing incident optical system 11 are synchronized under predetermined conditions by means of the synchronizing section 9.

Next is a description of embodiments related to liquid crystal display sections, in the liquid crystal display device according to the abovementioned first and second embodiments of the present invention.

At first, a description is given of liquid crystal display sections according to first through sixth embodiments, in the liquid crystal display device according to the abovementioned first embodiment. Then, a description is given concerning liquid crystal display sections according to seventh through twelfth embodiments, in the liquid crystal display device according to the above mentioned second embodiment of the present invention.

Figure 3:
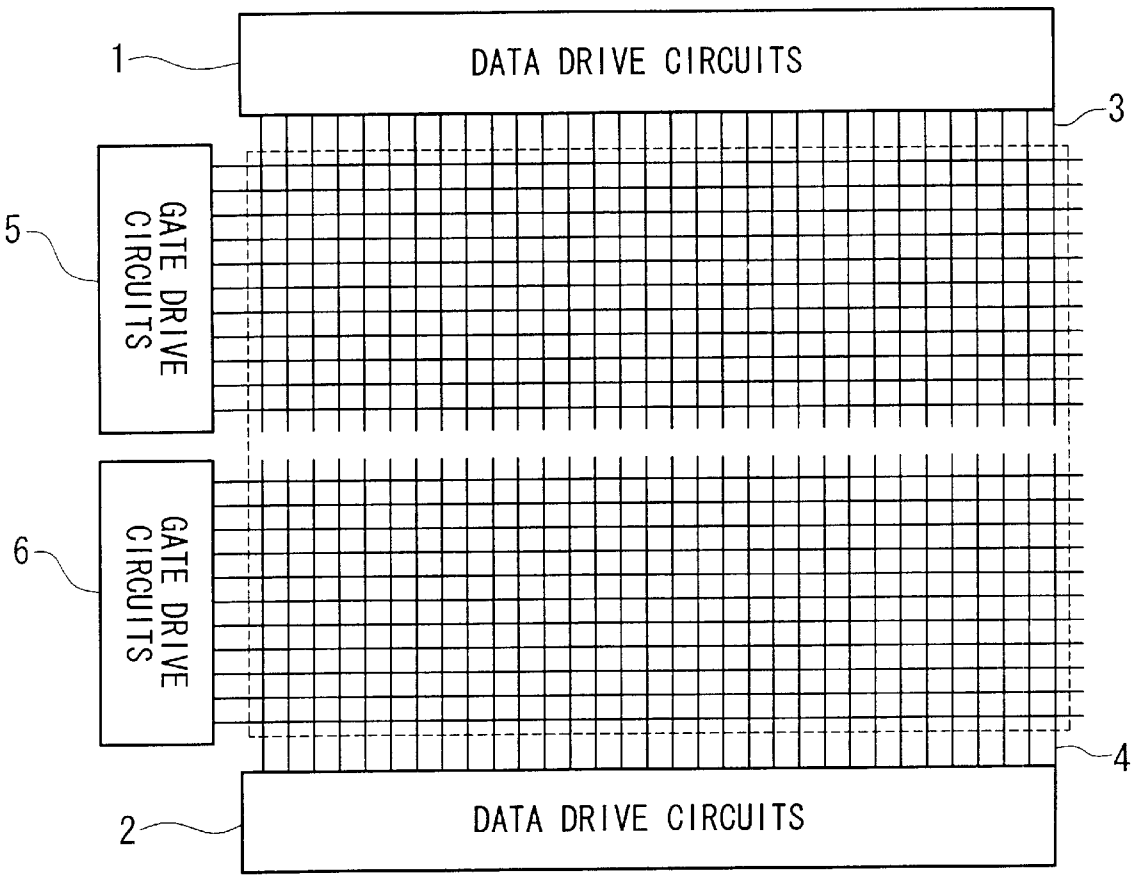
FIG. 3 is a schematic diagram showing display regions and drive circuits of a liquid crystal display section according to a first embodiment of the present invention.

At first, is a description with reference to FIG. 3, of a liquid crystal display section according to the first embodiment of the present invention. FIG. 3 is a schematic diagram showing the construction of the liquid crystal display section according to the first embodiment in the present invention. This liquid crystal display section comprises a display region and a drive circuit. With this embodiment, there are data drive circuits 1 and 2 at both the top and bottom (or the left and right) of the display region of the liquid crystal display device. Each data line group 3 and 4 respectively extending from each data drive circuit 1 and 2, is electrically separated at the top and bottom (or the left and right) of the display region. Furthermore, gate drive circuits 5 and 6 corresponding to the top and bottom (or the left and right), are arranged in a top and bottom (or left and right) divided form, on the left or right (or the top and bottom) of the display region. In FIG. 3, the gate drive circuits 5 and 6 are both shown in a left side arranged condition. However with the present embodiment, the gate drive circuits 5 and 6 may be both arranged on the right side.

Figure 4:
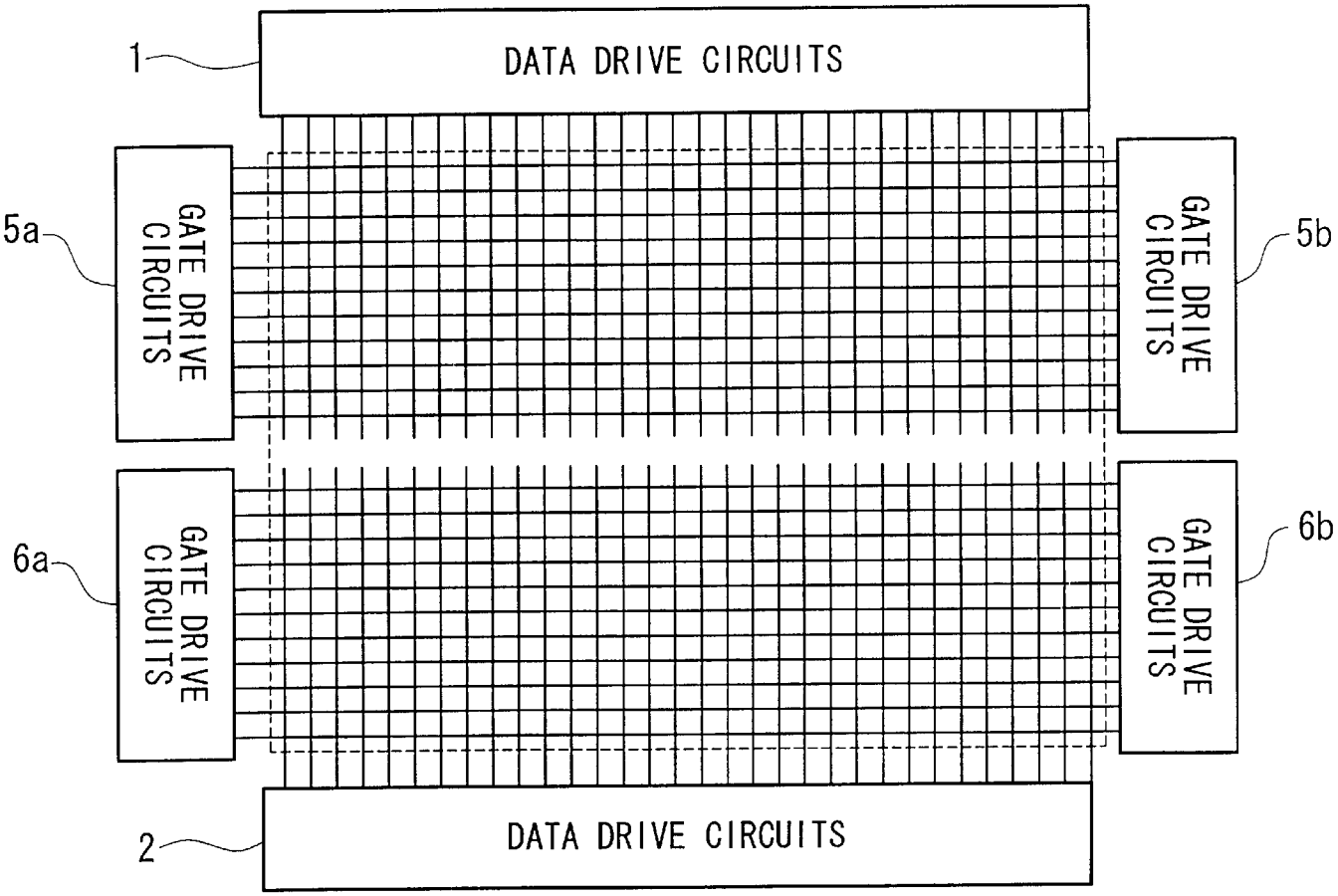
FIG. 4 is a schematic diagram showing display regions and drive circuits of a liquid crystal display section according to a second embodiment of the present invention.

Next is a description with reference to FIG. 4, of the liquid crystal display section according to the second embodiment of the present invention. FIG. 4 is a schematic diagram showing the construction of the second embodiment of the liquid crystal display section in the present invention. The liquid crystal display section in the second embodiment, as with the liquid crystal display section in the abovementioned first embodiment, uses the liquid crystal display device according to the first embodiment of the present invention. However in contrast to the liquid crystal display section according to the first embodiment where the gate drive circuits 5 and 6 are arranged on the same side, namely the left or the right (or the top or bottom) side of the display region, with the liquid crystal display section according to the second embodiment, as shown in FIG. 4, gate drive circuits 5*a* and 6*a* are arranged divided on one of the left or the right (or the top or the bottom) sides of the display region, and gate drive circuits 5*b* and 6*b* are arranged divided on the other of the sides. The arrangement of the data drive circuits 1 and 2 is the same as for the first embodiment.

In this way, with the liquid crystal display section according to the second embodiment, the gate drive circuits 5*a*, 5*b*, 6*a* and 6*b* are in top and bottom (or left and right) divided form, and are arranged on the two sides, namely the left and right (or top and bottom) sides of the display region.

Figure 5:
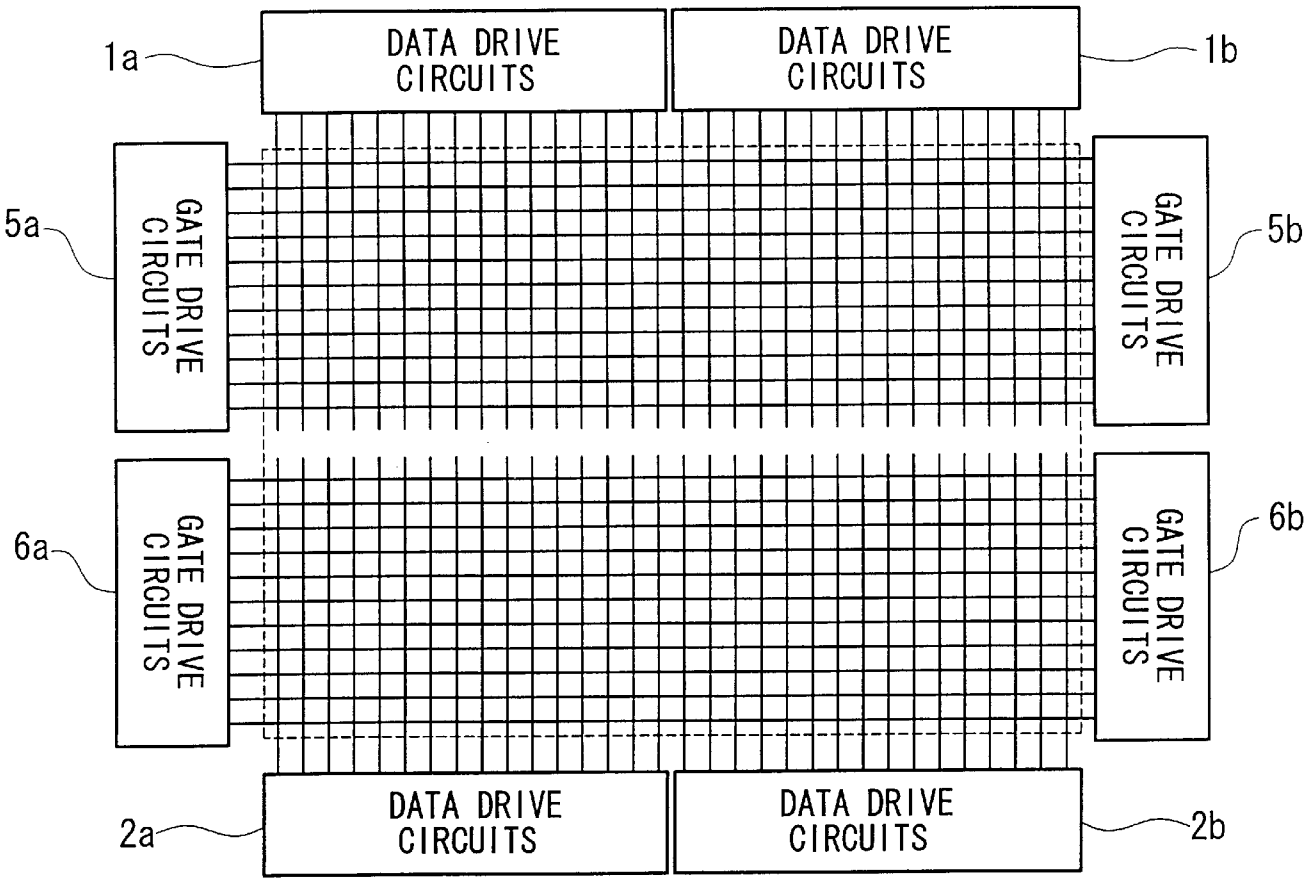
FIG. 5 is a schematic diagram showing display regions and drive circuits of a liquid crystal display section according to a third embodiment of the present invention.

Next is a description with reference to FIG. 5, of the liquid crystal display section according to the third embodiment in the present invention. FIG. 5 is a schematic diagram showing the construction of the liquid crystal display section according to the third embodiment in the present invention. The liquid crystal display section according to the third embodiment, as with the liquid crystal display section in the first and second embodiments, uses the liquid crystal display device according to the first embodiment of the present invention. However the data drive circuits 1 and 2 are each multiply divided transversely (or vertically) at the top and bottom (or the left and right) to give data drive circuits 1*a*, 1*b*, 2*a* and 2*b*. The gate drive circuits 5*a*, 5*b*, 6*a* and 6*b* are the same as for the liquid crystal display section according to the abovementioned second embodiment. In this way, the liquid crystal display section according to the third embodiment shown in FIG. 5, is an example for the case where the data drive circuits 1 and 2 of the liquid crystal display section according to the second embodiment shown in FIG. 4, are divided into two to give data drive circuits 1*a*, 1*b*, 2*a* and 2*b*. Here further multiple divisions may be made.

Figure 6:
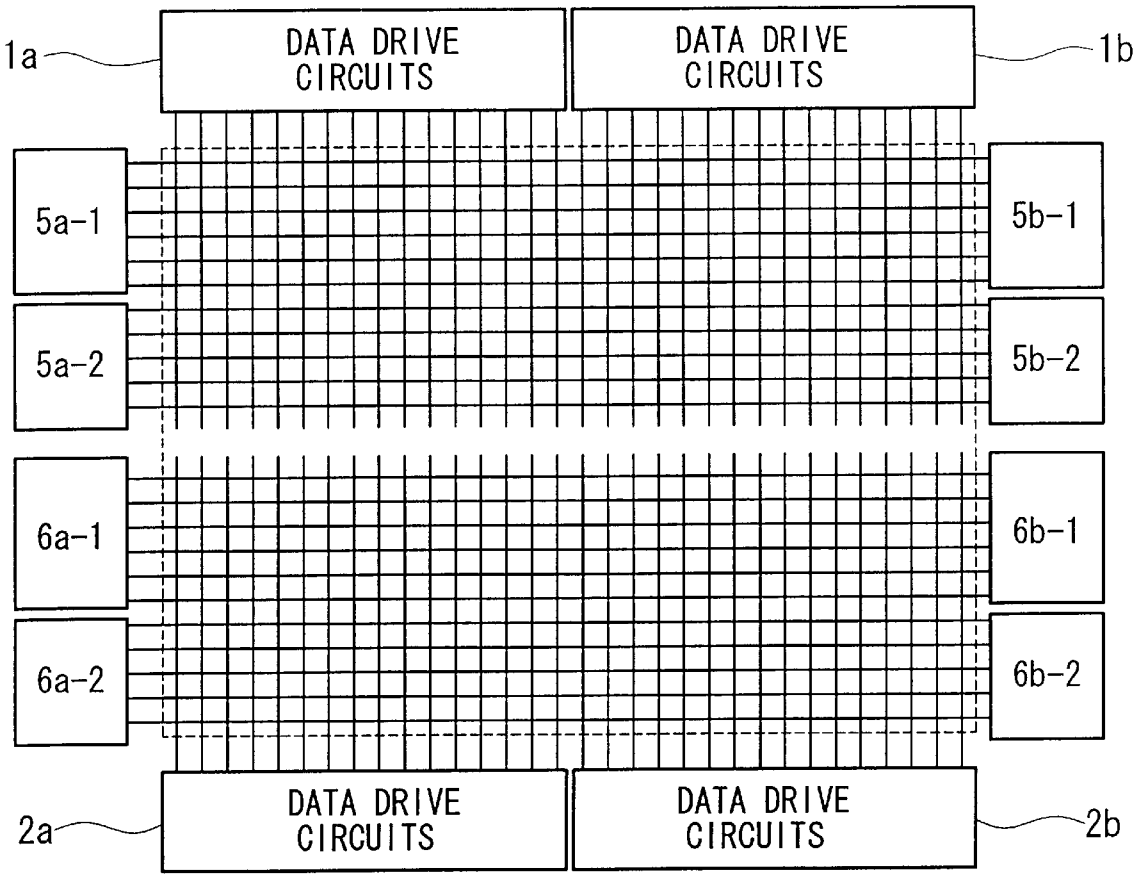
FIG. 6 is a schematic diagram showing display regions and drive circuits of a liquid crystal display section according to a fourth embodiment of the present invention.

Next is a description with reference to FIG. 6, of the liquid crystal display section according to the fourth embodiment in the present invention. FIG. 6 is a schematic diagram showing the construction of the liquid crystal display section according to the fourth embodiment in the present invention. With this embodiment, the gate drive circuit of the liquid crystal display section according to the first through third embodiments, is further multiply divided. That is to say, the gate drive circuits 5*a*, 5*b*, 6*a* and 6*b* of the liquid crystal display section according to the third embodiment, are divided into gate drive circuits 5*a*-1, 5*a*-2, 5*b*-1, 5*b*-2, 6*a*-1, 6*a*-2, 6*b*-1 and 6*b*-2. In this way, in the liquid crystal display section according to the fourth embodiment shown in FIG. 6, the example is shown of one part of a liquid crystal display section for the case where the gate drive circuit is divided into four.

Figure 7:
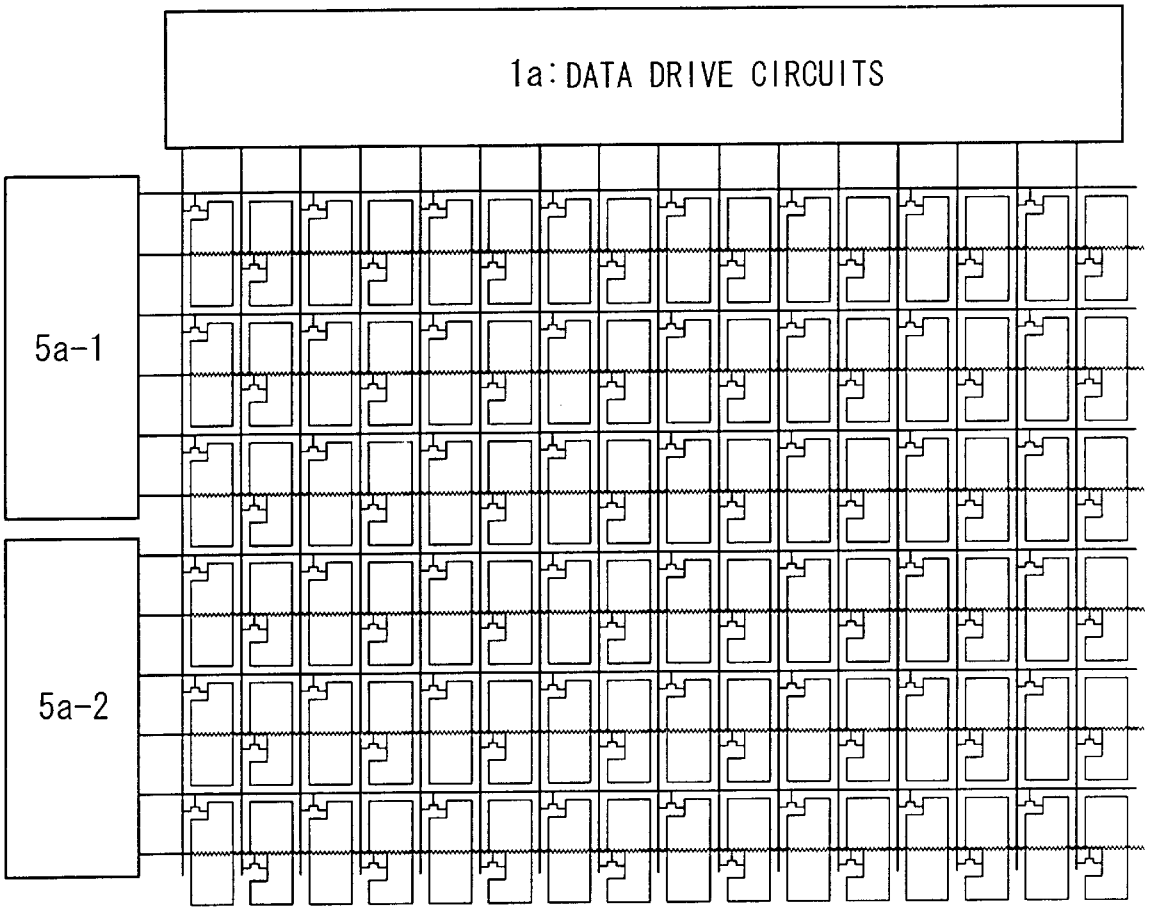
FIG. 7 is a schematic diagram showing display regions and drive circuits of a liquid crystal display section according to a fifth embodiment of the present invention.
Figure 8:
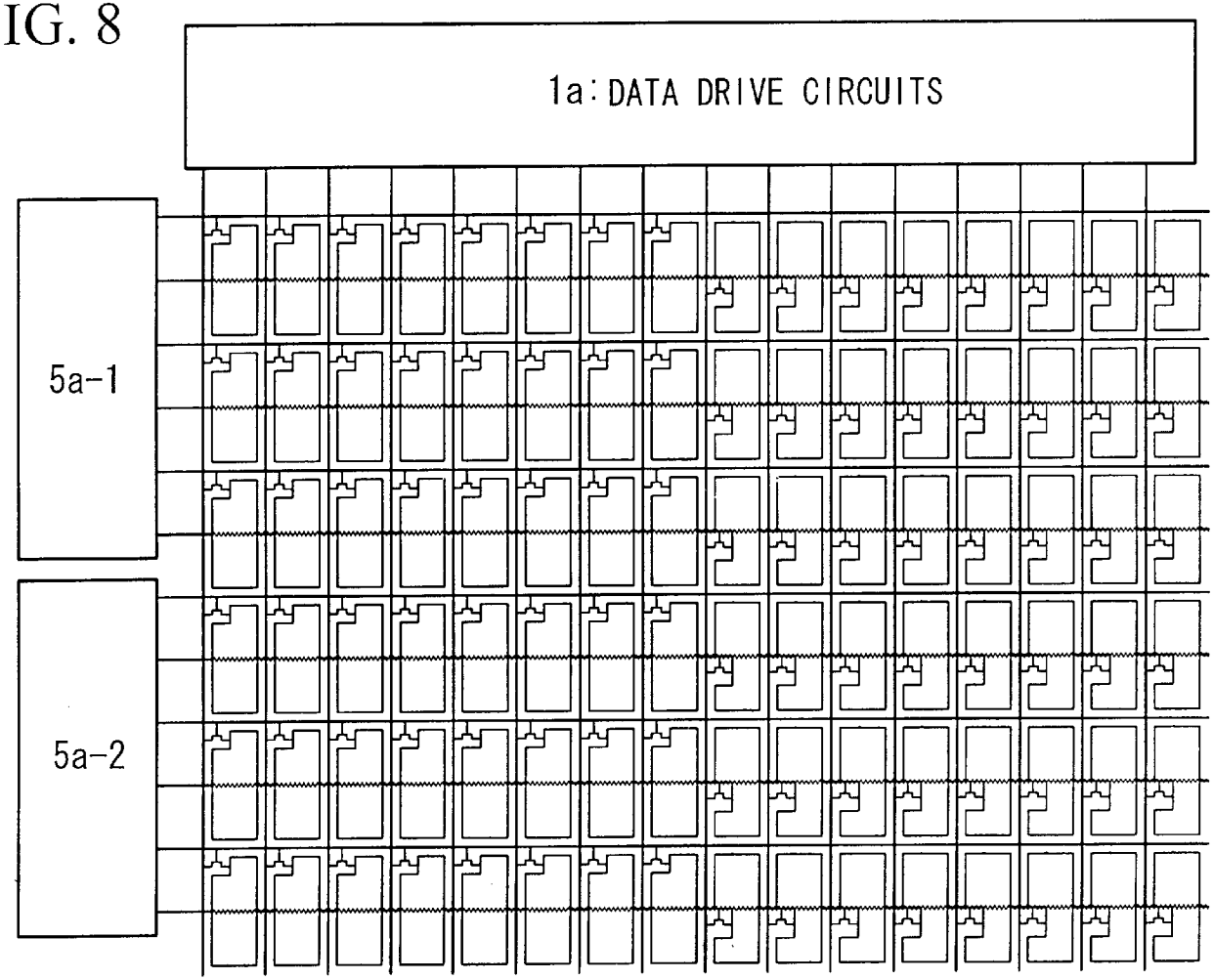
FIG. 8 is a schematic diagram showing display regions and drive circuits of a liquid crystal display section according to a sixth embodiment of the present invention.

Next is a description with reference to FIG. 7 and FIG. 8, of the liquid crystal display section according to the fifth embodiment in the present invention. With the liquid crystal display section according to the fifth embodiment, consideration is given to the operation in the liquid crystal display section according to the abovementioned fourth embodiment, for the case where active elements are arranged at all of the points where the data lines and the scanning lines intersect. For example, in the case where the timing at which the gate drive circuits 5*a*-1 and 5*a*-2 are scanned, does not simultaneously overlap, there is no problem at all. However, if this simultaneously overlaps, the data signals are written into scanning lines at a number of places. Therefore, with the liquid crystal display section according to this embodiment, active elements are only arranged at predetermined intersection points selected from intersection points where the data lines and the scanning lines intersect. FIG. 7 and FIG. 8 show examples with a part of FIG. 6 enlarged, for where the liquid crystal display section according to the fifth embodiment is applied. In FIG. 7, active elements are arranged in a checker board pattern. However there is also a method as in FIG. 8, where a region which is not a region for arranging active elements is made for each respective block. Furthermore, a construction where FIG. 7 and FIG. 8 are combined is also possible. Moreover, modification may be made to improve the aperture ratio by appropriately modifying the positional arrangement of the wiring.

Next, with the liquid crystal display section according to the sixth embodiment in the present invention, in the liquid crystal display section according to the fifth embodiment, a part or all of the wiring is further embedded or provided in bridge form. That is to say is provided as a separate layer. In this case, one part may be provided in a separate layer, and returned to the normal wiring layer having the contacts.

Next, is a description of liquid crystal display sections according to the respective embodiments, which use the liquid crystal display device according to the second embodiment of the present invention.

With the liquid crystal display section according to the seventh embodiment of the present invention, the same construction as for the liquid crystal display section according to the first embodiment described in FIG. 3 is realized using the second embodiment of the liquid crystal display device of FIG. 2. That is to say, with the liquid crystal display section according to the seventh embodiment, as shown in FIG. 3, there are data drive circuits 1 and 2 at both the top and bottom (or the left and right) of the display region, and each data line group 3 and 4 respectively extending from each data drive circuit 1 and 2, is electrically separated at the top and bottom (or the left and right) of the display region. Furthermore, gate drive circuits 5 and 6 corresponding to the top and bottom (or the left and right), are arranged in a top and bottom (or left and right) divided form, on the left or right (or the top or bottom) of the display region.

With the liquid crystal display section according to the eighth embodiment of the present invention, the same construction as for the liquid crystal display section according to the second embodiment described in FIG. 4 is realized using the liquid crystal display device according to the second embodiment shown in FIG. 2. That is to say, with the liquid crystal display section according to the eighth embodiment, as shown in FIG. 4, gate drive circuits 5 and 6 are in a top and bottom (or left and right) divided form, and are arranged on both sides, namely the left and right (or the top and bottom) of the display region.

With the liquid crystal display section according to the ninth embodiment of the present invention, the same construction as for the liquid crystal display section according to the third embodiment described in FIG. 5 is realized using the liquid crystal display device according to the second embodiment shown in FIG. 2. That is to say, the data drive circuits in the liquid crystal display section are each multiply divided transversely (or vertically) at the top and bottom (or the left and right). That is to say, with the liquid crystal display section according to the ninth embodiment, as shown in FIG. 5, the data drive circuits are divided into two, to give data drive circuits 1*a*, 1*b*, 2*a* and 2*b*. Moreover, further multiple divisions may be made.

With the liquid crystal display section according to the tenth embodiment of the present invention, the same construction as for the liquid crystal display section according to the fourth embodiment described in FIG. 6 is realized using the liquid crystal display device according to the second embodiment shown in FIG. 2. That is to say, in the liquid crystal display sections according to the seventh and eighth embodiments, the gate drive circuits are further multiply divided. As shown in FIG. 6, the gate drive circuits are divided into four, namely into 5*a*-1, 5*a*-2, 5*b*-1, 5*b*-2, 6*a*-1, 6*a* 2, 6*b*-1 and 6*b*-2.

With the liquid crystal display section according to the eleventh embodiment of the present invention, the same construction as for the liquid crystal display section according to the fifth embodiment described in FIG. 7 and FIG. 8 is realized using the liquid crystal display device according to the second embodiment shown in FIG. 2. That is to say, in the liquid crystal display sections according to the seventh through tenth embodiments, active elements are only arranged at predetermined intersection points selected from the intersection points where the data lines and the scanning lines intersect. With the liquid crystal display section according to the twelfth embodiment of the present invention, the same construction as for the liquid crystal display section according to the sixth embodiment described in FIG. 7 and FIG. 8 is realized using the liquid crystal display device according to the second embodiment shown in FIG. 2. That is to say, with the liquid crystal display section according to the twelfth embodiment, in the liquid crystal display sections according to the seventh through eleventh embodiments, a part or all of the wiring is further embedded or provided in bridge form. That is to say a part or all of the wiring may be provided as a separate layer.

In the above, detailed description is given of the liquid crystal display sections according to the first through twelfth embodiments in the liquid crystal display device of the present invention. Next is a description of an active element according to the present invention. For the active element of the present invention, a MIM (metal insulator metal) constructed diode, a TFT, and other active elements are considered. In the case of a TFT, this may be an amorphous silicon ($\alpha$-Si), a polysilicon (poly Si) or some other material. Furthermore, switching may be performed using a DRAM substrate.

Moreover, with the drive circuit of the present invention, this may be made using a single crystal silicon separate to the glass substrate of the liquid crystal display and connected thereto, or may be formed on a glass substrate of polysilicon. The construction of the circuit inside the drive circuit may be appropriately formed according to the embodiments of the following drive methods, from a circuit such as a shift register, a buffer, a latch, or some other circuit.

Figure 9:
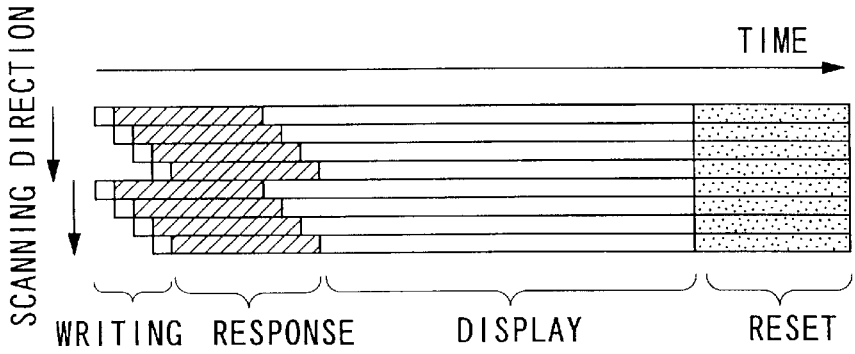
FIG. 9 is a timing chart showing a reset mode of a drive method of the liquid crystal display device of the present invention.
Figure 10:
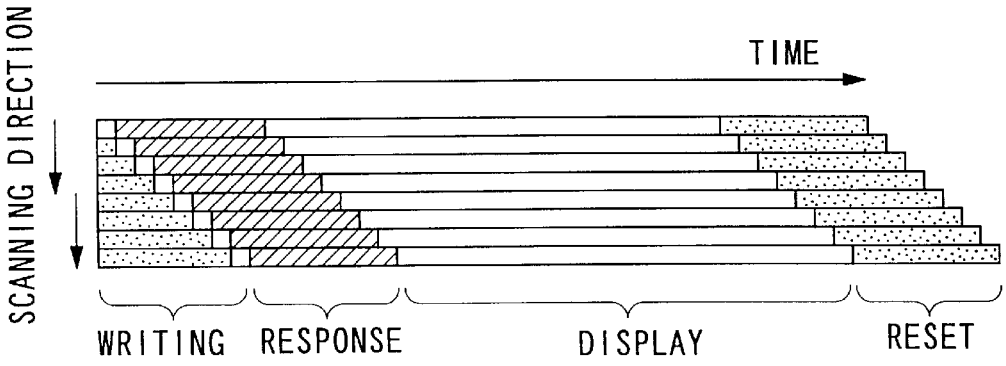
FIG. 10 is a timing chart showing a reset mode of a drive method of the liquid crystal display device of the present invention.

Next, before describing the embodiments of the drive methods of the liquid crystal display device of the present invention, at first a description is given of a timing chart shown in FIG. 9 and FIG. 10 showing a reset mode of the drive methods. In FIG. 9, the writing for each gate drive circuit is started at approximately the same time, while in FIG. 10, after completion of scanning in a certain gate circuit, the next gate circuit is scanned so that sequential scanning is possible for the whole panel face. Details of FIG. 9 and FIG. 10 are given later.

Next is a description of the drive methods according to first through twenty ninth embodiments, in the liquid crystal display device of the present invention.

With the drive method according to the first embodiment, in the liquid crystal display device of the present invention, at the time of driving any of the liquid crystal display sections in the above mentioned first through twelfth embodiments, reset is performed en bloc in each of the gate drive circuits. That is to say, the before mentioned whole screen en bloc reset is adopted for each of the gate drive circuits. Of course, a mode for complete whole screen en bloc reset by resetting all of the gate drive circuits at the same time is possible.

The drive method according to the second embodiment in the liquid crystal display device of the present invention is a substantially complete whole screen en bloc reset mode where reset of each gate drive circuit of the drive method according to the first embodiment is started at approximately the same time.

Figure 13:
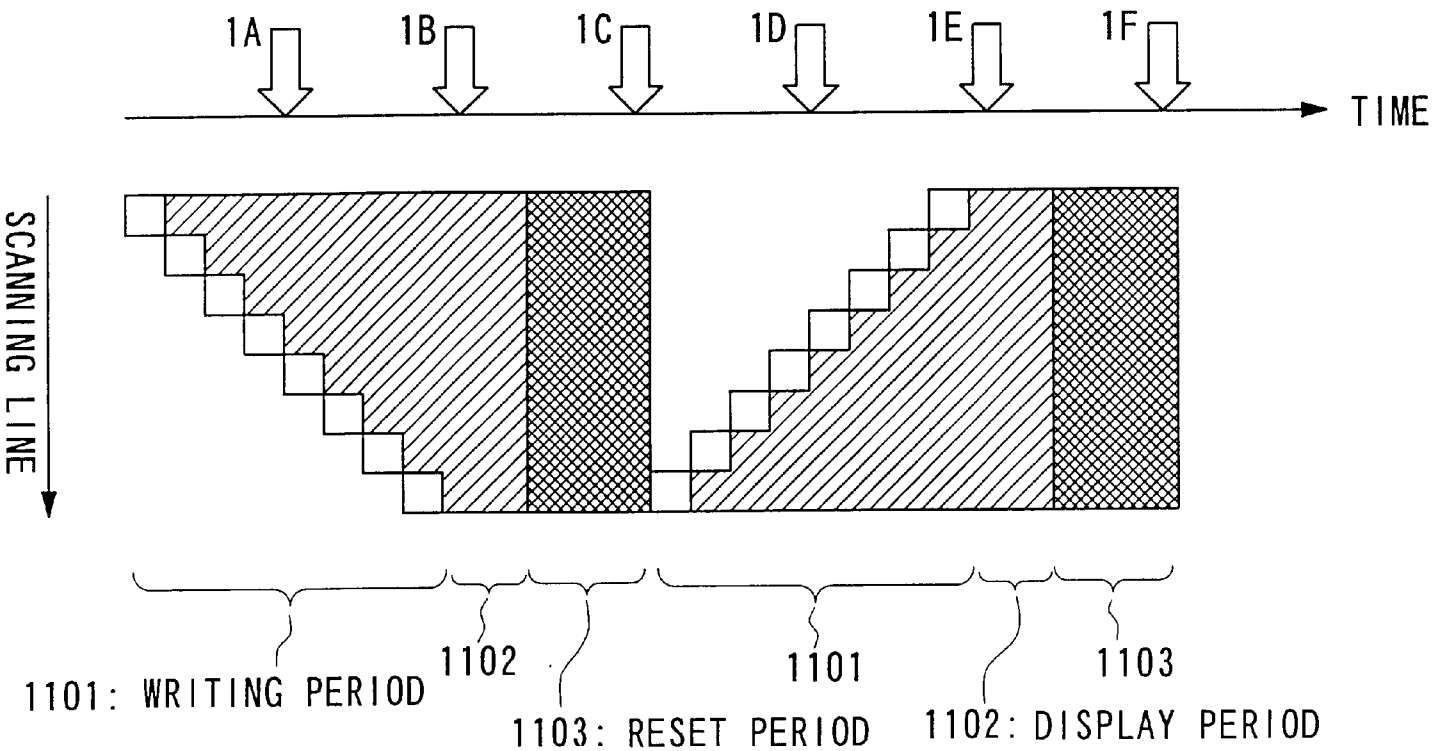
FIG. 13 is a timing chart for each of the scanning lines for the drive method by the third embodiment of the present invention.
Figure 14:
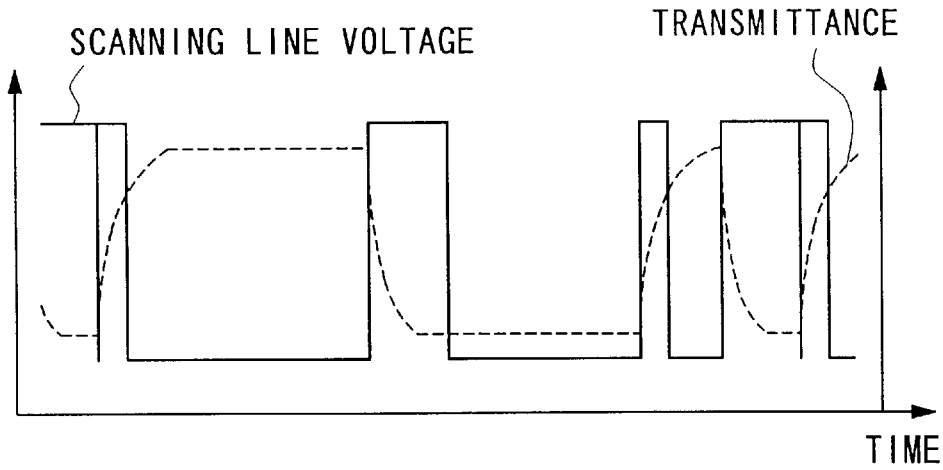
FIG. 14 is a waveform diagram of the scanning line voltage and transmittance for the first scanning line, in the drive method by the third embodiment of the present invention.
Figure 15:
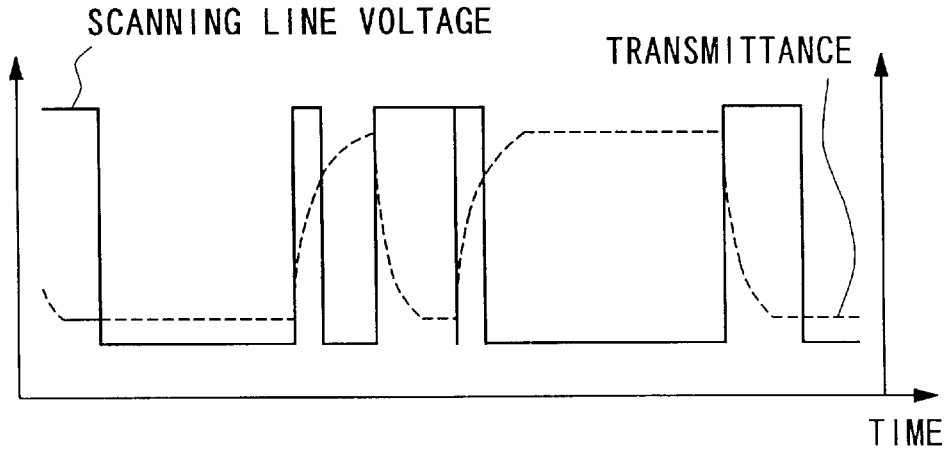
FIG. 15 is a waveform diagram of the scanning line voltage and transmittance for the eighth scanning line from the top, in the drive method by the third embodiment of the present invention.

With the drive method according to the third embodiment in the liquid crystal display device of the present invention, in the drive methods according to the first and second embodiments, for example as in FIG. 13 through FIG. 15 (FIG. 1 of Japanese Pending Patent Application No. 10-041689), the scanning direction in the first field is from top to bottom (or from left to right), while the scanning direction in the second field is from bottom to top (or from right to left). By changing the scanning directions in this way, it is possible to eliminate the luminance distribution in the panel face. Here, the reset voltage or the data voltage are not limited to that in FIG. 14 and FIG. 15, and may be optionally selected depending on the type of liquid crystal display mode or drive. Furthermore, a method other than that disclosed in Japanese Pending Patent Application No. 10-041689 may also be applied.

With the drive method according to the fourth embodiment in the liquid crystal display device of the present invention, in the drive methods according to the first through third embodiments, writing of each scanning line in each of the gate drive circuits, is performed by sequential scanning.

With the drive method according to the fifth embodiment in the liquid crystal display device of the present invention, in the drive method according to the fourth embodiment, writing for each of the gate drive circuits is sequentially started with a fixed time shift. With a further modification of this method, after completion of scanning in a certain gate circuit, the next gate circuit is scanned. As a result, sequential scanning for the whole panel face is possible.

Figure 29:
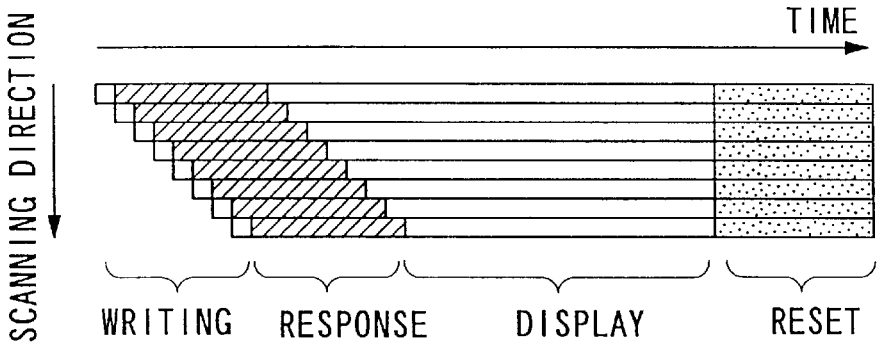
FIG. 29 PRIOR ART
FIG. 29 is a timing chart showing whole face on bloc reset according to a conventional reset drive mode.

With the drive method according to the sixth embodiment in the liquid crystal display device of the present invention, in the drive method according to the fourth embodiment, writing for each of the gate drive circuits is started at approximately the same time. The timing chart for the drive in this case is shown in FIG. 9. According to this method, the display period can be significantly increased compared to the conventional drive shown in FIG. 29.

With the drive method according to the seventh embodiment in the liquid crystal display device of the present invention, in the drive method according to the first through third embodiments, writing for each of the scanning lines in each of the gate drive circuits is performed at approximately the same time for all scanning lines. As a result, the display period can be further increased.

With the drive method according to the eighth embodiment in the liquid crystal display device of the present invention, reset is performed while scanning in each gate circuit. That is to say, the aforementioned scanning reset is adopted for each gate drive circuit. Of course, a scanning reset for sequentially scanning the whole face by sequentially resetting all of the gate drive circuits is possible.

With the drive method according to the ninth embodiment in the liquid crystal display device of the present invention, the abovementioned scanning is performed for each scanning line.

With the drive method according to the tenth embodiment in the liquid crystal display device of the present invention, an optionally selected plurality of scanning lines are made one block, and this block is reset simultaneously, and blocks are optionally selected and scanned.

Figure 16:
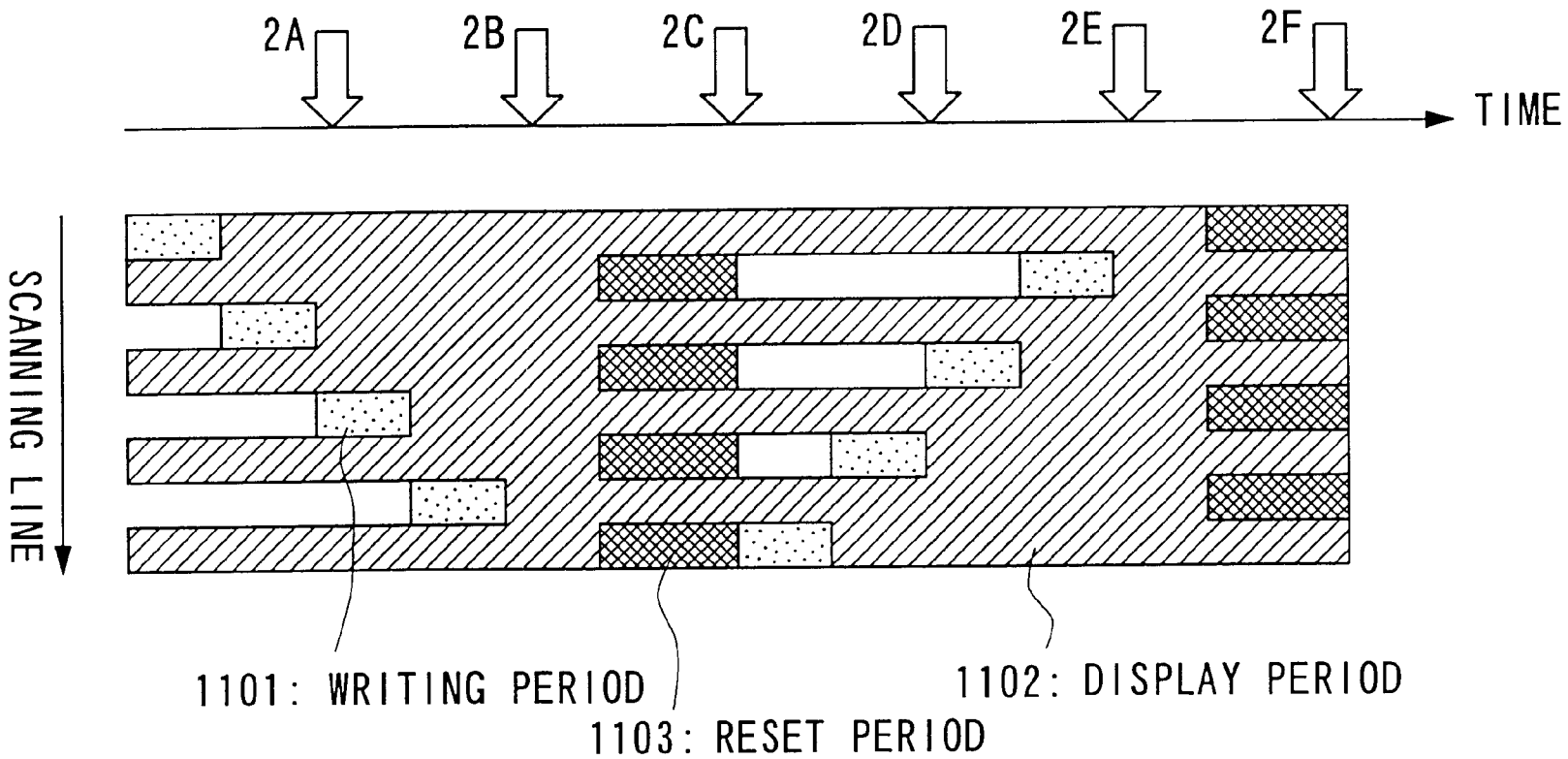
FIG. 16 is a timing chart for each of the scanning lines, in the drive method by the eleventh embodiment of the present invention.
Figure 17:
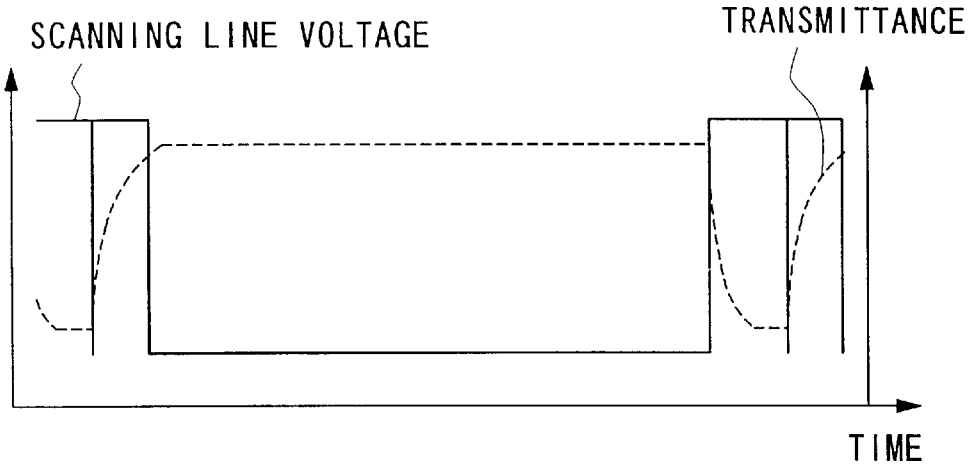
FIG. 17 is a waveform diagram of the scanning line voltage and transmittance for the first scanning line from the top, in the drive method by the eleventh embodiment of the present invention.
Figure 18:
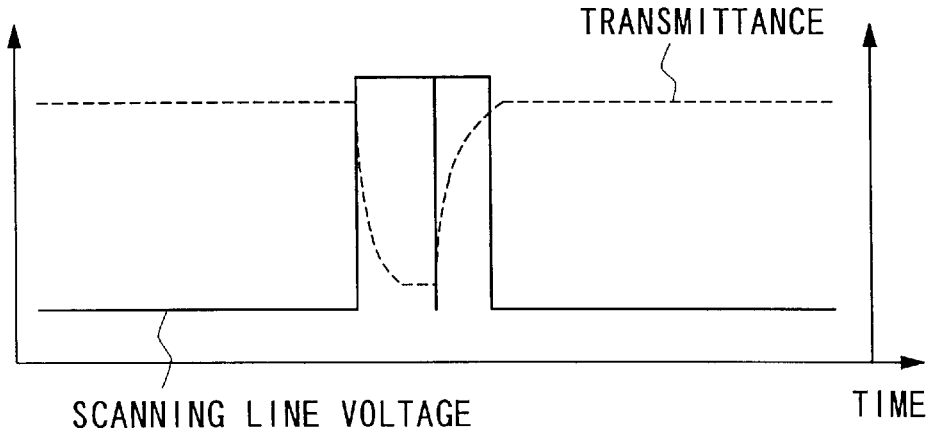
FIG. 18 is a waveform diagram of the scanning line voltage and transmittance for the eighth scanning line from the top, in the drive method by the eleventh embodiment of the present invention.

With the drive method according to the eleventh embodiment in the liquid crystal display device of the present invention, in the drive method according to the tenth embodiment, the scanning method disclosed in Japanese Pending Patent Application No. 10-041689 is applied. For example, as in FIG. 16 through FIG. 18 (FIG. 3 of Japanese Pending Patent Application No. 10-041689), the first scanning line group for which writing has been performed in the first field, is reset at the end of the second field, and the second scanning line group for which writing has been performed in the second field from the opposite direction to that of the first scanning line group, is reset at the end of the first field of the next frame. By changing the scanning directions in this way, it is possible to reduce the luminance distribution in the panel face. Here, the reset voltage or the data voltage are not limited to that in FIG. 17 and FIG. 18, and may be optionally selected depending on the type of liquid crystal display mode or drive. In addition, a method other than that disclosed in Japanese Patent Application No. 10-041689 may also be applied.

With the drive method according to the twelfth embodiment in the liquid crystal display device of the present invention, in the drive methods according to the eighth through eleventh embodiments, the writing of each scanning line in each of the gate drive circuits, is performed by sequential scanning.

With the drive method according to the thirteenth embodiment in the liquid crystal display device of the present invention, in the drive method according to the twelfth embodiment, the writing for each of the gate drive circuits is sequentially started with a fixed time shift.

Figure 30:
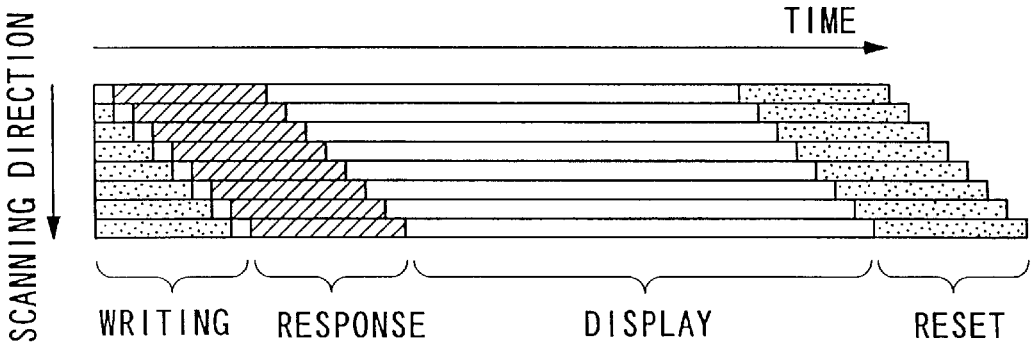
FIG. 30 PRIOR ART
FIG. 30 is timing chart showing scanning reset in the conventional reset drive mode.
Figure 31:
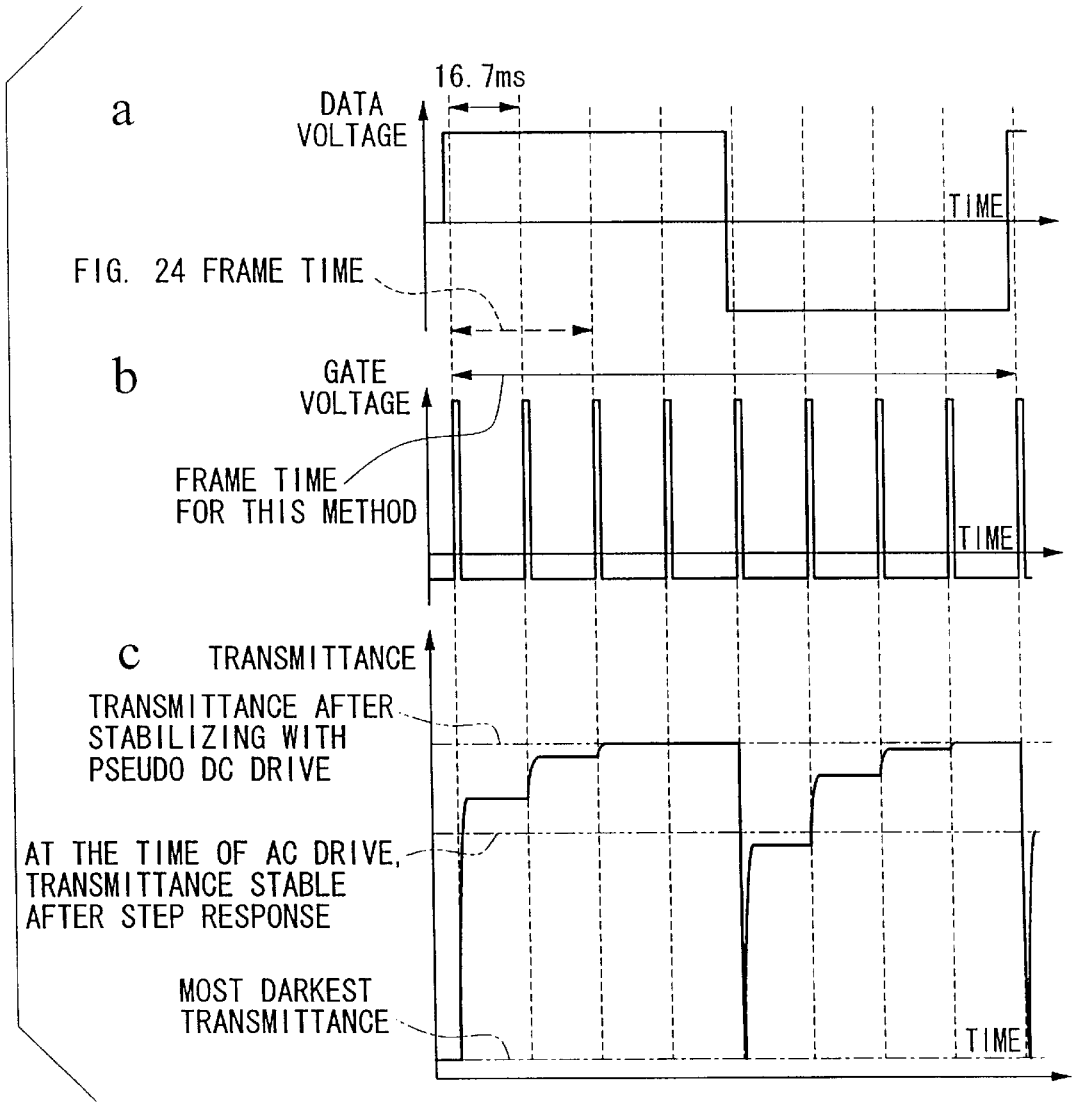
FIG. 31 PRIOR ART
FIG. 31 is a diagram for explaining the data signal waveform with a conventional pseudo DC drive method; part a being a waveform diagram of data line applied voltage, part b being a waveform diagram of gate line applied voltage, and part c being a diagram showing transmittance change when the voltage of a and b is applied to a high-speed response liquid crystal.
Figure 32:
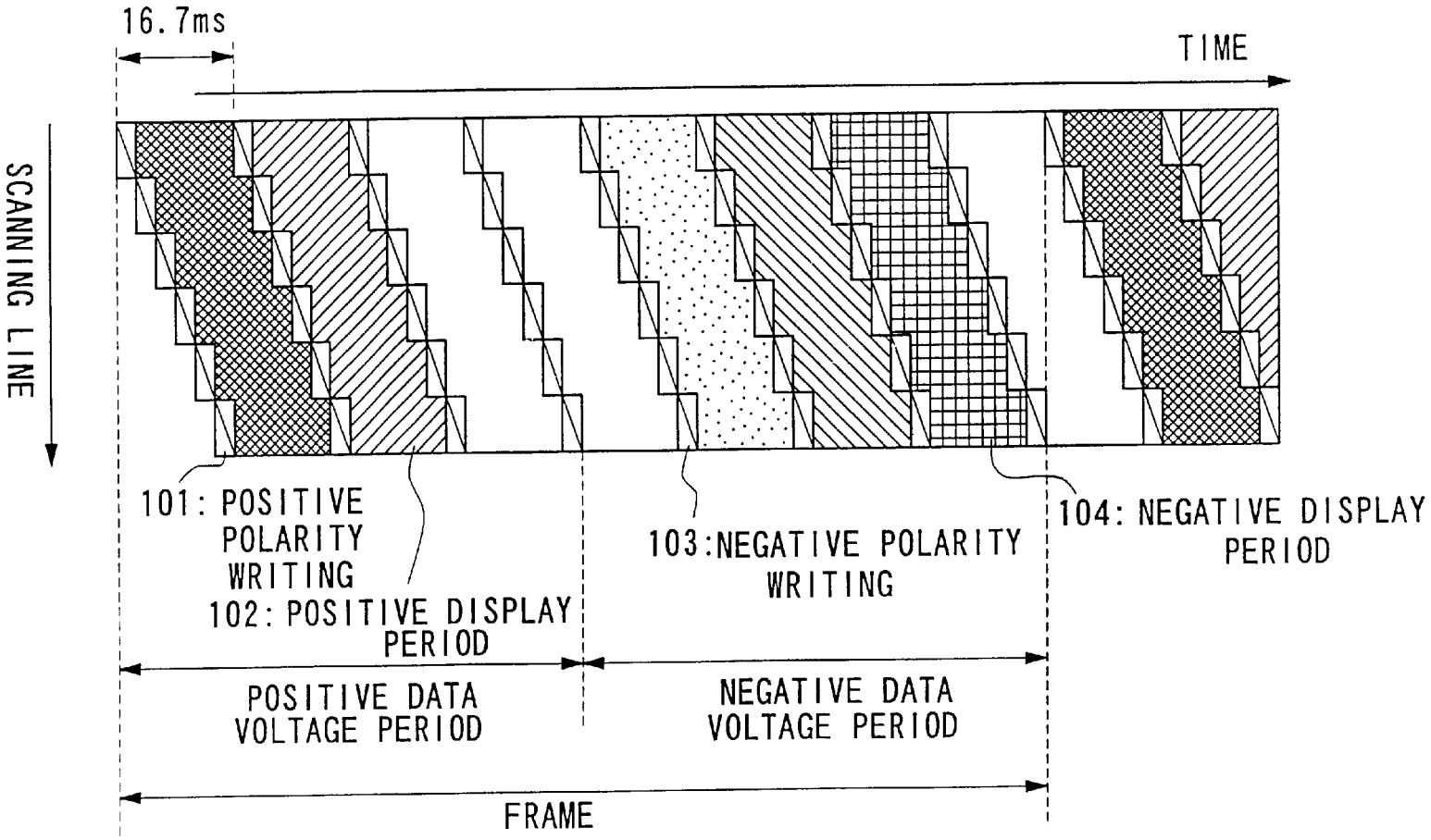
FIG. 32 PRIOR ART
FIG. 32 is a diagram showing a timing chart for each scanning line, and display luminance for each scanning line, with the conventional pseudo DC drive method of FIG. 31.

In the liquid crystal display device of the present invention, the drive method according to the fourteenth embodiment, is a technique where the drive method according to the thirteenth embodiment is further modified. After completion of scanning in a certain gate circuit, the next gate circuit is scanned. By means of this method, sequential scanning for the whole panel face is possible. The timing chart for the drive in this case is shown in FIG. 10. The timing chart is from appearances, the same as in FIG. 30. However this differs significantly in the point that the gate drive circuits are divided.

With the drive method according to the fifteenth embodiment in the liquid crystal display device of the present invention, in the drive method according to the twelfth embodiment, the writing for each of the gate drive circuits is started at approximately the same time.

With the drive method according to the sixteenth embodiment in the liquid crystal display device of the present invention, in the drive method according to the eighth through eleventh embodiments, the writing for each of the scanning lines in each of the gate drive circuits is performed at approximately the same time for all scanning lines. As a result, the display period can be further increased.

With the drive method according to the seventeenth embodiment in the liquid crystal display device of the present invention, the optical system lights up the whole face of the liquid crystal display section en bloc.

With the drive method according to the eighteenth embodiment in the liquid crystal display device of the present invention, the optical system, in the liquid crystal display section, lights up en bloc in the blocks for each of the respective gate drive circuits, and lights up the other gate drive circuits at a different timing.

With the drive method according to the nineteenth embodiment in the liquid crystal display device of the present invention, in the drive method according to the first through sixteenth embodiments, the seventeenth or eighteenth embodiment is performed.

With the drive method according to the twentieth embodiment in the liquid crystal display device of the present invention, in the drive method according to the nineteenth embodiment, in particular there is a drive method according to the seventeenth and eighteenth embodiments which adopts the drive method according to the sixth or seventh embodiment. In the drive method according to the twentieth embodiment, the drive method according to the seventeenth embodiment which adopts the drive method according to the sixth embodiment, is as follows.

Scanning and reset of the writing is performed by the timing chart of FIG. 9. Therefore, compared to the conventional drive shown in FIG. 29, the time used in writing and response is considerably reduced. As a result, the period which can be used for display is increased. In the case where the light source lights up en bloc over the whole face of the display region, an embodiment with a long period which can be used for display gives a higher intensity display. In this way, the light utilization efficiency is increased. Furthermore, the time is increased in which it is possible to perform stabilized display with the liquid crystal responding sufficiently. Therefore, in the case where flickering of the color/time division or the light and dark is performed, a stabilized high resolution picture display is possible for the display. In this way, in the light source en bloc lighting, when the sixth embodiment is adopted, extremely efficient light utilization is possible. Furthermore, a high resolution picture display is possible. If the seventh embodiment is adopted, even more efficient light utilization towards the light source en bloc lighting is possible. On the other hand, in the case where the display period is made the same time, the writing time to each scanning line can be increased. That is to say, the frequency of the gate drive circuit can be reduced. It is also possible to hold both of these effects together, reducing the frequency of the gate drive circuit while increasing the display period.

With the drive method according to the twenty first embodiment in the liquid crystal display device of the present invention, the optical system shines while scanning the liquid crystal display section. This is referred to as a scanning optical system.

With the drive method according to the twenty second embodiment in the liquid crystal display device of the present invention, the optical system, in the liquid crystal display section, scans and lights up in the blocks for each of the respective gate drive circuits, and lights up the other gate drive circuits at a different timing.

With the drive method according to the twenty third embodiment in the liquid crystal display device of the present invention, the drive method according to the twenty first or twenty second embodiments is used in the drive methods according to the first through sixteenth embodiments.

With the drive method according to the twenty fourth embodiment in the liquid crystal display device of the present invention, in the drive method according to the twenty third embodiment, in particular there is a drive method according to the twenty first and twenty second embodiments which adopt the drive method according to the fourteenth embodiment. In the drive method according to the twenty fourth embodiment, the operation of the twenty first embodiment which adopts the drive method according to the fourteenth embodiment, is as follows.

Scanning and reset of the writing is performed by the timing chart of FIG. 10. Therefore, from appearances, this is the same as the conventional drive shown in FIG. 30. However, with the respective drive circuits, the number of scanning lines to be driven is reduced, and drive of circuits which the conventional scanning lines cannot drive, is possible. As a result, low cost drive circuits with satisfactory characteristics can be used. On the other hand, in the case where the light source sequentially scans and lights up the display region, synchronized with the drive of the liquid crystal display section, an extremely good display is obtained. In this way, with the present embodiment, a good display is obtained even in the case where the light source is a scanning type.

With the drive method according to the twenty fifth embodiment in the liquid crystal display device of the present invention, in the drive method according to the first through twenty fourth embodiments, as required, the timing of the scanning of the scanning line, and the rising characteristics of the luminance of the light source are considered. Moreover, the occurrence of display unevenness within the panel surface is considered in performing synchronization of the scanning lines and the light source. A counter is provided for producing simultaneously a clock and a deviation of a set predetermined clock. For this counter, a binary counter or a Johnson counter may be used, or a counter of some other form may be used.

With the drive method according to the twenty sixth embodiment in the liquid crystal display device of the present invention, in the drive method according to the first through twenty fifth embodiments, the light from the incident optical system does not shine into the drive circuit section of the data drive circuit and the gate drive circuit. A method so that there is no incidence may involve a shielding layer or a shutter layer with patterning, or may involve some other method.

With the drive method according to the twenty seventh embodiment in the liquid crystal display device of the present invention, light of a form such that the light does not shine into the switch section inside the display section, is projected from the incident optical system to the liquid crystal display section. For this form, a form such as stripes, a checker board, or a form where dark dots are scattered is considered, but this may be some other form.

Figure 11:
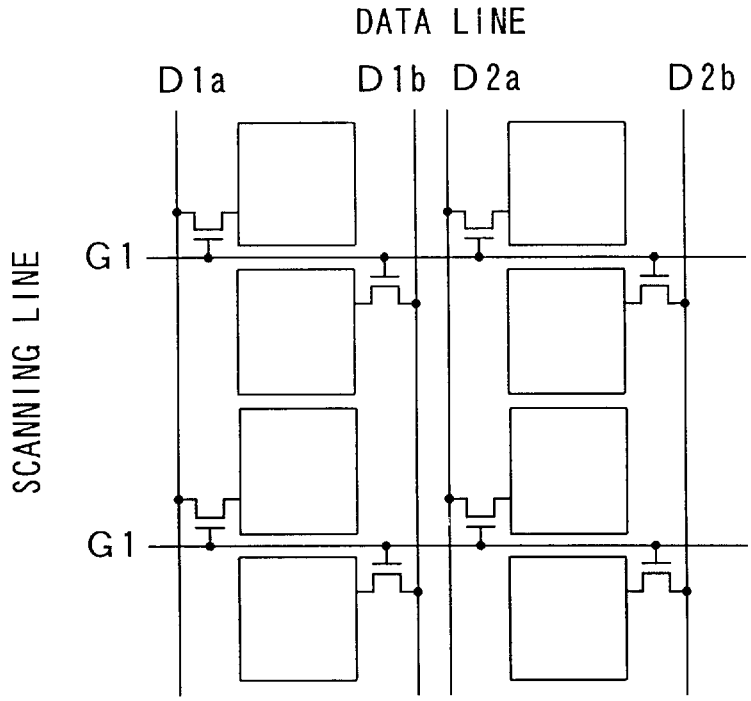
FIG. 11 is a schematic diagram showing an arrangement of wiring and pixels for a drive method by a twenty eighth embodiment according to the liquid crystal display device of the present invention.

With the drive method according to the twenty eighth embodiment in the liquid crystal display device of the present invention, a method is applied where in the drive methods according to all of the aforementioned embodiments, the number of data lines is doubled, and the number of scanning lines is reduced by half. In this way, the load on the gate drive circuit is significantly reduced. An example of the pixel array for this case is shown in FIG. 11.

With the drive method according to the twenty ninth embodiment in the liquid crystal display device of the present invention, there is a liquid crystal display device for sequentially scanning with an optical system a block selected from a multitude of display region blocks formed from divided respective gate drives circuits and respective data drive circuits.

Figure 12:
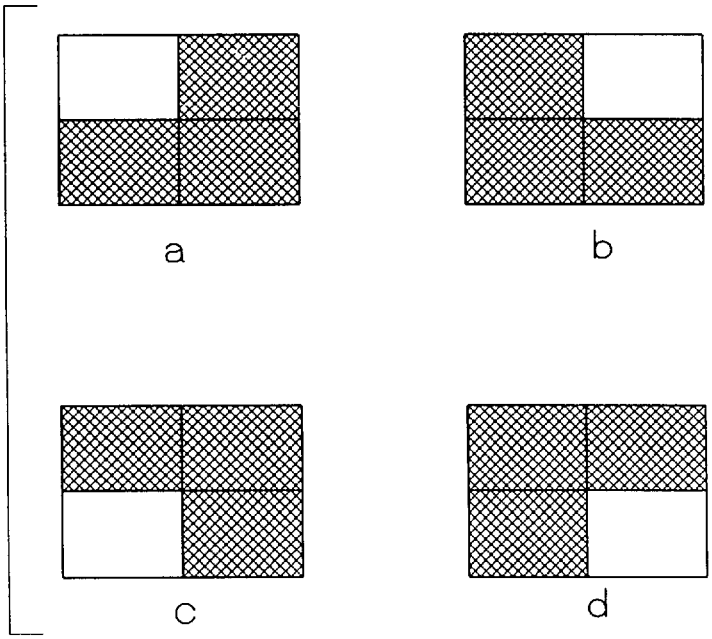
FIG. 12 is a schematic diagram showing aspects of illumination for the drive method by a twenty ninth embodiment according to the liquid crystal display device of the present invention; part a showing the instant where light is irradiated on the top left of four divisions, part b showing the instant where this is irradiated on the top right, part c showing the instant where this is irradiated on the bottom left, and part d showing the instant where this is irradiated on the bottom right.

An example of a drive circuit according to the twenty ninth embodiment is shown typically in FIG. 12, using the liquid crystal display section in FIG. 4 with the gate drive circuit divided in two, and the data drive circuit also divided in two. Part a shown in FIG. 12 is the instant where the light is irradiated on the top left of the four divisions, part b shown in FIG. 12 is the instant where this is irradiated on the top right, part c shown in FIG. 12 is the instant where this is irradiated on the bottom left, and part d shown in FIG. 12 is the instant where this is irradiated on the bottom right. For example, the light is scanned in sequence from a–b–c–d. However, there is no special requirement for this sequence. Furthermore, in this figure, each block at the light scanning time is lit up over the whole face. However the illumination may involve scanning within each block. Furthermore, a plurality of blocks may be illuminated at the same time.

With the drive method in the various embodiments described above, the description is made using only the liquid crystal display section appearing in the figure as shown in FIG. 2 where the synchronizing sections are independent. However the method may be for driving a liquid crystal display section of another construction. For example, the synchronous section may be provided inside the drive circuit of the liquid crystal display section, or may be provided inside the drive circuit of the light source.

Figure 19:
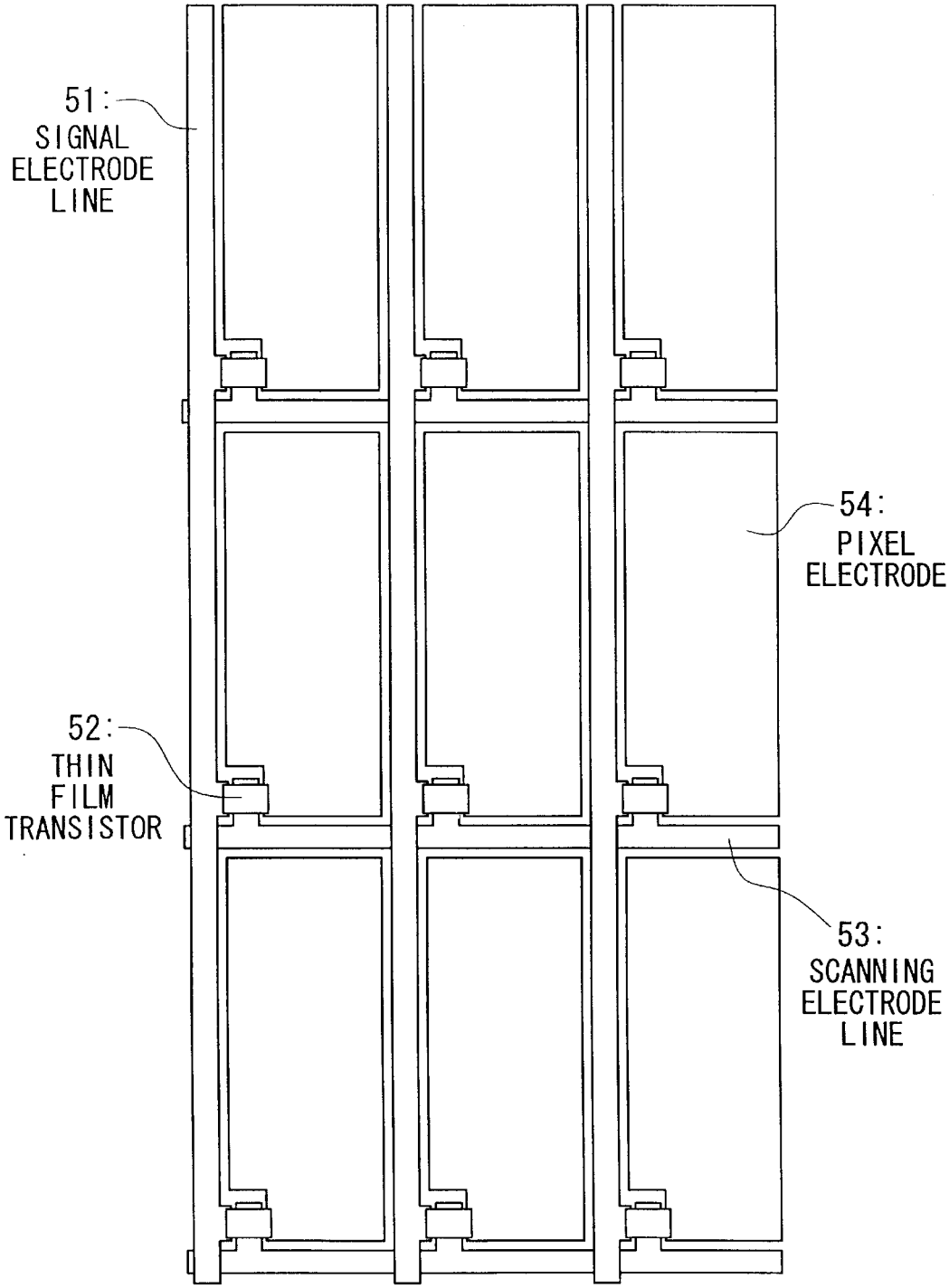
FIG. 19 is a schematic diagram showing a thin film transistor array related to embodiment 1-1 of the present invention.

Next is a detailed description of embodiments 1-1 through 1-6 of the present invention, with reference to the drawings. At first, referring to FIG. 10, a description is given of embodiment 1-1 of a liquid crystal display device of the present invention. FIG. 19 is an enlarged view showing a glass substrate on which a TFT of embodiment 1-1 of the present invention is formed in an array shape. With the embodiment 1-1, the liquid crystal display section is formed from a liquid crystal display element which is given a wide viewing angle by adding a compensator to a π cell referred to as an OCB (Optical-Compensated-Birefringence), and is an example applicable to the present invention. If the construction of the compensator is changed, then this can also be made a complementary π cell structure (CPS) mode. Using chromium (Cr) formed by sputtering methods, a 480 strand gate bus line (scanning electrode lines) and a 640 strand drain bus line (signal electrode lines) were formed with a line width of 10 μm, with silicon nitride ($SiN_x$) used as a gate insulation film. The size of a single pixel was set to a height of 330 μm and a width of 110 μm, and amorphous silicon used to form a TFT (thin film transistor). A pixel electrode was formed by sputtering using a transparent electrode of indium tin oxide (ITO). By forming an array of TFTs in this manner on a glass substrate as shown in FIG. 19 showing an enlarged view of one part, a first substrate was produced. On a second substrate, which opposes the first substrate, was formed a light shielding film comprising chromium, followed by a color filter, which was formed in a matrix shape using staining techniques. At the time of forming this color filter, color filters of each color were overlapped in three colors at 1.5 μm thickness to give a concave/convex construction of 4.5 μm thickness. Furthermore, the thickness was made to 6 μm, by laminating using a transparent resin material other than the color filter. Moreover, when the concave/convex construction was positioned facing the TFT substrate, a region other than the pixel aperture region was formed with the signal electrode lines facing each other in the ratio of one signal terminal line to three. A polyamic acid was applied to the first and second substrates using spin coating techniques, and was then baked at 200° C. to form a polyimide film by imidization. The polyimide film was then rubbed in a direction to give parallel rubbing using a rayon buffing material wound about a roller of diameter 50 mm, and with a roller rotation speed of 600 rpm, a stage displacement speed of 40 mm/second, and an indentation of 0.7 mm, with the rubbing process being conducted twice. The thickness of the orientation layer as measured by a contact step meter was approximately 500 Å, and the pretilt angle as measured by crystal rotation techniques was approximately 7 degrees. Onto one of the pair of glass substrates was applied an ultraviolet curing sealant with cylindrical glass rod spacers of diameter of approximately 6 μm dispersed therein. The two substrates were then positioned facing one another so that the rubbing processing directions thereof were arranged for parallel rubbing, and the sealant was then cured by non contact with an ultraviolet ray irradiation process to generate a panel with a gap of 6 μm. Nematic liquid crystal was then injected into this panel. With the present embodiment, a compensator designed so as to obtain a similar affect to the OCB (Optical-Compensating-Birefringence) display mode shown in page 927 to page 930 of the SID 94 Digest, was added. To this liquid crystal panel manufactured in this way, drive transistors were installed to give a liquid crystal display section. With this liquid crystal display section, a high-speed wide viewing angle display was obtained.

With the present embodiment, for the drive method, of the drive methods according to the abovementioned twentieth embodiment, the drive method according to the seventeenth embodiment which adopts the drive method according to the sixth embodiment was adopted. For the incident light source, a back light used in a normal liquid crystal display for shining light onto the whole surface was used, and the flashing of the light and dark was performed by remodelling of the inverter circuit. With this method, a higher intensity display was obtained than with the conventional method of the seminar sponsored by the LCD forum of the Japanese Liquid Crystal Society "LCDs Encroaching into the Market for CRT Monitors—from the Perspective of Moving-Image Quality" on pages 20 to 23. Furthermore, in adjusting the flashing time of the back light so that the luminance unevenness within the panel surface disappears, without increasing the luminance, an exceedingly high resolution picture image was obtained. Moreover, with the changing of the construction of the complementary π cell structure (CPS) mode with the compensator, a high resolution picture display with practically no color fluctuation was obtained.

Figure 20:
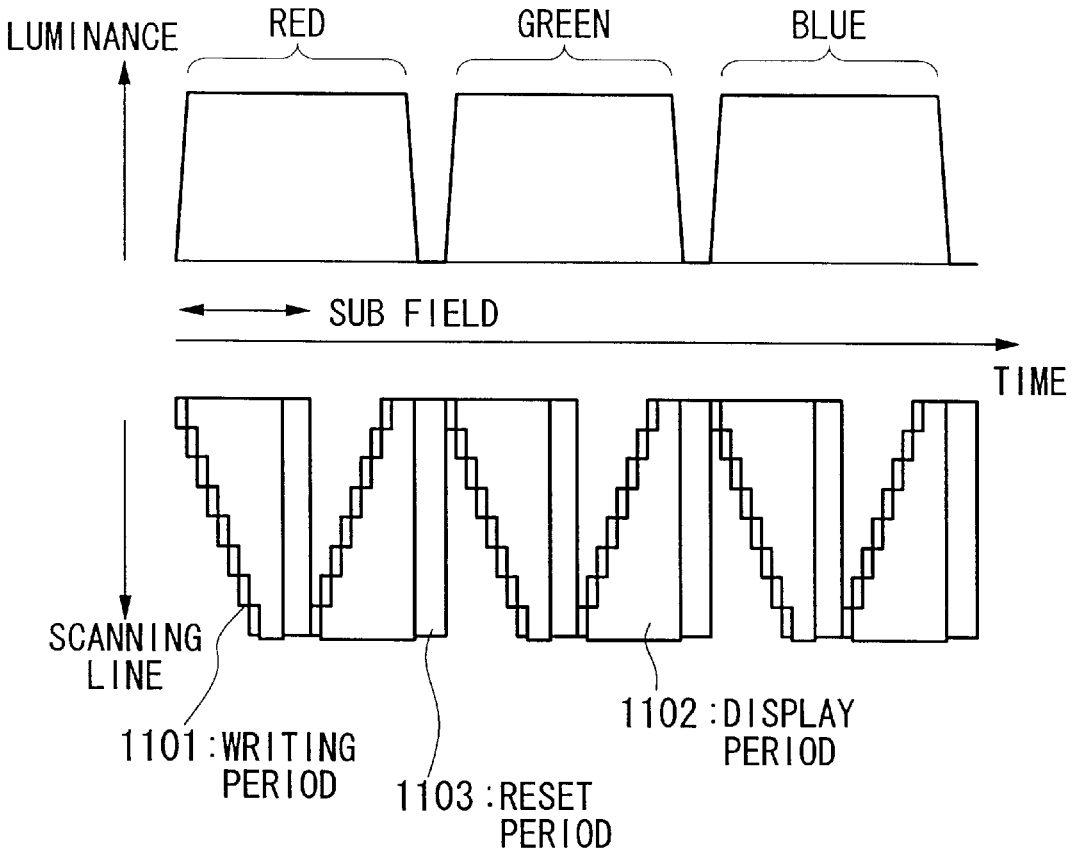
FIG. 20 is a timing chart for light source luminance for each of the scanning lines, being the light source flicker method of FIG. 11 of Japanese Patent Application No. 10-041689 which is adopted for one part of embodiment 1-2 of the present invention.

Next is a description of an embodiment 1-2 of the present invention, with reference to FIG. 20. FIG. 20 is a schematic diagram showing light source timing in the embodiment 1-2 of the present invention. With the embodiment 1-2 of the present invention, the embodiment 1-1 and the liquid crystal display mode are the same. However the color filter and protruding type spacer are not formed, and the panel is manufactured by dispersing cylindrical spacers of silica. In this liquid crystal display section, color/time divided optical systems are combined. As the color/time divided optical system, at first a construction which uses a color/time dividing color filter of a rotary type, is employed in the white light source. The timing of the flashing of the light source is by the method of FIG. 20 (FIG. 11 of Japanese Patent Application No. 10-041689). By means of this, a color/time division display is possible.

Figure 21:
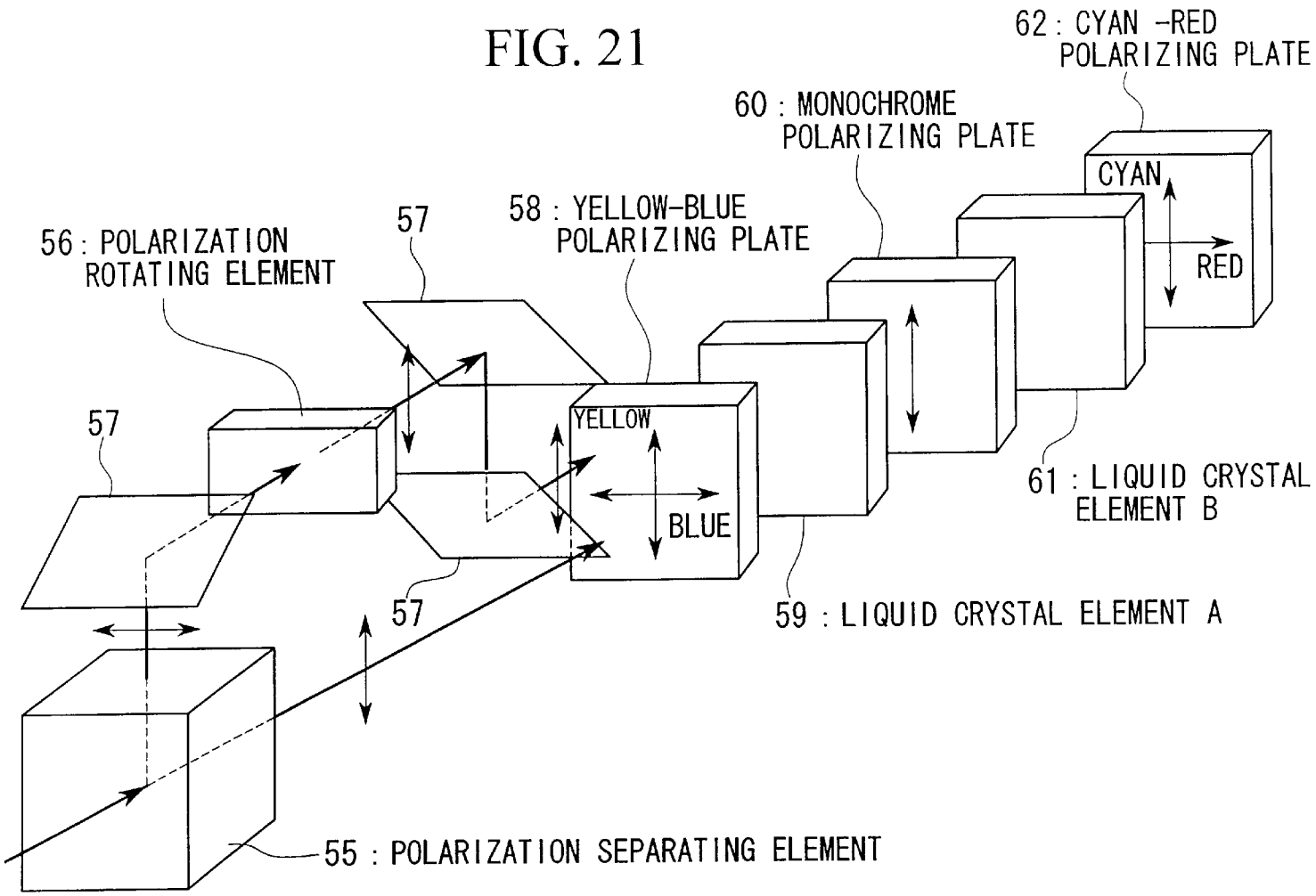
FIG. 21 is a schematic diagram showing a color/time division incident optical system related to embodiment 1-3 of the present invention.
Figure 41:
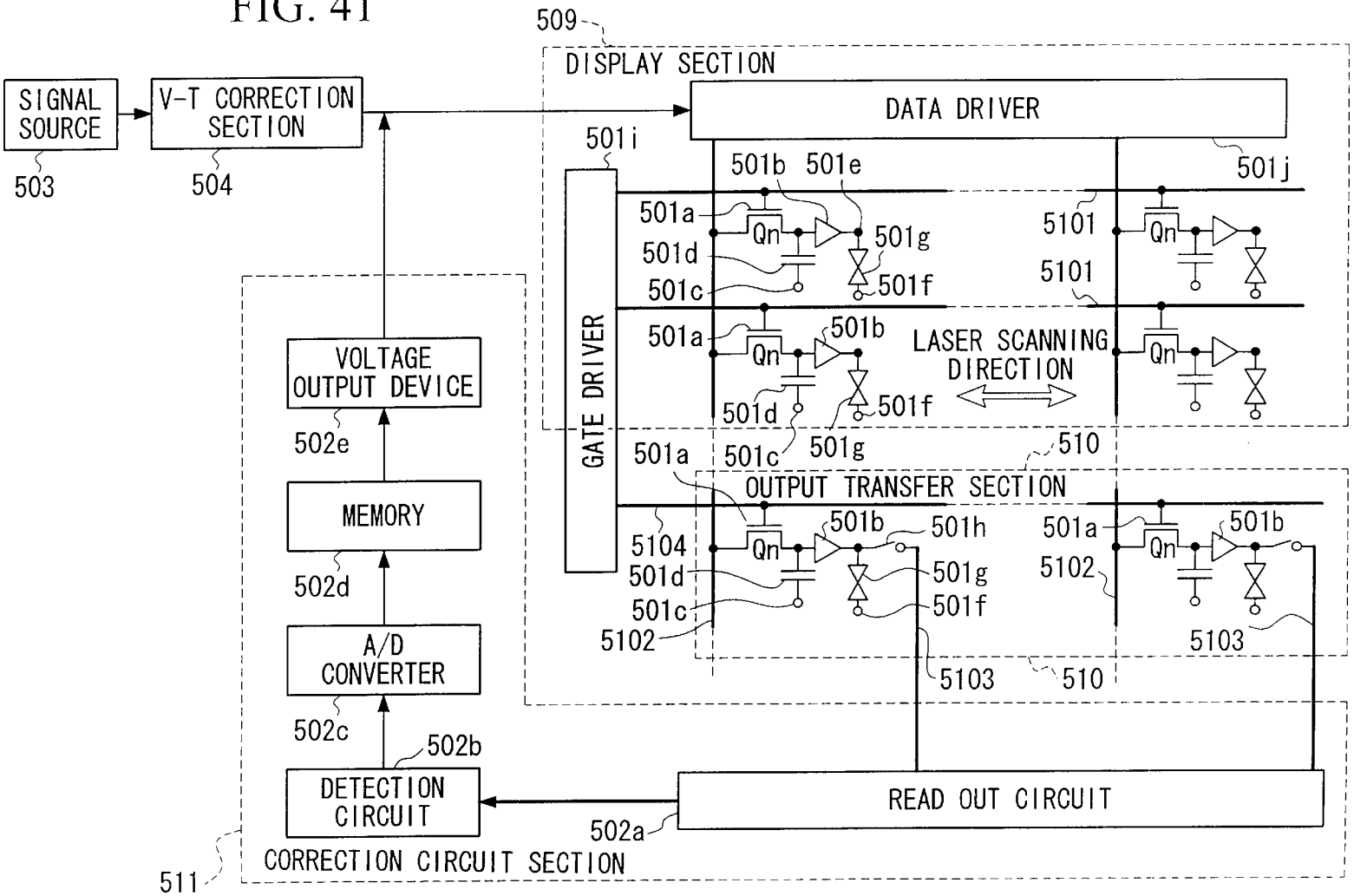
FIG. 41 is a diagram showing a schematic configuration of a liquid crystal display device according to a fifth embodiment of the present invention.

Next is a description of an embodiment 1-3 of the present invention, with reference to FIG. 21. FIG. 21 is a schematic diagram showing an optical system of a liquid crystal display device used in the embodiment 1-3. With the embodiment 1-3, the color/time division optical system of the embodiment 1-2is changed to the following optical system. With the color/time division optical system in this embodiment, an example made using a two color polarizer of a high transmittance shown in U.S. Pat. No. 575,138 of American ColorLink Inc. is shown next. In FIG. 21 an outline of the optical system is shown schematically. Light of a white color source (the incident direction is shown by the bottom.left arrow in the figure) is divided into two types of plane polarized beams using a polarization separating element 55. After this one of the linearly polarized beams is rotated to the same vibration direction as the other plane polarized beam using a polarization rotating element 56, after which these are synthesized By means of this polarization conversion method, the white light is straightened to one linearly polarized beam with an extremely small loss. Here, a mirror 57 is used, however this is not required depending on the design of the optical system. Furthermore, depending on the construction, it is possible to make the polarization conversion optical system even thinner. After this, a yellow-blue two color polarizer 58, a liquid crystal element A 59, a monochrome polarizer 60, a liquid crystal element B 61, and a cyan-red two color polarizer 62 are arranged in that order. The yellow-blue two color polarizer and the cyan-red two color polarizer have the configuration of the ColorLink Inc. method, with an exceedingly small loss. However, since the construction involves the before mentioned method of polarization conversion, without the monochrome polarizer which is necessary at the time of incidence in the construction of ColorLink Inc., the loss of light is exceedingly small. With this method, with each of the liquid crystal element A 59 and the liquid crystal element B 61, by combining the switching of the condition where the polarized light is rotated 90 degrees, and the condition where the polarized light is not rotated, the output of black, red, green and blue light becomes possible. By this method, the color/time division by the mode of FIG. 41 is possible. With this mode, a good display is performed, with the utilization factor of light even higher compared to the embodiment 1-2.

Next is a description of an embodiment 1-4 of the present invention.

The embodiment 1-4 of the present invention is one where a smectic liquid crystal is used in the liquid crystal display device of the present invention. The TFT substrate and the CF substrate operate the same as for the embodiment 1-1. However, the film thickness of one color of the respective colors of the color filter is made 1.6 $\mu$m, and a concave/convex construction is formed using only this layer. Furthermore, outside of the display region also a concave/convex construction surrounds the display region, and is provided in a shape with only one part of the region open The concave/convex construction on the outside of this display region does not replace the wall of the seal material, and the region where the aperture is formed becomes the liquid crystal inlet. Furthermore, the insulating layer of the contact section is patterned and removed. After this, a polyamic acid was applied to the two substrates using spin coating techniques, and was then baked at 180° C. to form a polyimide film by imidization. The polyimide film was then rubbed in a direction to give 10° cross rubbing, using a nylon buffing material wound about a roller of diameter 50 mm, and with a roller rotation speed of 600 rpm, a stage displacement speed of 40 mm/second, and an indentation of 0.7 mm, with the rubbing process being conducted twice. The thickness of the orientation layer as measured by a contact step meter was an approximately 500 Å, and the pretilt angle as measured by crystal rotation techniques was approximately 1.5 degrees. The two glass substrates were then positioned facing one another so as to give cross rubbing with the rubbing process directions at 10 degrees to each other, and the polyamide used in the orientation layer was further cured by heat treatment at 220° C. to give the adhesion, to generate a panel with a gap of 1.6 $\mu$m. Into this panel, a liquid crystal composition the same as the antiferroelectric liquid crystal composition which gives the V-shape type switching shown in Asia Display 95 from pages 61 to 64, was injected under vacuum conditions in an isotropic phase (ISO) state at 85° C. When the spontaneous polarization value of this liquid crystal was measured by applying a delta wave, that value was 165 nC/cm$^2$. Furthermore, the time of response differed depending on the grayscale voltage, being between 200 $\mu$s to 800 $\mu$s. At 85° C., an arbitrary waveform generator and a high power amplifier were used to apply a rectangular wave with a frequency of 3 kHz, and an amplitude of ±10 V to the whole panel, and while applying the electric field, the panel was cooled to room temperature at a rate of 0.1° C./min. To the liquid crystal panel manufactured in this way, drive driver ICs were installed to give the liquid crystal display section. The display image of the obtained liquid crystal panel ensured sufficient contrast (contrast ratio above 200), and had a wide viewing angle, being a good image with no image sticking or after image. The liquid crystal director was oriented at the center of the cross rubbing of 10°, that is to say at a position displaced by 5° from each rubbing direction.

With the drive method of the present embodiment, in the drive method according to the twenty fourth embodiment of the present invention, in particular the twenty first embodiment which adopts the fourteenth embodiment is used. As the incident light source, the color/time division optical system according to the ColorLink method of the third embodiment is used. However, with the liquid crystal element A and the liquid crystal element B, by forming the electrodes with patterning, then these can be used in scanning. With the liquid crystal used in the liquid crystal elements A and B, a fast response is realized using a SSFLC (Surface Stabilized Ferroelectric Liquid Crystal) of a ferroelectric liquid crystal. With the present embodiment, display is realized by a high -resolution picture color/time division method.

Next is a description of an embodiment 1-5 of a liquid crystal display device of the present invention.

This embodiment is the same as the embodiment 1-1. However for the light source, a light and dark flashing light source is used. In this flashing light source, a liquid crystal element where the electrodes are patterned to give a shutter effect, is arranged and scanned. As a result, display is realized by a light and dark flashing light source of a suitable scanning type. With this method, by adjusting in particular the timing of the on/off of the shutter liquid crystal element, the degree of improvement in the moving picture display due to the shutter effect can be adjusted.

Figure 22:
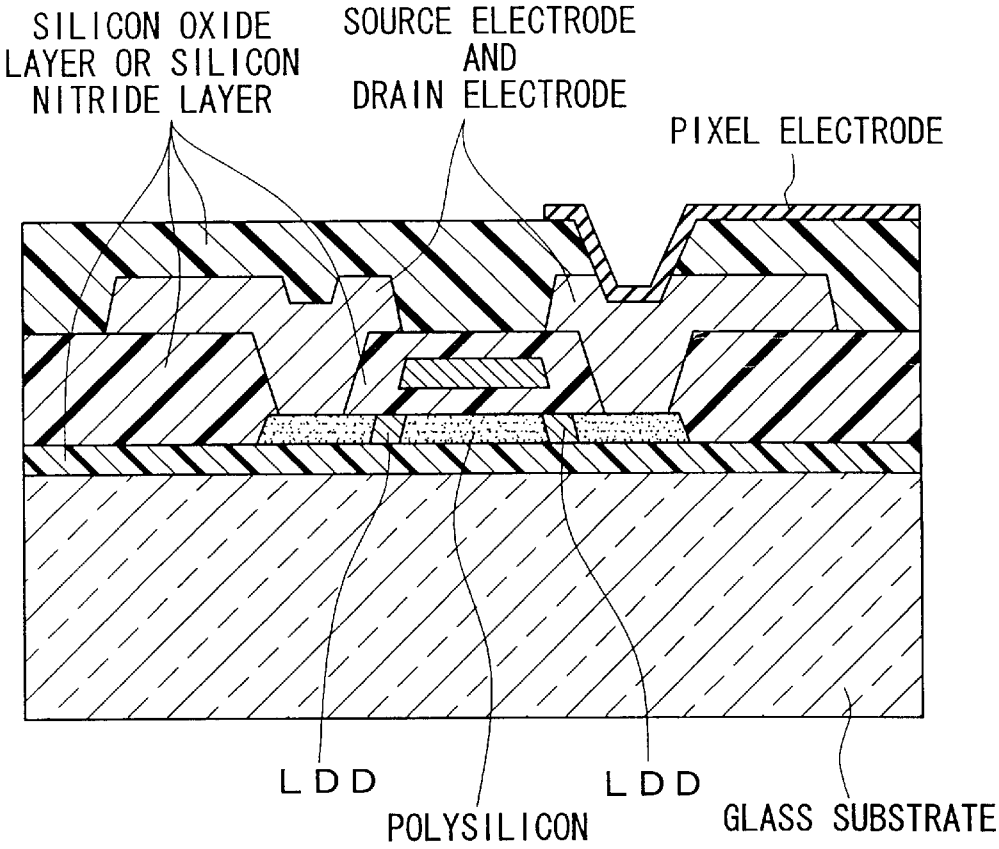
FIG. 22 is a sectional diagram showing the structure of a planar type polysilicon TFT switch used in embodiment 1-6 of the present invention.
Figure 23:
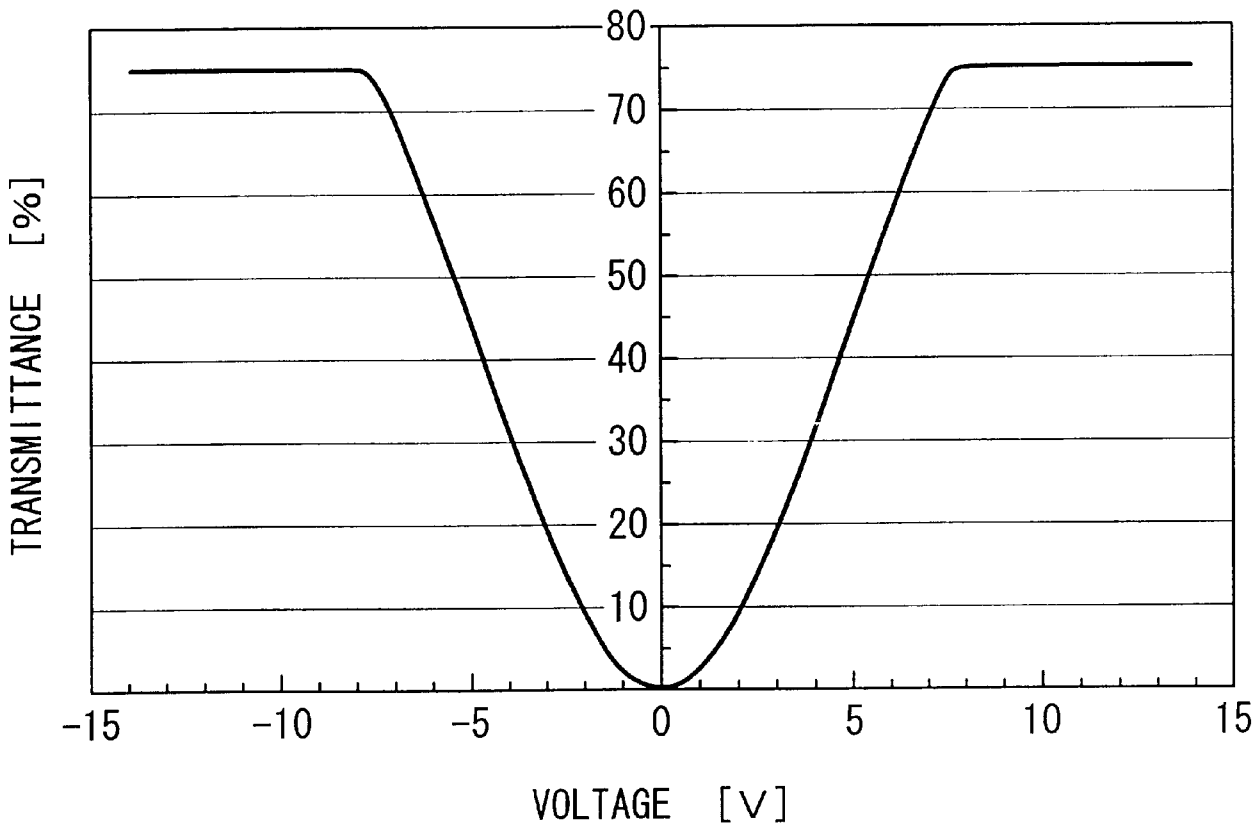
FIG. 23 is a diagram showing voltage transmittance for V-type switching used in the embodiment 1-6 of the present invention.
Figure 24:
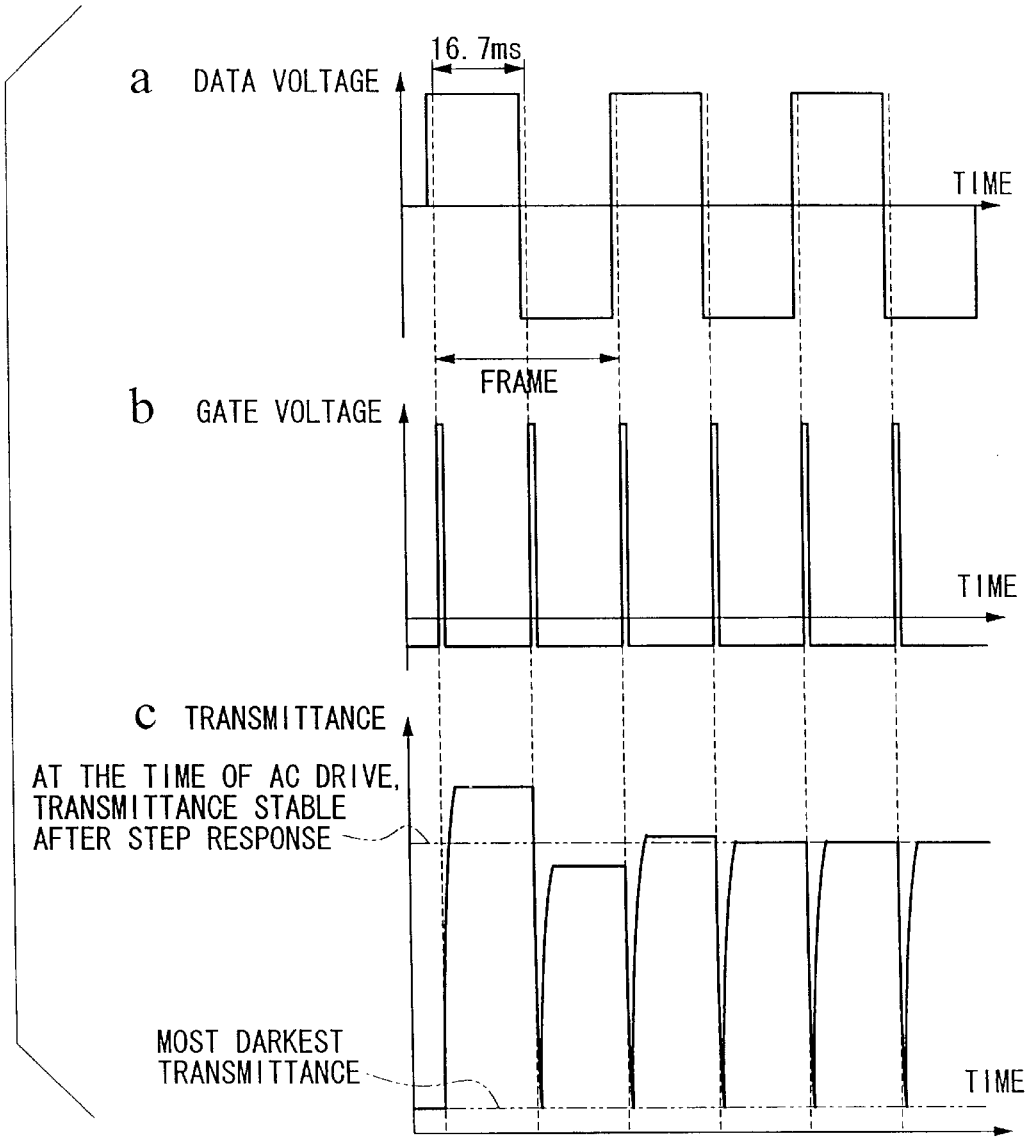
FIG. 24 PRIOR ART
FIG. 24 is an diagram for explaining the data signal waveform with a conventional AC drive method; part a being a waveform diagram of data line applied voltage, part b being a waveform diagram of gate line applied voltage, and part c being a diagram showing transmittance change when the voltage of a and b is applied to a high-speed response liquid crystal.
Figure 25:
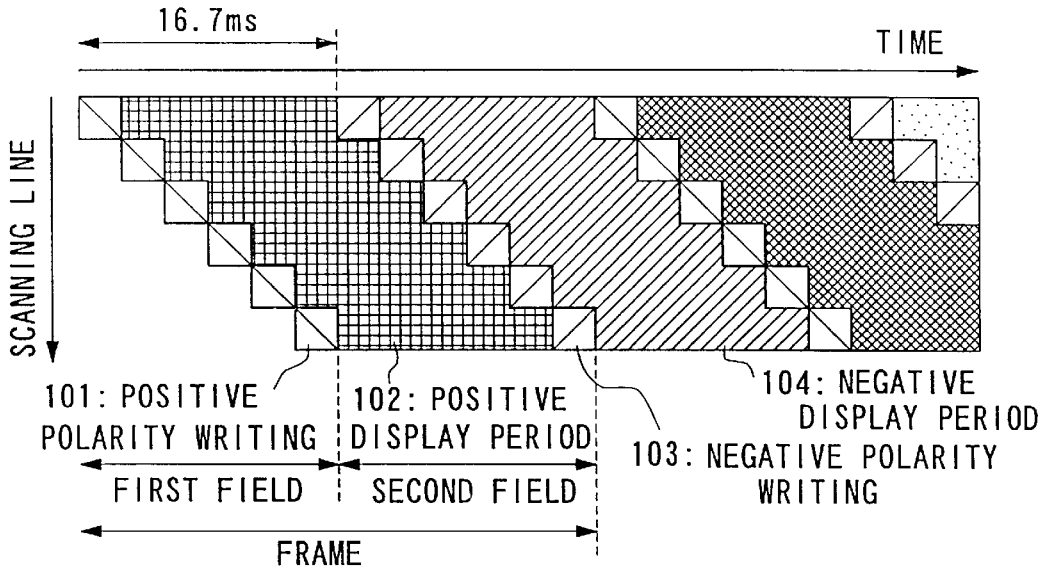
FIG. 25 PRIOR ART
FIG. 25 is a diagram showing a timing chart for each scanning line, and display luminance for each scanning line, with the conventional AC drive method of FIG. 24.
Figure 26:
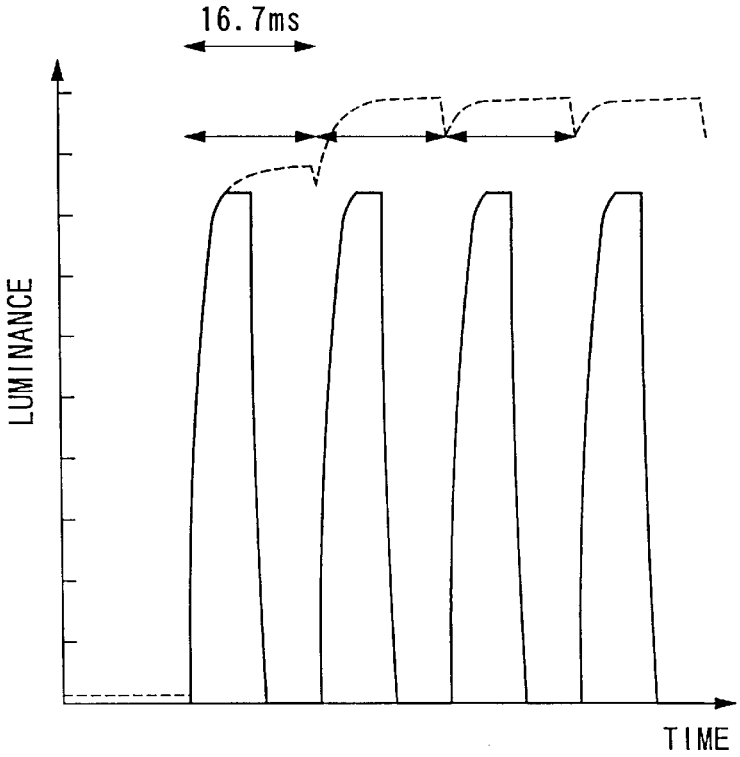
FIG. 26 PRIOR ART
FIG. 26 is a diagram showing change with time of luminance for a case where the reset method drive is applied to the conventional OCB mode.
Figure 27:
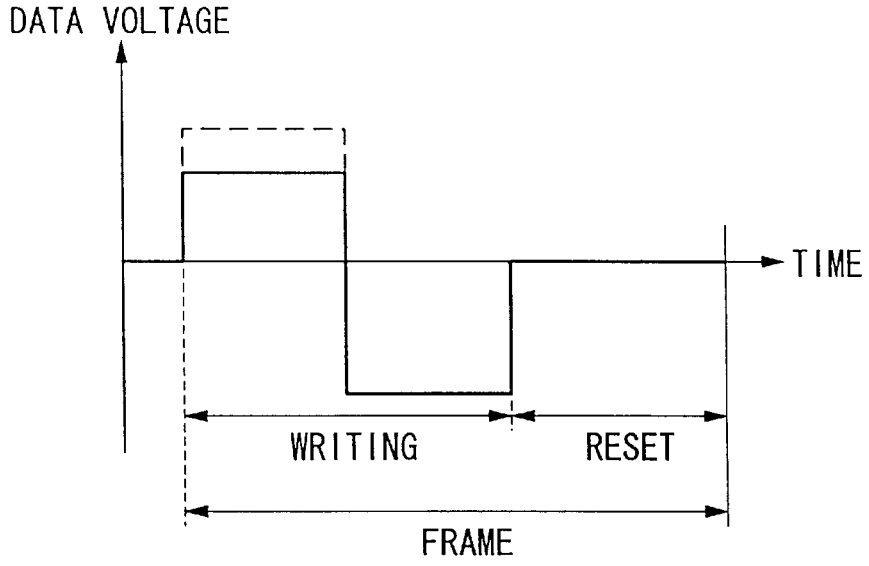
FIG. 27 PRIOR ART
FIG. 27 is an applied voltage waveform diagram for explaining a data signal waveform for preventing the conventional step response.
Figure 28:
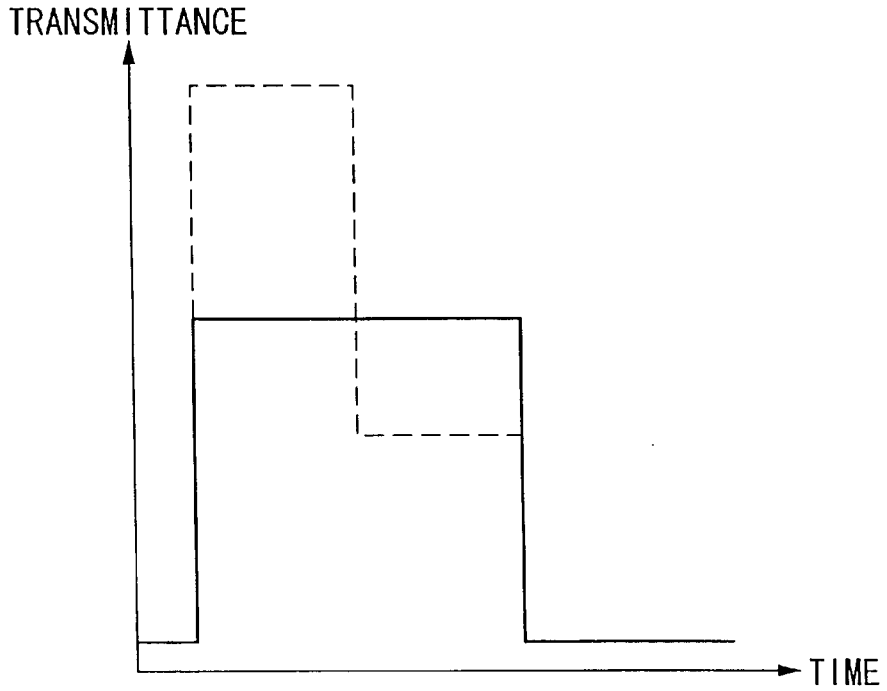
FIG. 28 PRIOR ART
FIG. 28 is a diagram showing transmittance change at the time of the applied voltage of FIG. 27.

Next is a description of an embodiment 1-6 of a liquid crystal display device of the present invention, with reference to FIG. 22 and FIG. 23. FIG. 22 is a sectional view showing a planar type pixel switch according to the embodiment 1-6 of the liquid crystal display device of the present invention, while FIG. 23 is a diagram showing the voltage-transmittance characteristics of the used liquid crystal material. For this embodiment, a polysilicon (polycrystalline silicon, poly Si) TFT array was produced to drive a smectic liquid crystal with a low spontaneous polarization value. Specifically, following formation of a silicon oxide film on a glass substrate, amorphous silicon was grown. Next, annealing was conducted with an excimer laser and the amorphous silicon converted to polysilicon, after which a film of silicon oxide of thickness 100 Å was grown. Following patterning, a photoresist was patterned at a size slightly larger than the gate shape (to allow for subsequent formation of an LDD region), and source and drain regions were then formed by doping of phosphorous ions. Following formation of another silicon oxide film, a microcrystal silicon ($\mu$-c-Si) and tungsten silicide (WSi) were grown, and pattered into a gate shape. An LDD region was then formed by using the patterned photoresist to conduct doping of phosphorous ions only within the necessary region. Following continuous growth of a silicon oxide layer and a silicon nitride layer, contact apertures were opened, and aluminum and tungsten formed via sputtering and subsequently patterned. A silicon nitride layer was formed, contact apertures were opened, and then transparent electrodes of ITO formed as the pixel electrodes and subsequently patterned. In this manner, a planar type TFT pixel switch such as that shown in FIG. 22 was produced, enabling production of a TFT array. Only a pixel array of TFT switches was provided on the glass substrate and a drive circuit was not provided within the substrate, and the drive circuit was mounted externally via a single crystal of silicon. A TFT array substrate produced in this manner, and an opposing substrate comprising an opposing electrode of ITO which was patterned across the entire surface thereof with a subsequent light shielding patterning layer of chrome, were prepared. Patterned columns of 1.8 $\mu$ were produced on the side of the opposing substrate, to act as a spacer and provide shock resistance. Furthermore, an ultraviolet light curable sealant was applied to the outer section of the opposing substrate pixel region. Following bonding of the TFT substrate and the opposing substrate, the liquid crystal material was injected therebetween. For the liquid crystal material a smectic liquid crystal material capable of continuous gray-scale display with a spontaneous polarizing value of approximately 18 ($nC/cm^2$) was used. Furthermore, the voltage-transmittance characteristics of the used liquid crystal were of the form shown in FIG. 23.

With the drive method of this embodiment, in the twenty fourth embodiment of the above mentioned drive methods of the invention, the twenty first embodiment which adopts the fourteenth embodiment is used. For the incident light source, the light source of the first embodiment of Japanese Patent Application No. 11-019095 invented by the present inventors is adopted. As a result, a light source is obtained which is capable of sequential scanning with practically no loss of light. As a result, a high definition image is obtained, with an extremely high efficiency for light utilization.

Figure 33:
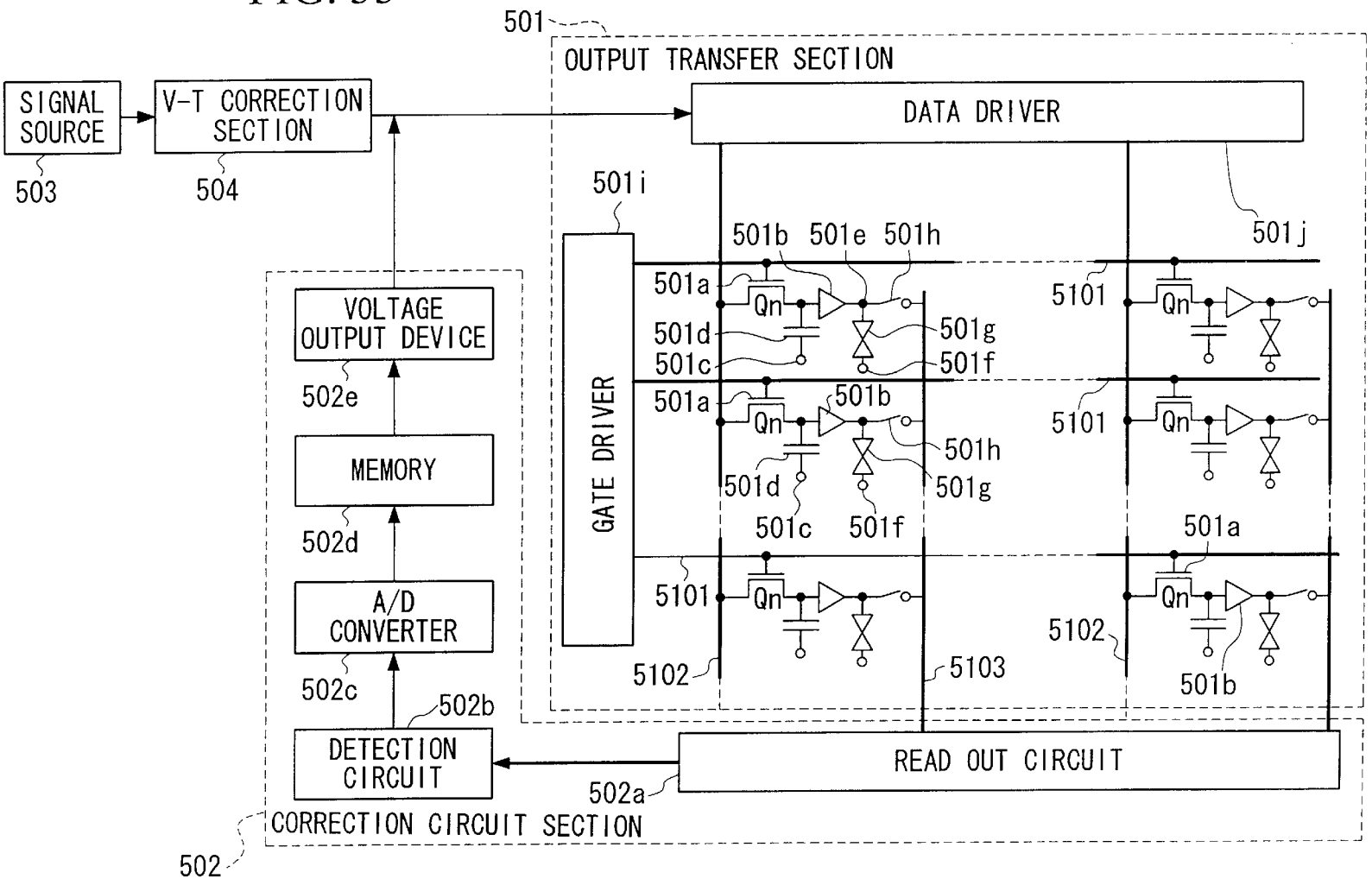
FIG. 33 is a diagram showing a schematic configuration of a liquid crystal display device according to a third embodiment of the present invention.

Next is a description of a liquid crystal display device according to a third embodiment of the present invention. FIG. 33 is a diagram showing a schematic construction of the liquid crystal display device according to the third embodiment of the present invention. In FIG. 33, the liquid crystal display device according to the third embodiment of the invention comprises; an output transfer section 501, a compensation circuit section 502, a signal source 503, and a V-T (Voltage-Transmittance) compensation section 504.

The output transfer section 501 is made up of amplifier output detection pixels each comprising: a MOS type transistor (Qn) 501*a* in the vicinity of respective intersection points of a plurality of scanning lines 5101 which are sequentially driven by a gate driver 501*i*, and a plurality of data lines 5102 for sequentially transferring data signals by means of a data driver 501*j*, with a gate electrode connected to a scanning line 5101 and one of a source electrode and a drain electrode connected to a data line 5102; an analog amplifier circuit 501*b* with an input electrode connected to the other of the source electrode and the drain electrode of the MOS type transistor (Qn) 501*a*, and an output electrode connected to a pixel electrode 501*e*; a voltage holding capacitor 501*d* formed between the input electrode of the analog amplifier circuit 501*b* and a voltage holding capacitor electrode 501*c*; a liquid crystal 501*g*, the orientation of which is to be changed, disposed between the pixel electrode 501*e* and an opposing electrode 501*f*; and a switch 501*h* with an input electrode connected to an output electrode of the analog amplifier circuit 501*b* and an output electrode connected to an amplifier monitor line 5103 or a data line 5102. This output transfer section 501 becomes the image display section as such.

The compensation circuit section 502 comprises: a read out circuit 502*a* connected to the output electrode of the analog amplifier circuit 501*b* through the switch 501*h* and an amplifier monitor line 5103 (there is also the case where the data line 5102 is combined for this); a detection circuit 502*b* for detecting a difference between an output from the read out circuit 502*a* and a reference voltage (Vref); an A/D converter 502*c* for A/D (Analog/Digital) converting the output from the detection circuit 502*b*; a memory 502*d* for storing the output from the A/D converter 502*c*; and a voltage output device 502e for applying a voltage corresponding to the storage contents of the memory 502*d*, to the data signal.

Figure 34:
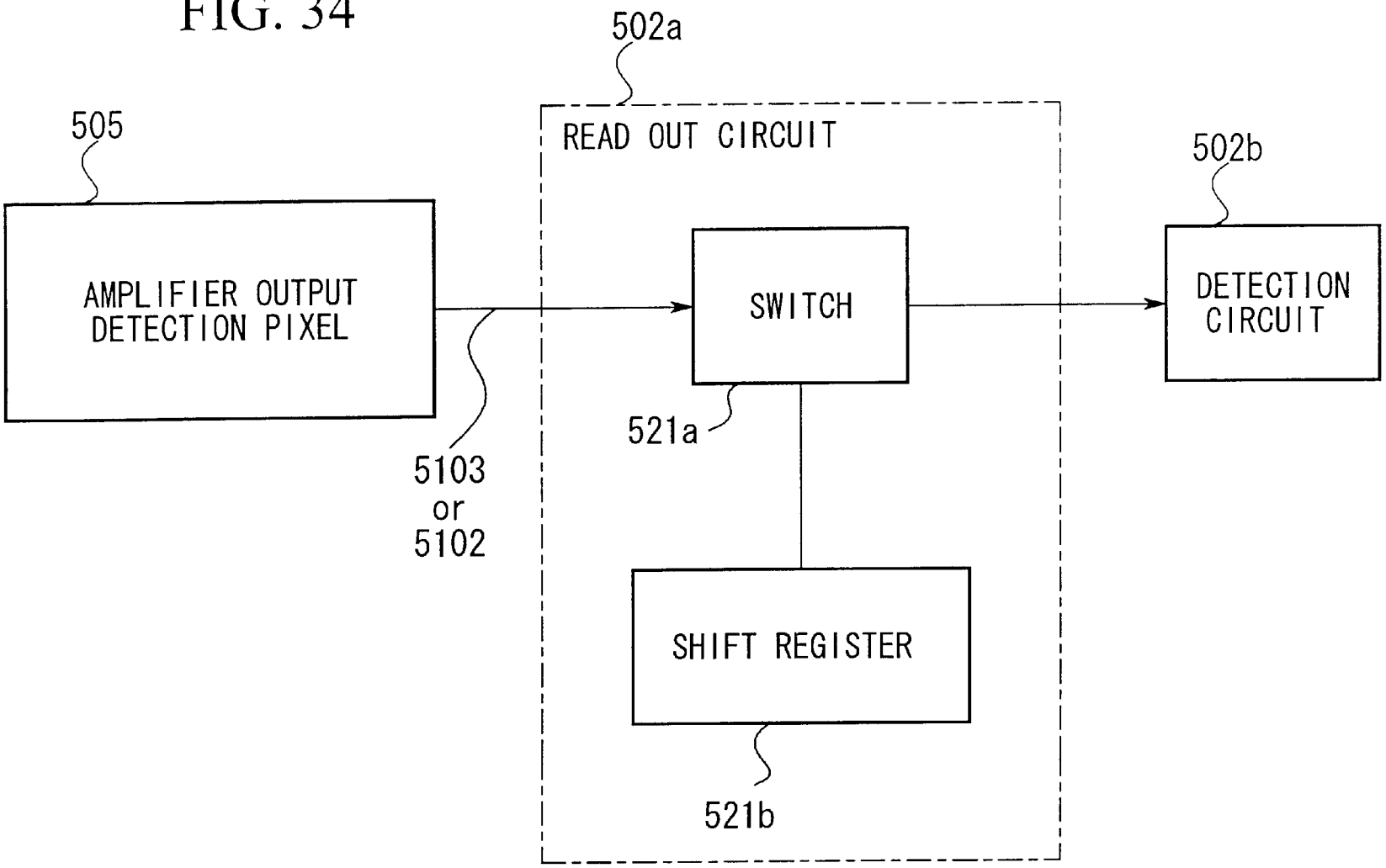
FIG. 34 is a block diagram showing a configuration example of a read out circuit of FIG. 33.

FIG. 34 is a block diagram showing a structural example of the read out circuit 502*a* of FIG. 33. In FIG. 34, the read out circuit 502*a* comprises a switch 521*a* and a shift register 521*b*. The amplifier output voltage Vout sent from the amplifier output detection pixel 505 is transferred to the detection circuit 502*b* by a predetermined sequence.

Figure 35:
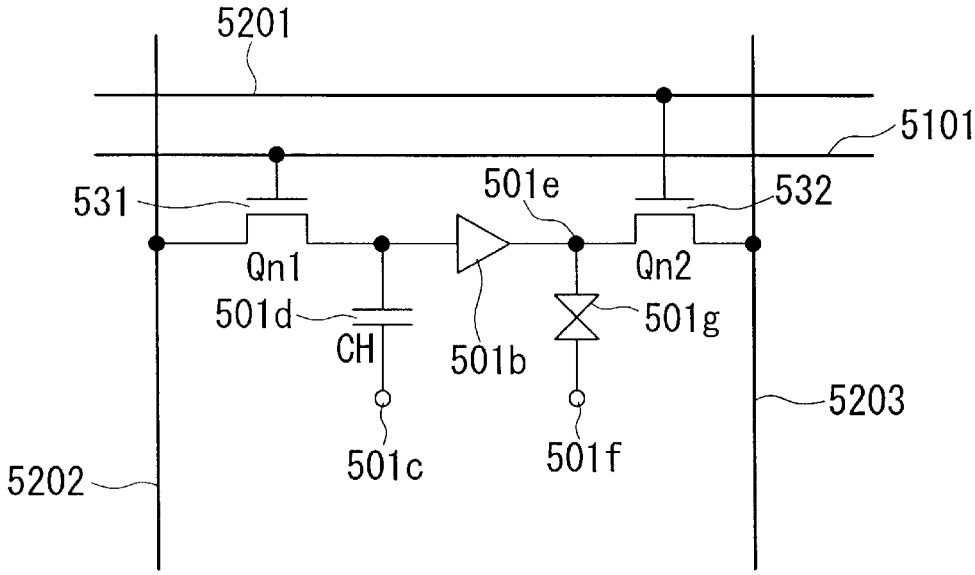
FIG. 35 is a diagram showing a configuration of one pixel section of the liquid crystal display device according to the third embodiment of the present invention.

FIG. 35 is a diagram showing the configuration of one pixel section of the liquid crystal display device according to the third embodiment of the present invention. In FIG. 35, the liquid crystal display device of the third embodiment of the present invention comprises a first MOS type transistor (Qn1) 531 with a gate electrode connected to a scanning line 5101 and one of a source electrode and a drain electrode connected to an Nth data line 5202; an analog amplifier circuit 501*b* with an input electrode connected to the other of the source electrode and the drain electrode of the first MOS type transistor (Qn) 531, and an output electrode connected to a pixel electrode 501*e;* a second MOS type transistor (Qn2) 532 with a gate electrode connected to a switch selection line 5201 and one of a source electrode and a drain electrode connected to an output electrode of an analog amplifier circuit 501*b*, and the other of the source electrode and the drain electrode connected to an N+1th data line 5203, a voltage holding capacitor 501*d* formed between the input electrode of the analog amplifier circuit 501*b* and a voltage holding capacitor electrode 501*c*; and a liquid crystal 501*g*, the orientation of which is to be changed, disposed between the pixel electrode 501*e* and an opposing electrode 501*f*.

Here the first MOS type transistor 531, the second MOS type transistor 532 and the analog amplifier circuit 501*b* are respectively made from p-Si TFTs (Thin Film Transistors). Furthermore, the gain of the analog amplifier circuit 501*b* is set to 1.

Figure 36:
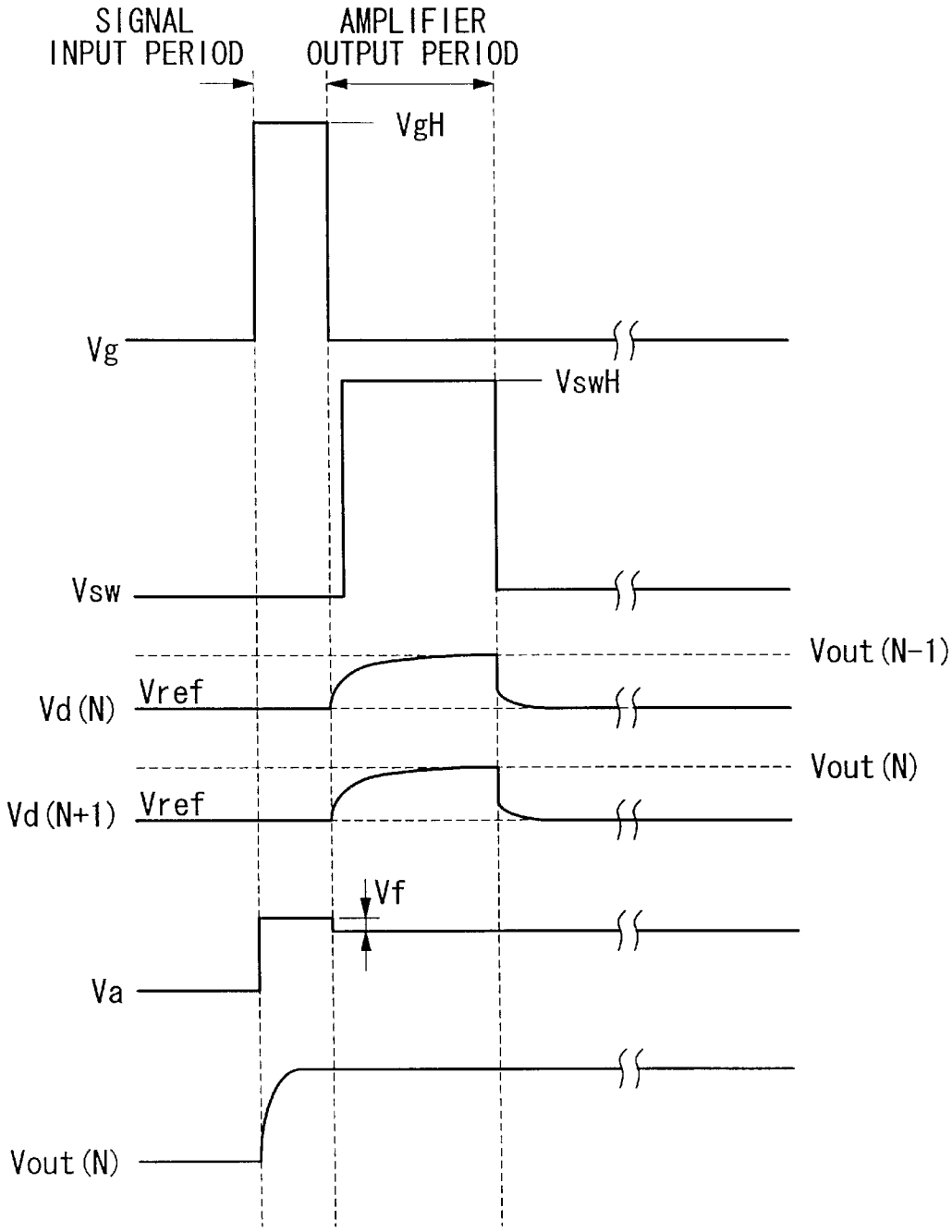
FIG. 36 is a diagram showing a drive method at the time of detecting amplifier output of the liquid crystal display device according to the third embodiment of the present invention.

FIG. 36 is a diagram showing a drive method at the time of amplifier output detection of the liquid crystal display device according to the third embodiment of the present invention. Referring to FIG. 36, a description is given of the amplifier output detection method of the liquid crystal display device which uses the aforementioned pixel configuration.

FIG. 36 shows a timing chart for the gate scanning voltage Vg, the data signal voltage Vd, the switch selection line voltage Vsw, the amplifier input voltage Va, and the amplifier output voltage Vout (=pixel voltage Vpix) for the case where the liquid crystal is driven by the pixel configuration shown in FIG. 35.

As shown in FIG. 36, due to the gate scanning voltage Vg becoming a high level VgH, the first MOS type transistor 531 comes on, and the reference voltage Vref input to the Nth data line is transmitted via the first MOS type transistor 531 to the input electrode of the analog amplifier circuit 501*b*.

The analog amplifier circuit 501*b* outputs an amplifier output voltage Vout corresponding to the amplifier input voltage Va. However at this time, the switch selection line voltage Vsw is set at a low level VswL, so that the second MOS type transistor 532 is off. Hence the amplifier output voltage Vout is not output to the N+1th data line.

When the gate scanning voltage Vg becomes a low level, the first MOS type transistor 531 goes off, and the reference voltage Vref transferred to the input electrode of the analog amplifier circuit 501*b* is held by the voltage holding capacitor electrode 501*c*. At this time, with the amplifier input voltage Va, at the time when the first MOS type transistor 531 goes off, a voltage shift referred to as a feed-through voltage occurs via the capacitance between the gate and the source of the first MOS type transistor 531. In FIG. 36, this voltage shift is shown by Vf.

After the first MOS type transistor 531 goes off, the application of voltage to the data line from the data driver 501*j* ceases, and the switch selection line voltage Vsw becomes a high level VswH. As a result, the second MOS type transistor 532 comes on, and the amplifier output voltage Vout is output to the N+1th data line.

The amplifier input voltage Va is held until the gate scanning voltage Vg again becomes a high level and the first MOS type transistor 531 comes on. The analog amplifier circuit 501*b* thus continues to output a voltage corresponding to this held amplifier input voltage Va during the time until the amplifier input voltage Va changes. Therefore, by monitoring the N+1th data line, the amplifier output voltage can be detected.

In this way, the data line is used as a normal data line in the case where the gate scanning voltage Vg is a high level, and the switch election line voltage Vsw is a low level, and is used as an amplifier output detection line in the case where the gate scanning voltage Vg is a low level and the switch selection line voltage Vsw is a high level. The period where the switch selection line voltage Vsw is a high level, is made sufficiently long so that the start up delay due to the load carrying capacity of the N+1th data line does not cause a problem.

When detection of the amplifier output is completed, the switch selection line voltage Vsw again becomes a low level so that the second MOS type transistor 532 goes off. Furthermore, in the case where image display is performed, the switch selection line voltage Vsw may be continuously set at a low level.

Next is a description of the operation of the circuit shown in FIG. 33. The amplifier output voltage Vout output by the amplifier monitor line 5103 (in the pixel construction shown in FIG. 34, the data line 5102 is combined with this) is sent to the read out circuit 502*a*.

The read out circuit 502*a* can transfer the amplifier output voltage Vout sent by the amplifier output detection pixel to the detection circuit 502*b* by a predetermined sequence. In the detection circuit 502*b*, the voltage difference of the amplifier output voltage Vout and the reference voltage Vref is taken out. This difference data is converted to digital data by the A/D converter 502*c*, and stored in the memory 502*d*.

When displaying images, at the same time that the image data signal is transferred, the difference data is sent from the memory 502*d* to the voltage output device 502*e*, and the compensation voltage corresponding to this is added to the image data signal by the voltage output device 502*e*. In FIG. 33, as another compensation for the image data signal, V-T compensation was explained. However normally in addition to this, processing such as polarity inversion, or phase expansion is performed.

Next is a description of the effect of the liquid crystal display device according to the third embodiment of the present invention. With the liquid crystal display device according to the third embodiment of the invention, also after completion of the horizontal scanning period, the pixel electrode 501*e* is driven by the analog amplifier circuit 501*b*. Hence the fluctuations in the pixel voltage Vpix (=amplifier output voltage Vout) accompanying the response of the liquid crystal as discussed for the conventional technology, can be eliminated.

Figure 53:
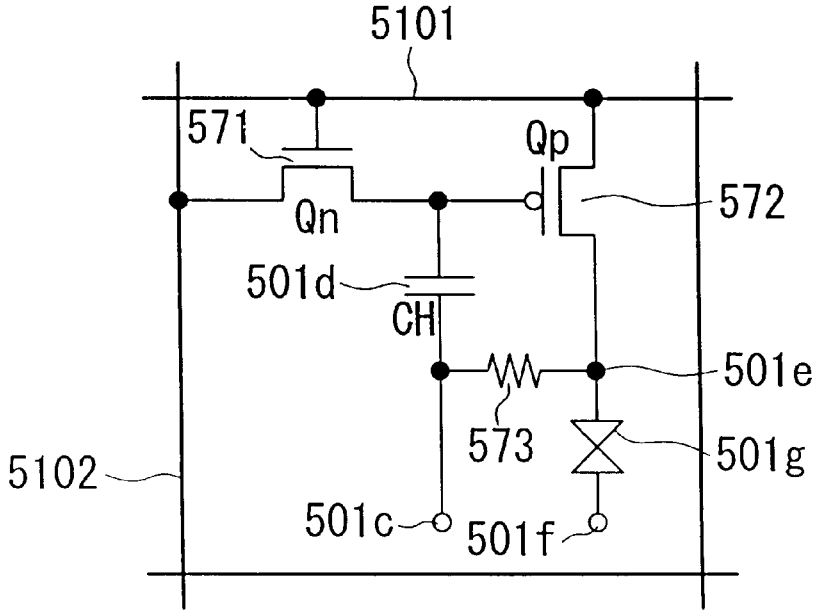
FIG. 53 PRIOR ART
FIG. 53 is a diagram showing another configuration example of a display dedicated pixel in a liquid crystal display device according to a conventional example.

At this time, for example in the construction shown in FIG. 53, the amplifier output voltage can be represented by the following equation using the amplifier input voltage Va, and the threshold value Vt of the MOS type transistor used in the amplifier, namely:

$$\mathrm{Vpix}=Va-Vt \tag{2}$$

Therefore, in the conventional technology where only the analog amplifier circuit is installed, the threshold value fluctuations for each of the pixels becomes the fluctuations of the pixel voltage as such, so that a decrease in image quality such as irregular coloring occurs. However with the liquid crystal display device according to the third embodiment of the present invention, compensation is performed corresponding to the output characteristics of the analog amplifier circuit 501*b* for each of the pixels. Hence such a decrease in image quality does not occur.

In this way, it is possible to use liquid crystal materials in which voltage fluctuations occur during the holding period as mentioned for the conventional technology, such as a polymer liquid crystal, a ferroelectric liquid crystal or antiferroelectric liquid crystal having polarization, or an OCB liquid crystal. In the case of driving these liquid crystal, or a TN liquid crystal used heretofore, a more accurate gray scale is realized, and the affect is obtained where the flickering of the image or the irregular coloring is suppressed.

With the present embodiment, it was noted that the first MOS type transistor 531, the second MOS type transistor 532, and the analog amplifier circuit 501*b* were respectively formed from p-Si TFTs. However these may be formed from other thin film transistors such as a-Si TFTs or cadmium-selenium thin film transistors. Moreover these may be formed from single crystal silicon transistors. Furthermore, with the present embodiment, the gain of the analog amplifier circuit 501*b* is set to 1. However in order to make the pixel voltage different from the input voltage, the voltage amplification may be changed.

Furthermore, with the present embodiment, an n-type MOS transistor is employed for the pixel selection switch. However a p-type MOS transistor may be employed. In this case, for the gate scanning signal, a pulse signal which becomes a low level at the time of selection, and a high level at the time of non selection, is input.

In addition, with the present embodiment, an n-type MOS transistor is employed for the amplifier output switch. However a p-type MOS transistor may be employed. In this case, when the amplifier output switch is selected, a low level VswL is input to the switch selection line, while when the amplifier output switch is non selected, a high level VswH is input to the switch selection line.

In the aforementioned memory 502*d*, either a rewritable memory or a non rewritable memory may be used. In the case where a rewritable memory is used, this may be a volatile or a non volatile memory. In the case where a volatile memory is used, detection of the amplifier output, and writing to memory is executed automatically each time the liquid crystal display device is started. In the non volatile memory also, the same processing can also be applied. Furthermore, irrespective of whether volatile or non volatile, in the case where a rewritable memory is used, detection of the amplifier output and updating of the memory can be performed by the user at an optional timing. Moreover, in the case where a rewritable memory is used, while detection of the amplifier output and writing to memory requires time, changes of the amplifier circuit characteristics over time can be dealt with.

Figure 37:
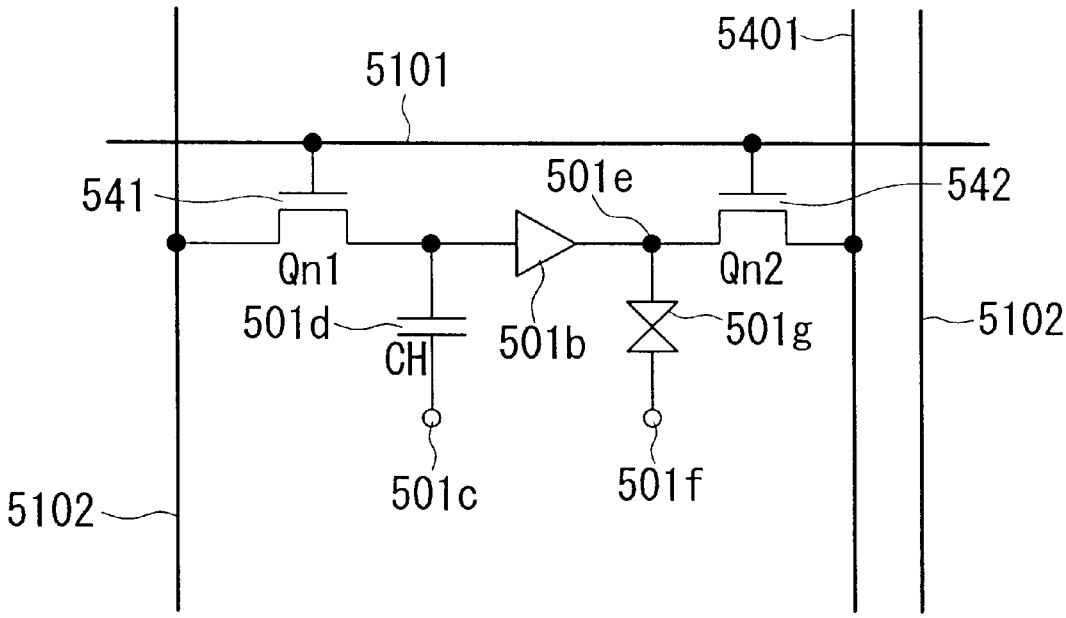
FIG. 37 is a diagram showing another configuration example of one pixel section of the liquid crystal display device according to the third embodiment of the present invention.

FIG. 37 is a diagram showing a structural example of another one pixel section of the liquid crystal display device according to the third embodiment of the present invention. In FIG. 37, the liquid crystal display device of the third embodiment of the present invention comprises a first MOS type transistor (Qn1) 541 with a gate electrode connected to a scanning line 5101 and one of a source electrode and a drain electrode connected to a data line 5102; an analog amplifier circuit 501*b* with an input electrode connected to the other of the source electrode and the drain electrode of the first MOS type transistor (Qn1) 541, and an output electrode connected to a pixel electrode 501*e*; a second MOS type transistor (Qn2) 542 with a gate electrode connected to a scanning line 5101 and one of a source electrode and a drain electrode connected to an output electrode of an analog amplifier circuit 501*b*, and the other of the source electrode and the drain electrode connected to an amplifier monitor line 5401, a voltage holding capacitor 501*d* formed between the input electrode of the analog amplifier circuit 501*b* and a voltage holding capacitor electrode 501*c*; and a liquid crystal 501*g*, the orientation of which is to be changed, disposed between the pixel electrode 501*e* and an opposing electrode 501*f*.

Here the first MOS type transistor 541, the second MOS type transistor 542 and the analog amplifier circuit 501*b* are respectively made from p-Si TFTs. Furthermore, the gain of the analog amplifier circuit 501*b* is set to 1.

Figure 38:
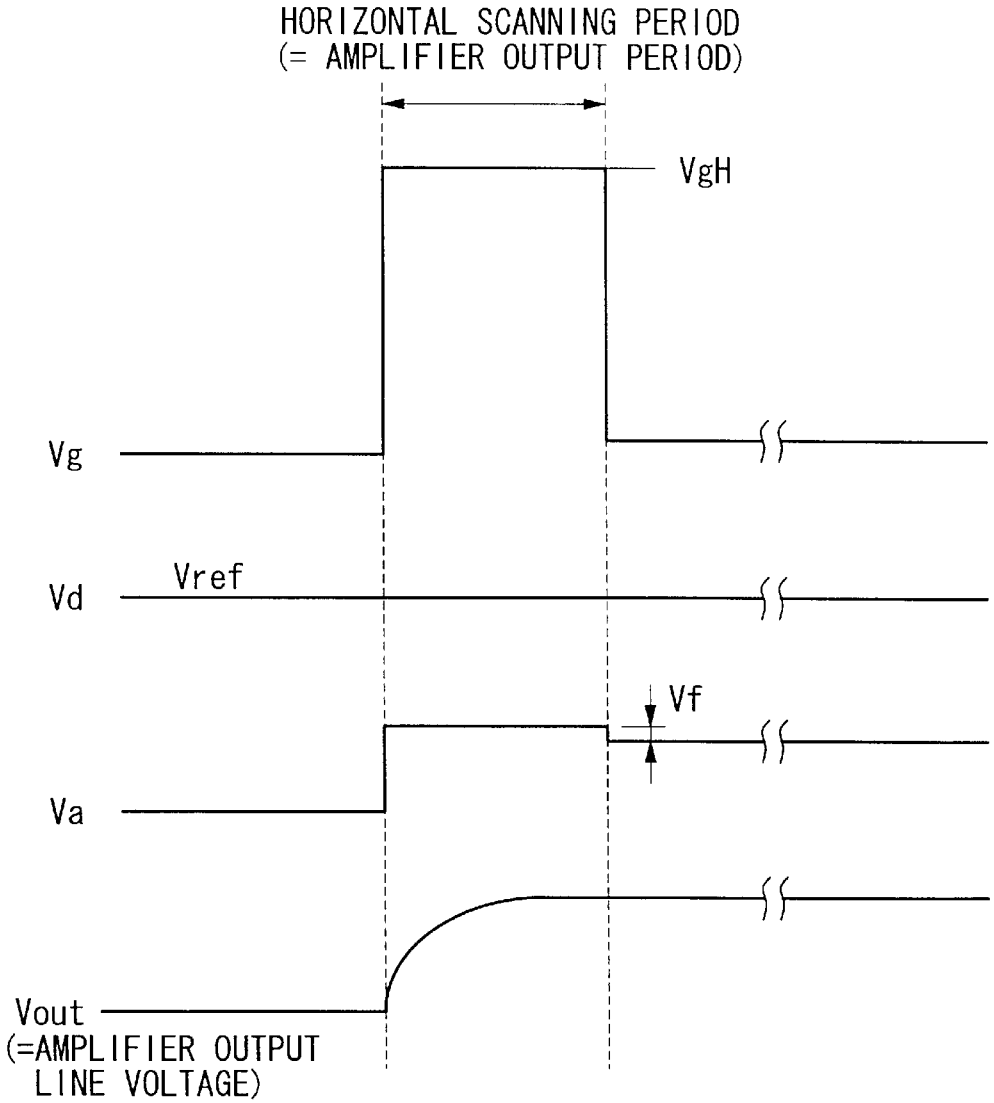
FIG. 38 is a diagram showing a drive method at the time of detecting amplifier output of the liquid crystal display device according to the third embodiment of the present invention.

FIG. 38 is a diagram showing a drive method at the time of amplifier output detection of the liquid crystal display device according to the third embodiment of the present invention. Referring to FIG. 38, a description is given of the amplifier output detection method of the liquid crystal display device which uses the aforementioned pixel configuration.

FIG. 38 shows a timing chart for the gate scanning voltage Vg, the data signal voltage Vd, the amplifier input voltage Va, and the amplifier output voltage (=pixel voltage) Vout for the case where the liquid crystal is driven by the pixel configuration shown in FIG. 37.

As shown in FIG. 38, due to the gate scanning voltage Vg becoming a high level VgH, the first MOS type transistor 541 comes on, and the reference voltage Vref input to the data line is transmitted via the first MOS type transistor 541 to the input electrode of the analog amplifier circuit 501*b*.

The analog amplifier circuit 501*b* outputs an amplifier output voltage Vout corresponding to the amplifier input voltage Va. At this time, since the second MOS type transistor 542 is also on so that the amplifier output voltage Vout is output to the amplifier monitor line 5401, then by monitoring this, the amplifier output can be detected.

When the gate scanning voltage Vg becomes a low level, the first MOS type transistor 541 and the second MOS type transistor 542 both go off, and the output to the amplifier monitor line 5401 is interrupted. The reference voltage Vref itself which is transferred to the input electrode of the analog amplifier circuit 501*b*, is held by the voltage holding capacitor electrode 501*c*. The analog amplifier circuit 501*b* thus continues to output a voltage corresponding to this held amplifier input voltage Va during the time until the amplifier input voltage Va changes.

At this time, with the amplifier input voltage Va, at the time when the first MOS type transistor 541 goes off, a voltage shift referred to as a feed-through voltage occurs via the capacitance between the gate and the source of the transistor. In FIG. 38, this voltage shift is shown by Vf.

The period where the gate scanning voltage is a high level, is made sufficiently long so that the start up delay due to the load carrying capacity of the amplifier monitor line 5401 does not cause a problem. With the construction shown in FIG. 37, in the case where amplifier output is detected and in the case where image display is performed, there is no great difference in the timing chart, and the length of the horizontal scanning period need only be adjusted.

The operation in the case where the construction shown in FIG. 37 is used in the pixel constituting the liquid crystal display device shown in FIG. 33, apart from the fact that the line connected to the read out circuit 502*a* is an amplifier monitor line 5401, is the same as for the case where the construction shown in FIG. 35 is used.

Also in the construction shown in FIG. 37, the same affect as for the case of the construction shown in FIG. 35 is obtained. In addition, the timing chart for the gate scanning voltage Vg, and the data signal voltage Vd at the time of amplifier output voltage detection, with the exception of the length of the horizontal scanning period, is the same as for the case where image display is performed. Therefore, this has the affect that the detection routine for the amplifier output voltage Va can be easily executed by only changing the pulse width or the pulse number for specifying the horizontal scanning period.

With the present embodiment, it was noted that the first MOS type transistor 541, the second MOS type transistor 542, and the analog amplifier circuit 501*b* were formed from p-Si TFTs. However these may be formed from other thin film transistors such as a-Si TFTs or cadmium-selenium thin film transistors. Moreover these may be formed from single crystal silicon transistors. Furthermore, with the present embodiment, the gain of the analog amplifier circuit 501*b* is set to 1. However in order to make the pixel voltage different from the input voltage, the voltage amplification may be changed.

Furthermore, with the present embodiment, an n-type MOS transistor is employed for the pixel selection switch and the amplifier output switch. However a p-type MOS transistor may be employed. In this case, for the gate scanning signal, a pulse signal which becomes a low level at the time of selection, and a high level at the time of non selection, is input.

In addition in the memory 502*d*, either a rewritable memory or a non rewritable memory may be used. In the case where a rewritable memory is used, this may be a volatile or a non volatile memory. In the case where a volatile memory is used, detection of the amplifier output, and writing to memory is executed automatically each time the liquid crystal display device is started. In the non volatile memory also, the same processing can also be applied. Furthermore, irrespective of whether volatile or non volatile, in the case where a rewritable memory is used, detection of the amplifier output and updating of the memory can be performed by the user at an optional timing. Moreover, in the case where a rewritable memory is used, while detection of the amplifier output and writing to memory requires time, changes of the amplifier circuit characteristics over time can be dealt with.

Figure 39:
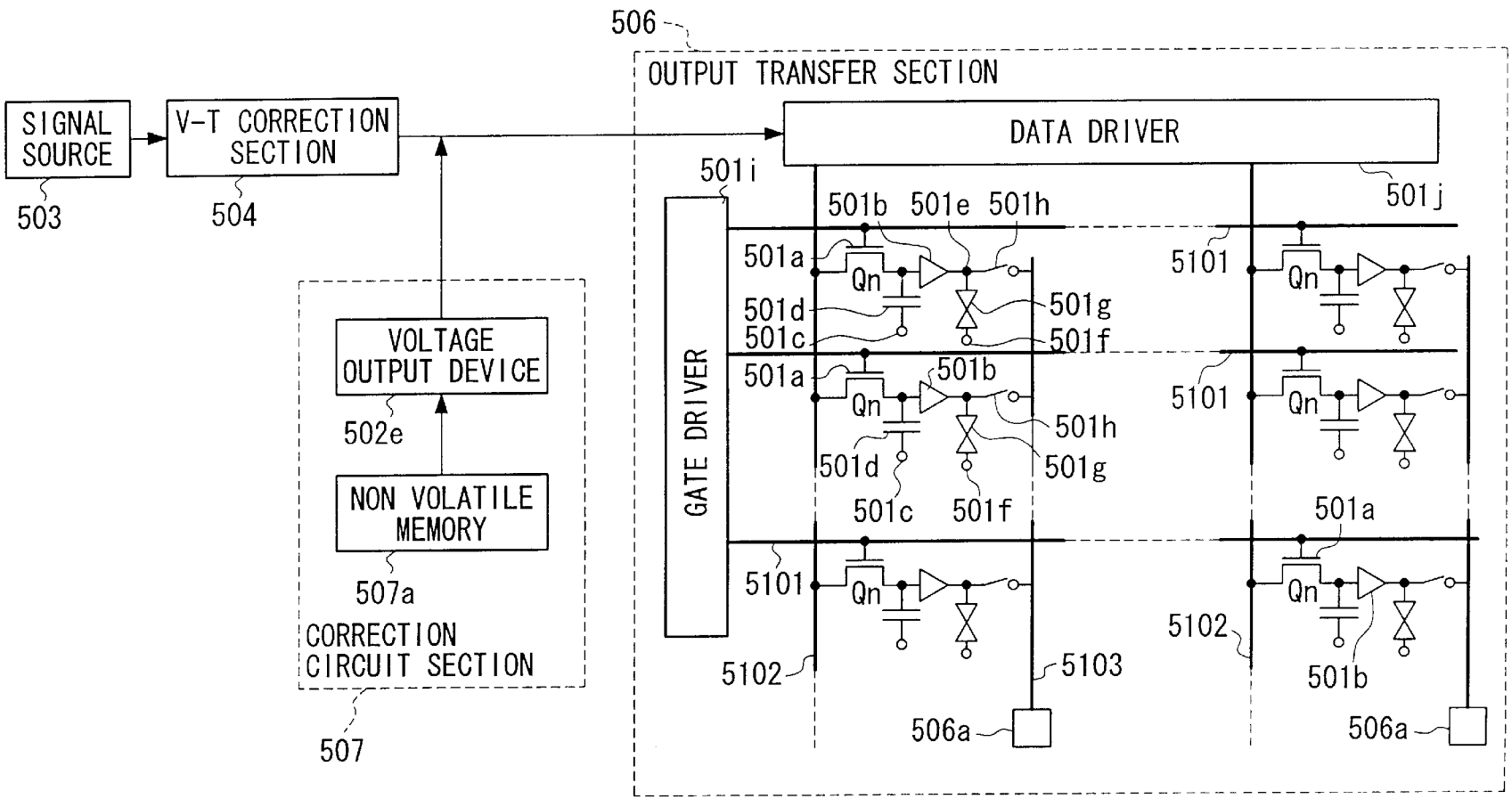
FIG. 39 is a diagram showing a schematic configuration of a liquid crystal display device according to a fourth embodiment of the present invention.

FIG. 39 is a diagram showing a schematic construction of a liquid crystal display device according to a fourth embodiment of the present invention. In FIG. 39, the liquid crystal display device according to the fourth embodiment of the invention comprises; an output transfer section 506, a compensation circuit section 507, a signal source 503, and a V-T compensation section 504.

The output transfer section 506 is made up of amplifier output detection pixels each comprising: a MOS type transistor (Qn) 501*a* in the vicinity of respective intersection points of a plurality of scanning lines 5101 which are sequentially driven by a gate driver 501*i*, and a plurality of data lines 5102 for sequentially transferring data signals by means of a gate driver 501*j*, with a gate electrode connected to a scanning line 5101 and one of a source electrode and a drain electrode connected to a data line 5102; an analog amplifier circuit 501*b* with an input electrode connected to the other of the source electrode and the drain electrode of the MOS type transistor 501*a*, and an output electrode connected to a pixel electrode 501*e*; a voltage holding capacitor 501*d* formed between the input electrode of the analog amplifier circuit 501*b* and a voltage holding capacitor electrode 501*c*; a liquid crystal 501*g*, the orientation of which is to be changed, disposed between the pixel electrode 501*e* and an opposing electrode 501*f*; and a switch 501*h* with an input electrode connected to an output electrode of the analog amplifier circuit 501*b* and an output electrode connected to an amplifier monitor line 5103 or a data line 5102. Moreover, the construction involves a terminal electrode 506*a* so that one end of the amplifier monitor line 5103 can be measured by an external measuring device (omitted from the figure).

This output transfer section 506 becomes the image display section as such. The compensation circuit section 507 comprises a non volatile memory 507*a*, and a voltage output device 502*e* for applying a voltage corresponding to the storage contents of the non volatile memory 507*a*, to the data data line.

Figure 40:
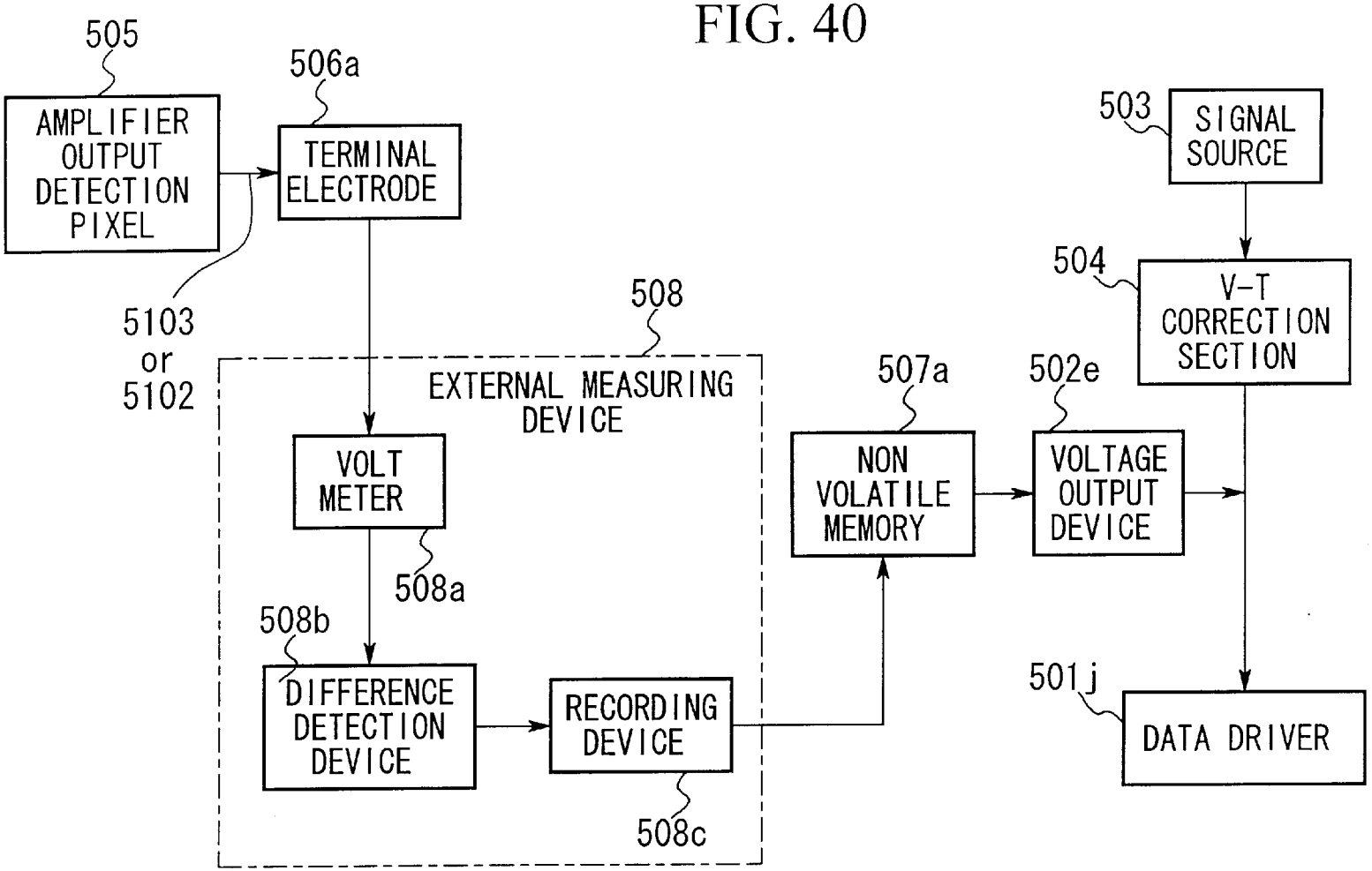
FIG. 40 is a block diagram for explaining the operation of the liquid crystal display device according to the fourth embodiment of the present invention.

FIG. 40 is a block diagram for explaining the operation of the liquid crystal display device according to the fourth embodiment of the present invention. FIG. 40 shows the procedures for amplifier output compensation in the liquid crystal display device according to the fourth embodiment of the present invention.

The amplifier output voltage Vout is output to the terminal electrode 506*a* by the amplifier monitor line 5103 or the data line 5102. An external measuring device 508 comprises; a volt meter 508*a* for reading out the voltage Vout of the terminal electrode 506*a*, a difference detection device 508*b* for detecting a difference voltage between the amplifier output voltage Vout and the reference voltage Vref, and a recording device 508*c* for recording the difference data in the non volatile memory 507*a*.

In this way, the amplifier output characteristics for each pixel are recorded in the non volatile memory 507*a*. When displaying images, at the same time that the image data signal is transferred, the difference data is sent from the non volatile memory 507*a* to the voltage output device 502*e*, and the compensation voltage corresponding to the difference data is added to the image data signal by the voltage output device 502*e*.

The construction of the one pixel in the liquid crystal display device according to the fourth embodiment, is the same as the construction shown in FIG. 35 and FIG. 37. Also in the liquid crystal display device according to the fourth embodiment of the present invention, the same affect as for the liquid crystal display device according to the third embodiment of the invention is obtained. In addition, since the read out circuit 502*a*, the detection circuit 502*b*, and the A/D converter 502*c* which were necessary in the liquid crystal display device according to the third embodiment of the invention become unnecessary, this has the effect that the circuit construction is simplified.

FIG. 41 is a diagram showing a schematic construction of a liquid crystal display device according to a fifth embodiment of the present invention. In FIG. 41, the liquid crystal display device according to the fifth embodiment of the invention comprises; a display section 509, an output transfer section 510, a compensation circuit section 511, a signal source 503, and a V-T compensation section 504.

With the liquid crystal display device according to the fifth embodiment of the invention, the semiconductor layer of the transistor is a thin film semiconductor layer which has been crystallized or recrystallized by laser annealing. The laser scanning direction at that time is parallel to or at an angle substantially the same as the scanning line 5101.

The display section 509 is made up of display pixels each comprising: a MOS type transistor (Qn) 501*a* in the vicinity of respective intersection points of a plurality of scanning lines 5101 which are sequentially driven by a gate driver 501*i*, and a plurality of data lines 5102 for sequentially transferring data signals by means of a data driver 501*j*, with a gate electrode connected to a scanning line 5101 and one of a source electrode and a drain electrode connected to a data line 5102; an analog amplifier circuit 501*b* with an input electrode connected to the other of the source electrode and the drain electrode of the MOS type transistor 501 a, and an output electrode connected to a pixel electrode 501*e*; a voltage holding capacitor 501*d* formed between the input electrode of the analog amplifier circuit 501*b* and a voltage holding capacitor electrode 501*c*; and a liquid crystal 501*g*, the orientation of which is to be changed, disposed between the pixel electrode 501*e* and an opposing electrode 501*f*.

The output transfer section 510 is made up of amplifier output detection pixels each comprising: a MOS type transistor (Qn) 501*a* with a gate electrode connected to a final stage scanning line 5104 and one of a source electrode and a drain electrode connected to a data line 5102; an analog amplifier circuit 501*b* with an input electrode connected to the other of the source electrode and the drain electrode of the MOS type transistor 501*a*, and an output electrode connected to a pixel electrode 501*e*; a voltage holding capacitor 501*d* formed between the input electrode of the analog amplifier circuit 501*b* and a voltage holding capacitor electrode 501*c*; a liquid crystal 501*g*, the orientation of which is to be changed, disposed between the pixel electrode 501*e* and an opposing electrode 501*f*; and a switch 501*h* with an input electrode connected to an output electrode of the analog amplifier circuit 501*b* and an output electrode connected to an amplifier monitor line 5103 or a data line 5102. These amplifier output detection pixels are provided on the final stage scanning line 5104 farthest from the data driver 501*j*.

The compensation circuit section 511 comprises: a read out circuit 502*a* connected to the switch 501*h*; a detection circuit 502*b* for detecting a difference between an output from the read out circuit 502*a* and a reference voltage (Vref); an A/D converter 502*c* for AID converting the output from the detection circuit 502*b*; a memory 502*d* for storing the output from the A/D converter 502*c*; and a voltage output device 502*e* for applying a voltage corresponding to the storage contents of the memory 502*d*, to the data signal.

Figure 52:
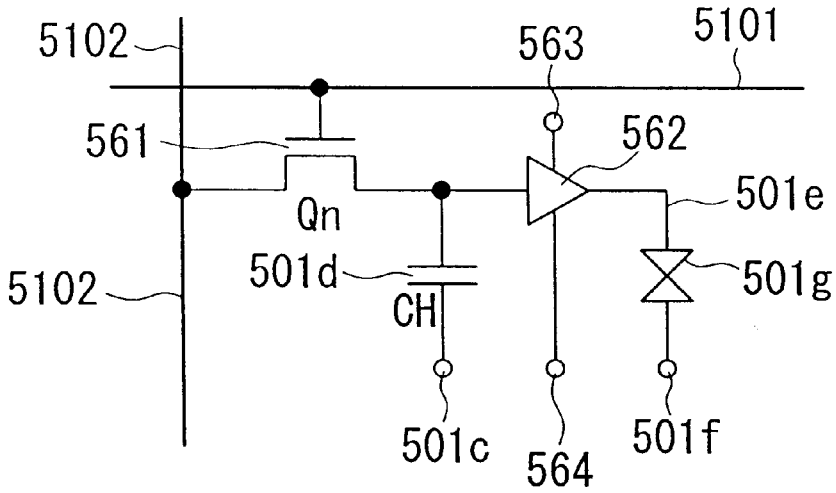
FIG. 52 PRIOR ART
FIG. 52 is a diagram showing one configuration example of a display dedicated pixel in a liquid crystal display device according to a conventional example.

The construction of the display section pixels in the liquid crystal display device according to the fifth embodiment of the present invention is the same as the construction shown in FIG. 52. Furthermore, the construction of the amplifier output detection pixels in the liquid crystal display device according to the fifth embodiment of the invention is the same as the construction shown in FIG. 35 and FIG. 37. However, instead of the switch selection line 5201 in FIG. 35, the scanning line which is not used for display may be used.

The operation of the liquid crystal display device according to the fifth embodiment of the present invention shown in FIG. 41 is the same as for the case of the liquid crystal display device according to the third embodiment of the present invention. However, in the liquid crystal display device according to the third embodiment of the invention and the liquid crystal display device according to the fourth embodiment of the invention, the difference data for amplifier output compensation is present for each bit. However in the liquid crystal display device according to the fifth embodiment of the invention, in the case where the data lines are common, then the same line is used for the compensation difference data.

With the present embodiment, it is noted that the amplifier output detection bits are connected to the final stage scanning line 5104 farthest from the data driver 501*j*. However these amplifier output detection bits may be used in the actual image display, or dummy bits which are not used in the actual display may be used. In the case of using dummy bits, any dummy bit may be used, and this is not limited to the description for the scanning line farthest from the data driver 501*j*.

Furthermore, with the present embodiment, it was noted that the MOS type transistor 501*a* and the analog amplifier circuit 501*b* were formed from p-Si TFTs. However these may be formed from single crystal silicon transistors, or may be formed from other thin film transistors using laser scanning in the production process. Moreover, this is not limited to laser scanning, but the present embodiment is also effective in the case where a process is used in which in the manufacture, noticeable deviations can be expected in the scanning line direction In addition, with the present embodiment, the gain of the analog amplifier circuit 501*b* is set to 1. However in order to make the pixel voltage different from the input voltage, the voltage amplification may be changed.

With the present embodiment, an n-type MOS transistor is employed for the pixel selection switch. However a p-type MOS transistor may be employed. In this case, for the gate scanning signal, a pulse signal which becomes a low level at the time of selection, and a high level at the time of non selection, is input.

In the aforementioned memory 502*d*, either a rewritable memory or a non rewritable memory may be used. In the case where a rewritable memory is used, this may be a volatile or a non volatile memory. In the case where a volatile memory is used, detection of the amplifier output, and writing to memory is executed automatically each time the liquid crystal display device is started. In the non volatile memory also, the same processing can also be applied. Furthermore, irrespective of whether volatile or non volatile, in the case where a rewritable memory is used, detection of the amplifier output and updating of the memory can be performed by the user at an optional timing. Moreover, in the case where a rewritable memory is used, while detection of the amplifier output and writing to memory requires time, changes of the amplifier circuit characteristics over time can be dealt with.

In the liquid crystal display device according to the fifth embodiment of the present invention, compensation of the amplifier output is performed with respect to the laser scanning direction, where variations in transistor characteristics are large, at the time of laser annealing, and the same effect as for the liquid crystal display device according to the third embodiment of the present invention is obtained with respect to the overall screen. In addition, since the amplifier output detection bits are divided out from the image display section (even at the most, only one scanning line portion influences the image), the amplifier output can be corrected without a decrease in the pixel aperture ratio.

Furthermore, since the compensation data is common to the data line, then compared to the liquid crystal display device according to the third embodiment of the invention and the liquid crystal display device according to the fourth embodiment of the invention, this has the effect that the capacity of the memory 502*d* can be reduced. Furthermore, the application of compensation voltage to the data signal is simplified, enabling an increase in speed.

Figure 42:
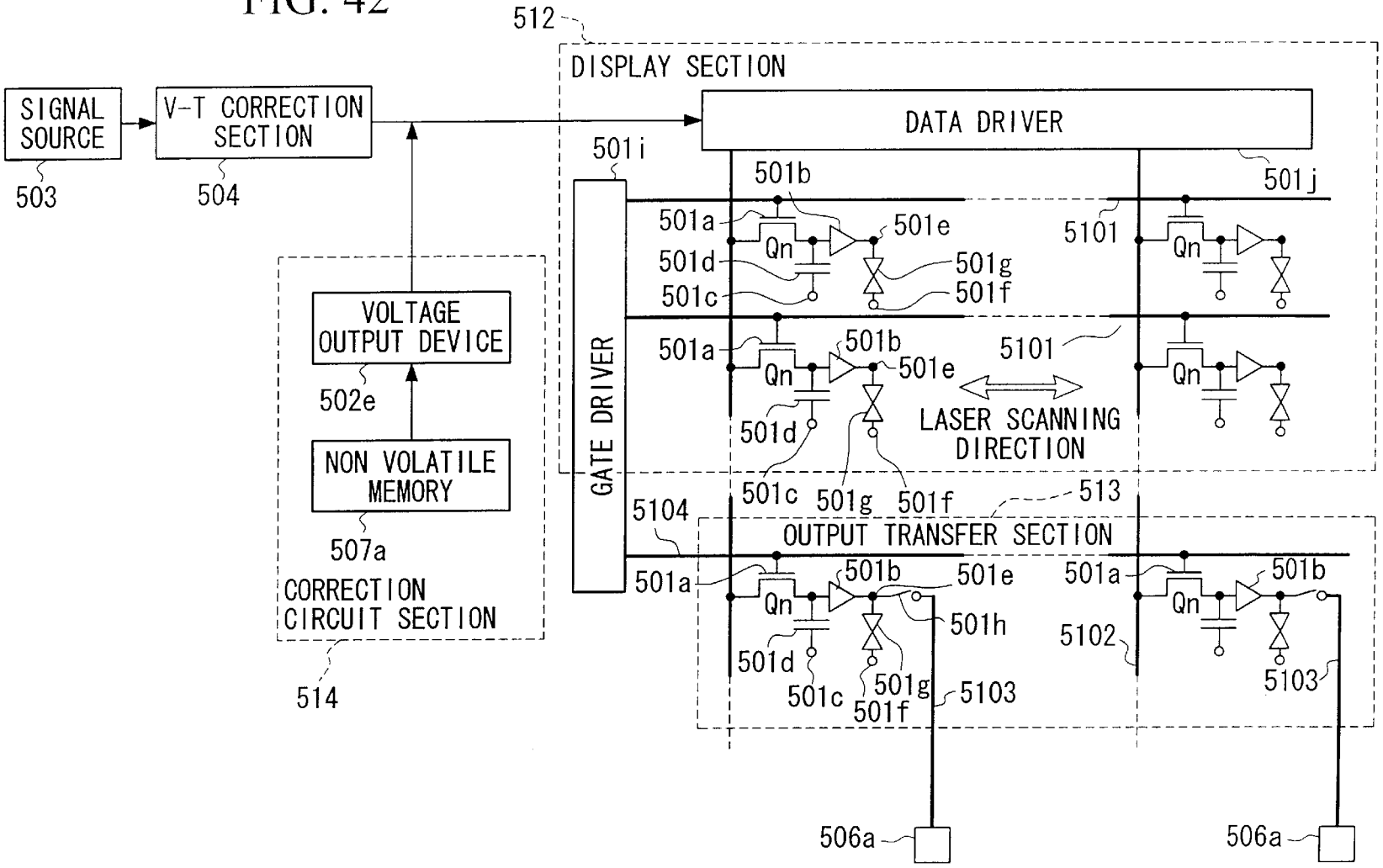
FIG. 42 is a diagram showing a schematic configuration of a liquid crystal display device according to a sixth embodiment of the present invention.

FIG. 42 is a diagram showing a schematic construction of a liquid crystal display device according to a sixth embodiment of the present invention. In FIG. 42, the liquid crystal display device according to the sixth embodiment of the invention comprises; a display section 512, an output transfer section 513, a compensation circuit section 514, a signal source 503, and a V-T compensation section 504.

In the liquid crystal display device according to the sixth embodiment of the invention, the semiconductor layer of the transistor is a thin film semiconductor layer which has been crystallized or recrystallized by laser annealing. The laser scanning direction at that time is parallel to or at an angle substantially the same as the scanning line 5101.

The display section 512 is made up of display pixels each comprising: a MOS type transistor (Qn) 501*a* in the vicinity of respective intersection points of a plurality of scanning lines 5101 which are sequentially driven by a gate driver 501*i*, and a plurality of data lines 5102 for sequentially transferring data signals by means of a data driver 501*j*, with a gate electrode connected to a scanning line 5101 and one of a source electrode and a drain electrode connected to a data line 5102; an analog amplifier circuit 501*b* with an input electrode connected to the other of the source electrode and the drain electrode of the MOS type transistor 501*a*, and an output electrode connected to a pixel electrode 501*e*; a voltage holding capacitor 501*d* formed between the input electrode of the analog amplifier circuit 501*b* and a voltage holding capacitor electrode 501*c*; and a liquid crystal 501*g*, the orientation of which is to be changed, disposed between the pixel electrode 501*e* and an opposing electrode 501*f*.

The output transfer section 513 is made up of amplifier output detection pixels each comprising: a MOS type transistor (Qn) 501*a* with a gate electrode connected to a final stage scanning line 5104 and one of a source electrode and a drain electrode connected to a data line 5102; an analog amplifier circuit 501*b* with an input electrode connected to the other of the source electrode and the drain electrode of the MOS type transistor 501*a*, and an output electrode connected to a pixel electrode 501*e*; a voltage holding capacitor 501*d* formed between the input electrode of the analog amplifier circuit 501*b* and a voltage holding capacitor electrode 501*c*; a liquid crystal 501*g*, the orientation of which is to be changed, disposed between the pixel electrode 501*e* and an opposing electrode 501*f*; and a switch 501*h* with an input electrode connected to an output electrode of the analog amplifier circuit 501*b* and an output electrode connected to an amplifier monitor line 5103 or a data line 5102.

These amplifier output detection pixels are provided on the final stage scanning line 5104 farthest from the data driver 501*j*. Moreover, the construction involves a terminal electrode 506*a* so that one end of the amplifier monitor line 5103 can be measured by an external measuring device (omitted from the figure). The compensation circuit section 514 comprises a non volatile memory 507*a*, and a voltage output device 502*e* for applying a voltage corresponding to the storage contents of the non volatile memory 507*a*, to the data data line.

The operation of the liquid crystal display device according to the sixth embodiment of the present invention shown in FIG. 42 is the same as the operation of the liquid crystal display device according to the fourth embodiment of the present invention shown in FIG. 39. The construction of the amplifier output detection pixels in the liquid crystal display device according to the sixth embodiment of the present invention is the same as the construction shown in FIG. 35 and FIG. 37. However, instead of the switch selection line in FIG. 35, the scanning line which is not used for display may be used.

With the present embodiment, it is noted that the amplifier output detection bits are connected to the final stage scanning line 5104 farthest from the data driver 501*j*. However these amplifier output detection bits may be used in the actual image display, or dummy bits which are not used in the actual display may be used. In the case of using dummy bits, any dummy bit may be used, and this is not limited to the description for the scanning line farthest from the data driver 501*j*.

Furthermore, with the present embodiment, it was noted that the MOS type transistor 501*a* and the analog amplifier circuit 501*b* were formed from p-Si TFTs. However these may be formed from single crystal silicon transistors, or may be formed from other thin film transistors using laser scanning in the production process. Moreover, this is not limited to laser scanning, but the present embodiment is also effective in the case where a process is used in which in the manufacture, noticeable deviations can be expected in the scanning line direction.

In addition, with the present embodiment, the gain of the analog amplifier circuit 501*b* is set to 1. However in order to make the pixel voltage different from the input voltage, the voltage amplification may be changed. With the present embodiment, an n-type MOS transistor is employed for the pixel selection switch. However a p-type MOS transistor may be employed. In this case, for the gate scanning signal, a pulse signal which becomes a low level at the time of selection, and a high level at the time of non selection, is input.

Also in the liquid crystal display device according to the sixth embodiment of the present invention, the same affect as for the liquid crystal display device according to the fifth embodiment of the invention is obtained. In addition, since the read out circuit 502*a*, the detection circuit 502*b*, and the A/D converter 502*c* which were necessary in the liquid crystal display device according to the fifth embodiment of the invention become unnecessary, this has the effect that the circuit construction is simplified.

Figure 43:
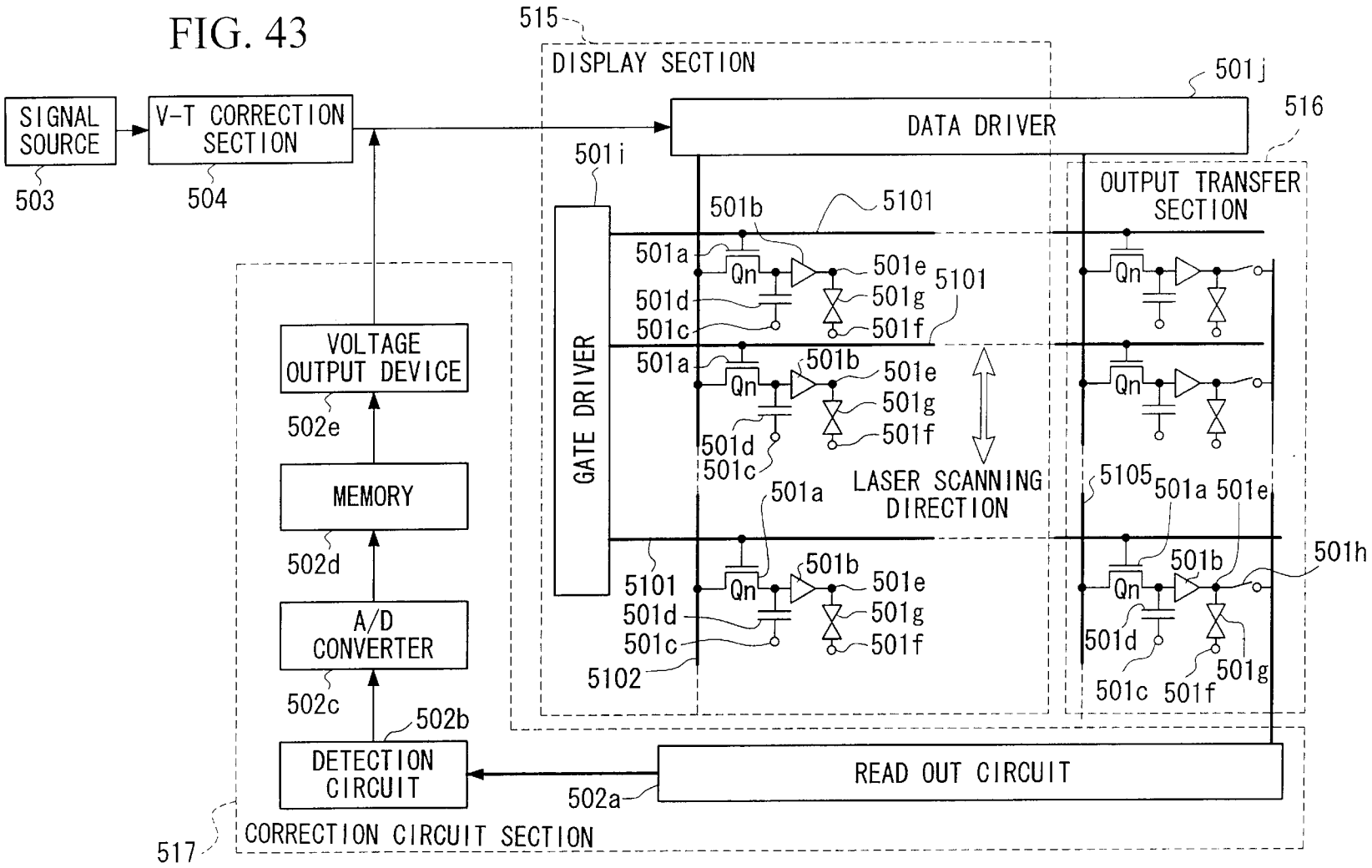
FIG. 43 is a diagram showing a schematic configuration of a liquid crystal display device according to a seventh embodiment of the present invention.

FIG. 43 is a diagram showing a schematic construction of a liquid crystal display device according to a seventh embodiment of the present invention. In FIG. 43, the liquid crystal display device according to the seventh embodiment of the invention comprises; a display section 515, an output transfer section 516, a compensation circuit section 517, a signal source 503, and a V-T compensation section 504.

In the liquid crystal display device according to the seventh embodiment of the invention, the semiconductor layer of the transistor is a thin film semiconductor layer which has been crystallized or recrystallized by laser annealing. The laser scanning direction at that time is parallel to or at an angle substantially the same as the data line 5102.

The display section 515 is made up of display pixels each comprising: a MOS type transistor (Qn) 501*a* in the vicinity of respective intersection points of a plurality of scanning lines 5101 which are sequentially driven by a gate driver 501*i*, and a plurality of data lines 5102 for sequentially transferring data signals by means of a data driver 501*j*, with a gate electrode connected to a scanning line 5101 and one of a source electrode and a drain electrode connected to a data line 5102; an analog amplifier circuit 501*b* with an input electrode connected to the other of the source electrode and the drain electrode of the MOS type transistor 501*a*, and an output electrode connected to a pixel electrode 501*e*; a voltage holding capacitor 501*d* formed between the input electrode of the analog amplifier circuit 501*b* and a voltage holding capacitor electrode 501*c*; and a liquid crystal 501*g*, the orientation of which is to be changed, disposed between the pixel electrode 501*e* and an opposing electrode 501*f*.

The output transfer section 516 is made up of amplifier output detection pixels each comprising: a MOS type transistor (Qn) 501*a* with a gate electrode connected to a scanning line 5101 and one of a source electrode and a drain electrode connected to a final stage data line 5105; an analog amplifier circuit 501*b* with an input electrode connected to the other of the source electrode and the drain electrode of the MOS type transistor 501*a*, and an output electrode connected to a pixel electrode 501*e*; a voltage holding capacitor 501*d* formed between the input electrode of the analog amplifier circuit 501*b* and a voltage holding capacitor electrode 501*c*; a liquid crystal 501*g*, the orientation of which is to be changed, disposed between the pixel electrode 501*e* and an opposing electrode 501*f*; and a switch 501*h* with an input electrode connected to an output electrode of the analog amplifier circuit 501*b* and an output electrode connected to an amplifier monitor line 5103 or a data line 5102. These amplifier output detection pixels are provided on the last data line 5105 farthest from the gate driver 501*i*.

The compensation circuit section 517 comprises: a read out circuit 502*a* connected to the switch 501*h*; a detection circuit 502*b* for detecting a difference between an output from the read out circuit 502*a* and a reference voltage (Vref);

an A/D converter 502*c* for A/D converting the output from the detection circuit 502*b*; a memory 502*d* for storing the output from the A/D converter 502*c*; and a voltage output device 502*e* for applying a voltage corresponding to the storage contents of the memory 502*d*, to the data signal.

The construction of the amplifier output detection pixels in the liquid crystal display device according to the seventh embodiment of the present invention is the same as the construction shown in FIG. 35 and FIG. 37. However, instead of the amplifier monitor line 5201 in FIG. 37, the data line which is not used for display may be used.

The operation of the liquid crystal display device according to the seventh embodiment of the present invention shown in FIG. 43 is the same as the operation of the liquid crystal display device according to the third embodiment of the invention shown in FIG. 33. However, in the liquid crystal display device according to the third embodiment of the invention, the difference data for amplifier output compensation is present for each bit. However in the liquid crystal display device according to the seventh embodiment of the invention, in the case where the scanning lines are common, then the same data is used for the compensation difference data.

In FIG. 43, the amplifier detection bit is connected by one amplifier monitor line (or data line). However the amplifier monitor line may be connected to the read out circuit 502*a* independently for each of the respective amplifier output detection bits. Furthermore, with this embodiment, it is noted that the amplifier output detection bits are connected to the last data line 5105 farthest from the gate driver 501*i*. However this is the case where the gate driver 501*i* is installed on only one side of the screen. In the case where this is installed on both sides of the screen, then this is connected to the data line which is closest to either of the gate drivers. These amplifier output detection bits may be used in the actual image display, or dummy bits which are not used in the actual display may be used. In the case of using dummy bits, any dummy bit may be used, and this is not limited to the description for the data line farthest (closest in the case of both side gate drivers) from the gate driver 501*i*.

Furthermore, with the present embodiment, it was noted that the MOS type transistor 501*a* and the analog amplifier circuit 501*b* were formed from p-Si TFTs. However these may be formed from single crystal silicon transistors, or may be formed from other thin film transistors using laser scanning in the production process. In this case, this is not limited to laser scanning, but the present embodiment is effective in the case where a process is used in which in the manufacture, noticeable deviations can be expected in the data line direction.

Moreover, with the present embodiment, the gain of the analog amplifier circuit 501*b* is set to 1. However in order to make the pixel voltage different from the input voltage, the voltage amplification may be changed. In addition, with the present embodiment, an n-type MOS transistor is employed for the pixel selection switch. However a p-type MOS transistor may be employed. In this case, for the gate scanning signal, a pulse signal which becomes a low level at the time of selection, and a high level at the time of non selection, is input.

In the aforementioned memory 502*d*, either a rewritable memory or a non rewritable memory may be used. In the case where a rewritable memory is used, this may be a volatile or a non volatile memory. In the case where a volatile memory is used, detection of the amplifier output, and writing to memory is executed automatically each time the liquid crystal display device is started. In the non volatile memory also, the same processing can also be applied.

Furthermore, irrespective of whether volatile or non volatile, in the case where a rewritable memory is used, detection of the amplifier output and updating of the memory can be performed by the user at an optional timing. Moreover, in the case where a rewritable memory is used, while detection of the amplifier output and writing to memory requires time, changes of the amplifier circuit characteristics over time can be dealt with. Also in the liquid crystal display device in the seventh embodiment of the present invention, the same effect is obtained as for that in the liquid crystal display device in the fifth embodiment of the present invention.

Figure 44:
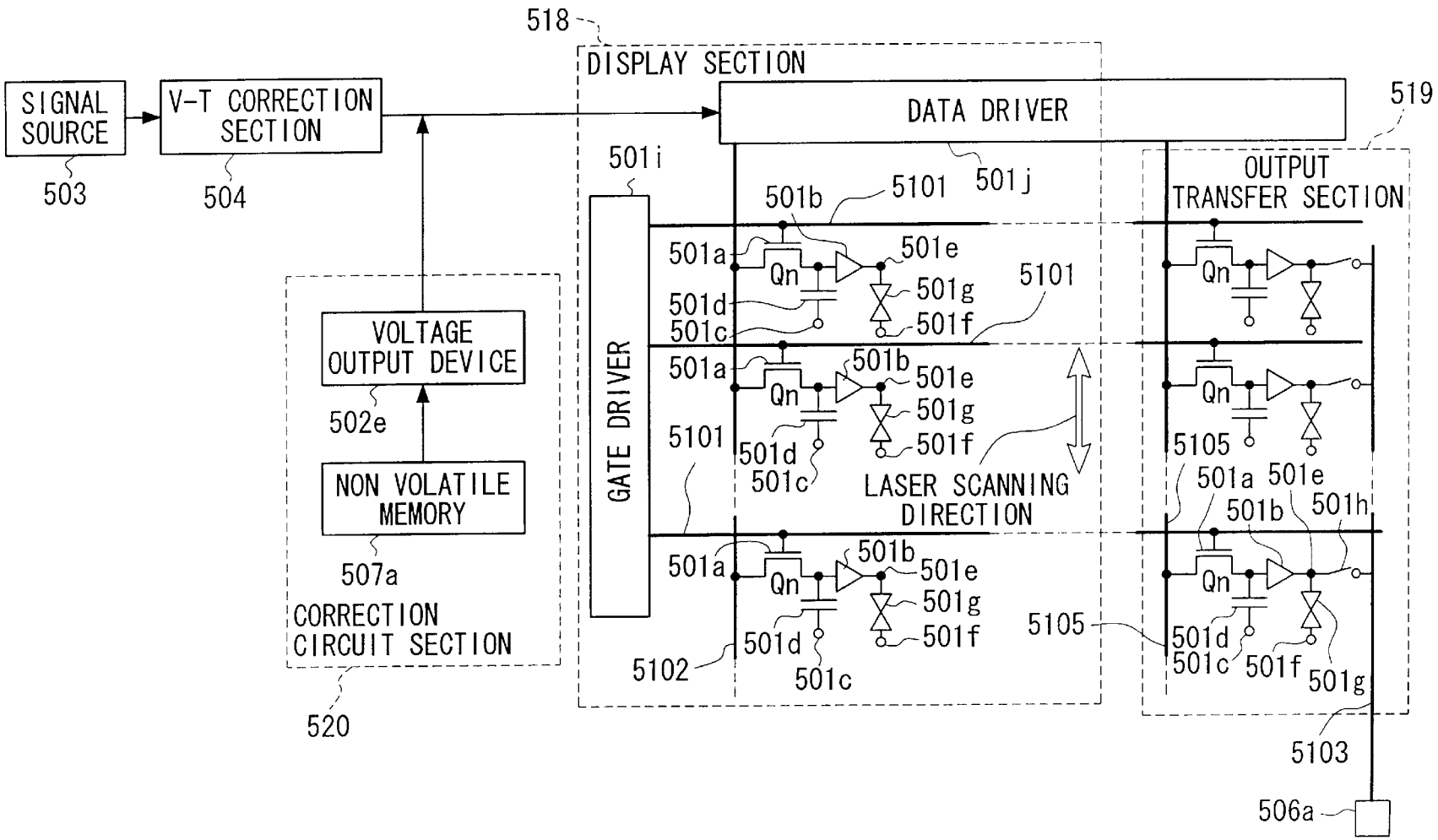
FIG. 44 is a diagram showing a schematic configuration of a liquid crystal display device according to an eighth embodiment of the present invention.

FIG. 44 is a diagram showing a schematic construction of a liquid crystal display device according to an eighth embodiment of the present invention. In FIG. 44, the liquid crystal display device according to the eighth embodiment of the invention comprises; a display section 518, an output transfer section 519, a compensation circuit section 520, a signal source 503, and a V-T compensation section 504.

In the liquid crystal display device according to the eighth embodiment of the invention, the semiconductor layer of the transistor is a thin film semiconductor layer which has been crystallized or recrystallized by laser annealing. The laser scanning direction at that time is parallel to or at an angle substantially the same as the scanning line 5101.

The display section 518 is made up of display pixels each comprising: a MOS type transistor (Qn) 501*a* in the vicinity of respective intersection points of a plurality of scanning lines 5101 which are sequentially driven by a gate driver 501*i*, and a plurality of data lines 5102 for sequentially transferring data signals by means of a data driver 501*j*, with a gate electrode connected to a scanning line 5101 and one of a source electrode and a drain electrode connected to a data line 5102; an analog amplifier circuit 501*b* with an input electrode connected to the other of the source electrode and the drain electrode of the MOS type transistor 501*a*, and an output electrode connected to a pixel electrode 501*e*; a voltage holding capacitor 501*d* formed between the input electrode of the analog amplifier circuit 501*b* and a voltage holding capacitor electrode 501*c*; and a liquid crystal 501*g*, the orientation of which is to be changed, disposed between the pixel electrode 501*e* and an opposing electrode 501*f*.

The output transfer section 519 is made up of amplifier output detection pixels each comprising: a MOS type transistor (Qn) 501*a* with a gate electrode connected to a scanning line 5101 and one of a source electrode and a drain electrode connected to a final stage data line 5105; an analog amplifier circuit 501*b* with an input electrode connected to the other of the source electrode and the drain electrode of the MOS type transistor 501*a*, and an output electrode connected to a pixel electrode 501*e*; a voltage holding capacitor 501*d* formed between the input electrode of the analog amplifier circuit 501*b* and a voltage holding capacitor electrode 501*c*; a liquid crystal 501*g*, the orientation of which is to be changed, disposed between the pixel electrode 501*e* and an opposing electrode 501*f*; and a switch 501*h* with an input electrode connected to an output electrode of the analog amplifier circuit 501*b* and an output electrode connected to an amplifier monitor line 5103 or a data line 5102. These amplifier output detection pixels are provided on the final stage data line 5105 farthest from the gate driver 501*i*. Moreover, the construction involves a terminal electrode 506*a* so that one end of the amplifier monitor line 5103 can be measured by an external measuring device (omitted from the figure).

The compensation circuit section 520 comprises a non volatile memory 507*a*, and a voltage output device 502*e* for applying a voltage corresponding to the storage contents of the non volatile memory 507*a*, to the data data line. The operation of the liquid crystal display device according to the eighth embodiment of the present invention shown in FIG. 44 is the same as the operation of the liquid crystal display device according to the sixth embodiment of the present invention shown in FIG. 42.

The construction of the amplifier output detection pixels in the liquid crystal display device according to the eighth embodiment of the present invention is the same as the construction shown in FIG. 35 and FIG. 37. However, instead of the amplifier monitor line in FIG. 37, the data line which is not used for display may be used. Moreover, in FIG. 44, the amplifier detection bit is connected by one amplifier monitor line (or data line). However the terminal electrode 506*a* may be taken out independently for each of the respective amplifier output detection bits.

Furthermore, with this embodiment, it is noted that the amplifier output detection bits are connected to the last data line 5105 farthest from the gate driver 501*i*. However this is the case where the gate driver is installed on only one side of the screen. In the case where this is installed on both sides of the screen, then this is connected to the data line which is closest to either of the gate drivers. These amplifier output detection bits may be used in the actual image display, or dummy bits which are not used in the actual display may be used. In the case of using dummy bits, any dummy bit may be used, and this is not limited to the description for the data line farthest (closest in the case of both side gate drivers) from the gate driver 501*i*.

Furthermore, with the present embodiment, it was noted that the MOS type transistor 501*a* and the analog amplifier circuit 501*b* were formed from p-Si TFTs. However these may be formed from single crystal silicon transistors, or may be formed from other thin film transistors using laser scanning in the production process. In this case, this is not limited to laser scanning, but the present embodiment is effective in the case where a process is used in which in the manufacture, noticeable deviations can be expected in the data line direction Moreover, with the present embodiment, the gain of the analog amplifier circuit 501*b* is set to 1. However in order to make the pixel voltage different from the input voltage, the voltage amplification may be changed. In addition, with the present embodiment, an n-type MOS transistor is employed for the pixel selection switch. However a p-type MOS transistor may be employed. In this case, for the gate scanning signal, a pulse signal which becomes a low level at the time of selection, and a high level at the time of non selection, is input. Also in the liquid crystal display device according to the eighth embodiment of the present invention, the same effect is obtained as for the liquid crystal display device according the sixth embodiment of the present invention.

Figure 45:
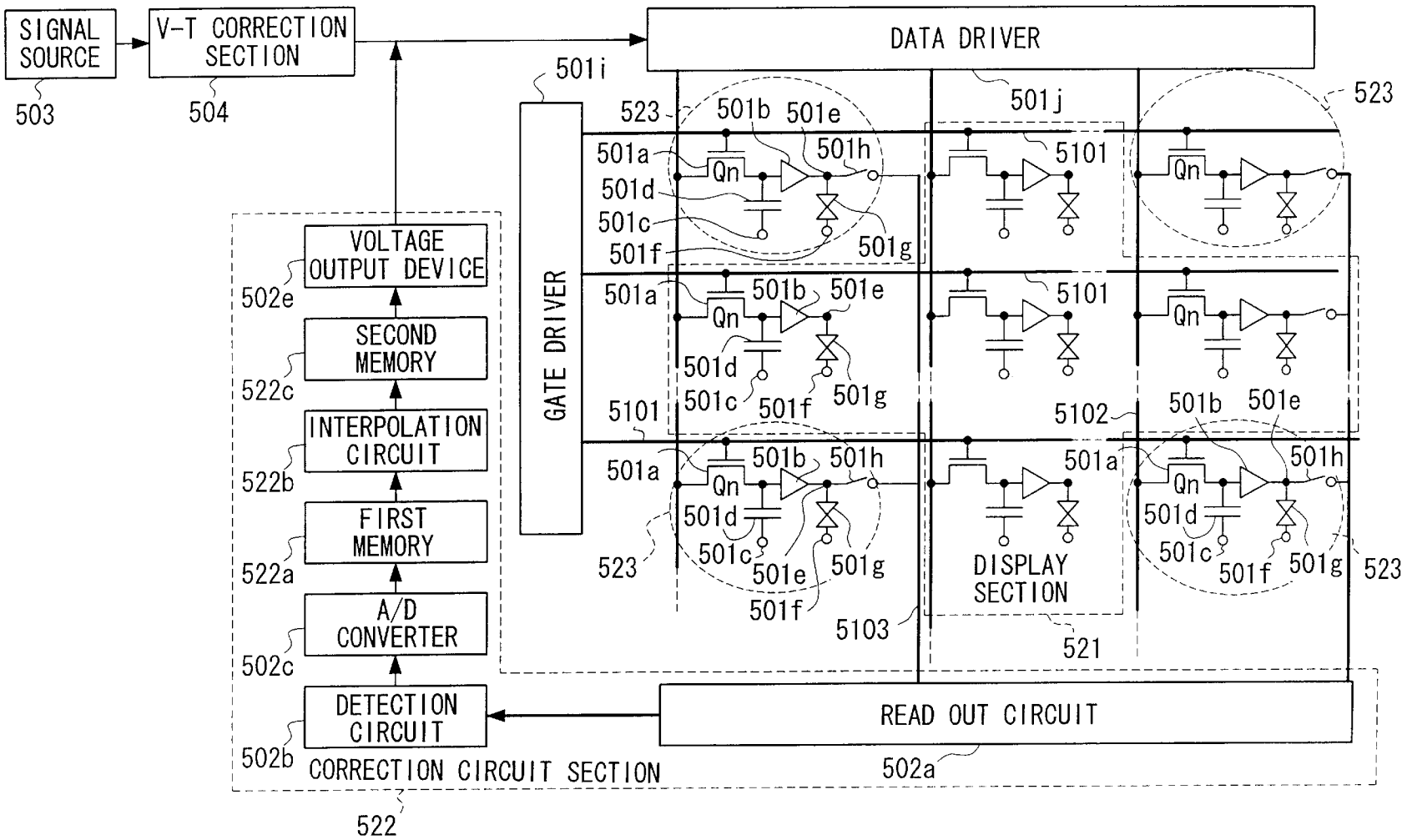
FIG. 45 is a diagram showing a schematic configuration of a liquid crystal display device according to a ninth embodiment of the present invention.

FIG. 45 is a diagram showing a schematic construction of a liquid crystal display device according to a ninth embodiment of the present invention. In FIG. 45, the liquid crystal display device according to the ninth embodiment of the invention comprises; a display section 521, a compensation circuit section 522, amplifier output detection pixels 523, a signal source 503, and a V-T compensation section 504.

The display section 521 is made up of display pixels each comprising: a MOS type transistor (Qn) 501*a* in the vicinity of respective intersection points of a plurality of scanning lines 5101 which are sequentially driven by a gate driver 501*i*, and a plurality of data lines 5102 for sequentially transferring data signals by means of a data driver 501*j*, with a gate electrode connected to a scanning line 5101 and one of a source electrode and a drain electrode connected to a data line 5102; an analog amplifier circuit 501*b* with an input electrode connected to the other of the source electrode and the drain electrode of the MOS type transistor 501*a*, and an output electrode connected to a pixel electrode 501*e*; a voltage holding capacitor 501*d* formed between the input electrode of the analog amplifier circuit 501*b* and a voltage holding capacitor electrode 501*c*; and a liquid crystal 501*g*, the orientation of which is to be changed, disposed between the pixel electrode 501*e* and an opposing electrode 501*f*.

Four amplifier output detection pixels 523 are disposed at the four corners of the display screen, and respectively comprise: a MOS type transistor (Qn) 501*a* with a gate electrode connected to a scanning line 5101 and one of a source electrode and a drain electrode connected to a data line 5102; an analog amplifier circuit 501*b* with an input electrode connected to the other of the source electrode and the drain electrode of the MOS type transistor 501*a*, and an output electrode connected to a pixel electrode 501*e*; a voltage holding capacitor 501*d* formed between the input electrode of the analog amplifier circuit 501*b* and a voltage holding capacitor electrode 501*c*; a liquid crystal 501*g* which is to be switched, disposed between the pixel electrode 501*e* and an opposing electrode 501*f*, and a switch 501*h* with an input electrode connected to an output electrode of the analog amplifier circuit 501*b* and an output electrode connected to an amplifier monitor line 5103 or a data line 5102.

The compensation circuit section 522 comprises: a read out circuit 502*a* connected to the switch 501*h* by the amplifier monitor line 5103 or the data line 5102; a detection circuit 502*b* for detecting a difference between an output from the read out circuit 502*a* and a reference voltage (Vref); an A/D converter 502*c* for AID converting the output from the detection circuit 502*b*; a first memory 522*a* for storing the output from the A/D converter 502*c*; an interpolation circuit 522*b* for computing a compensation voltage for each of the respective pixels from the storage contents of the first memory 522*a*, a second memory 522*c* for storing the output results from the interpolation circuit 522*b*, and a voltage output device 502*e* for applying a voltage corresponding to the storage contents of the second memory 522*c*, to the data signal.

The construction of the amplifier output detection pixels in the liquid crystal display device according to the ninth embodiment of the present invention is the same as the construction shown in FIG. 35 and FIG. 37. However, instead of the switch selection line in FIG. 35, the scanning line which is not used for display may be used. Similarly, instead of the amplifier monitor line in FIG. 37, the data line which is not used for display may be used.

Referring to FIG. 45, a description is given of the operation of the liquid crystal display device according to the ninth embodiment of the present invention. The amplifier output voltage Vout output by the amplifier monitor line 5103 (the data line 5102 is combined with this) is sent to the detection circuit 502*b* by the read out circuit 502*a* by a predetermined sequence.

In the detection circuit 502*b*, the voltage difference of the amplifier output voltage Vout and the reference voltage Vref is taken out, and this difference data is converted to digital data by the A/D converter 502*c*, and stored in the first memory 522*a*. In the interpolation circuit 522*b*, compensation data for all of the bits is computed based on the data for the four points stored in the first memory 522*a*.

Figure 46:
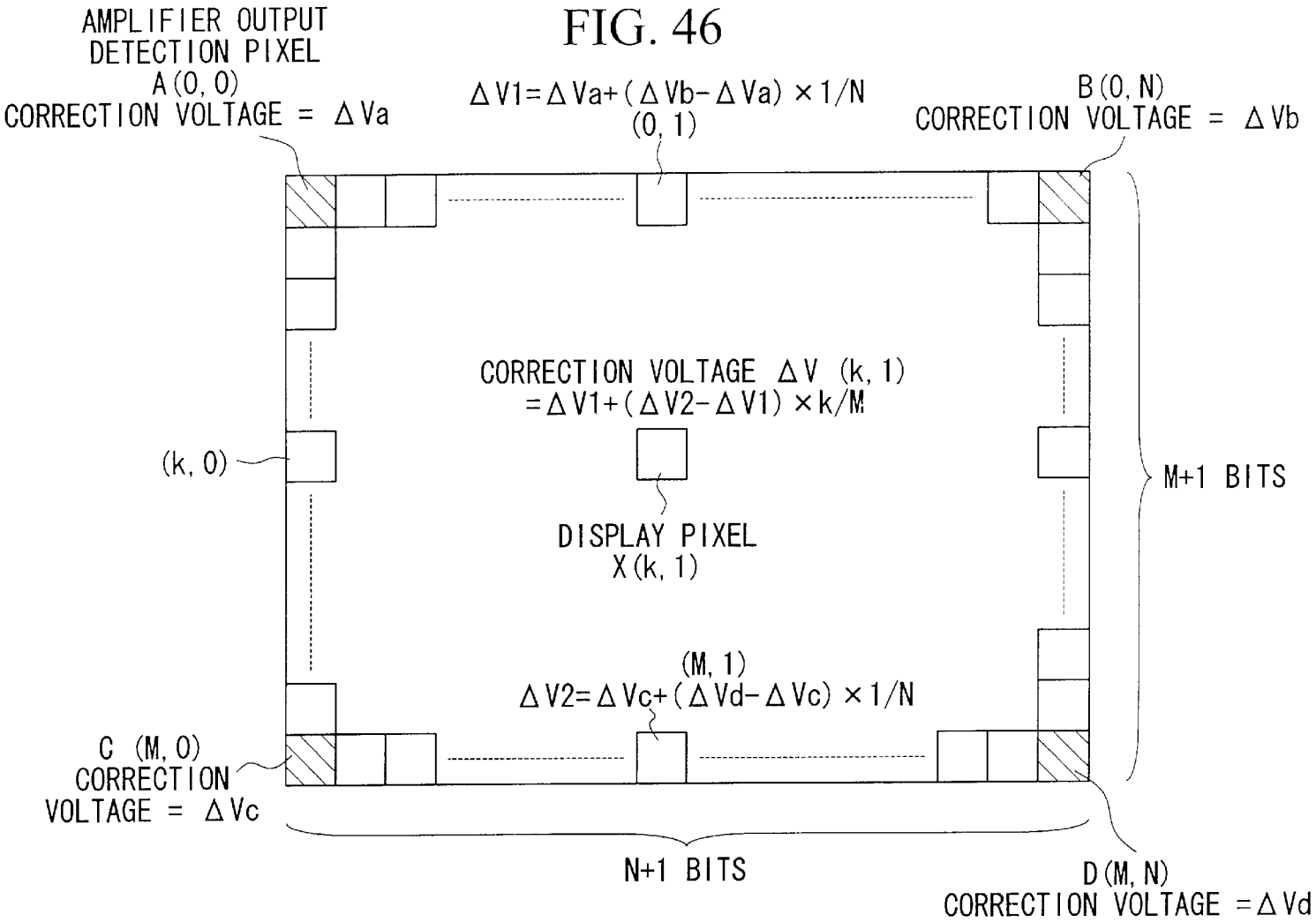
FIG. 46 is a concept diagram showing an interpolation method for an interpolation circuit of FIG. 45.

FIG. 46 is a concept diagram showing an interpolation method by the interpolation circuit 522*b* of FIG. 45. Referring to FIG. 46, a description is given hereunder of the interpolation method by the interpolation circuit 522*b*. Here, the amplifier output detection pixels at the four corners are designated as A, B, C and D, and the amplifier output compensation voltages of these are designated as ΔVa, ΔVb, ΔVc and ΔVd. Furthermore, the number of bits between A-B including A and B is N+1, and the number of bits between A-C including A and C is M+1. At this time, the bit compensation voltages in the (k rows, l column) counting from A where A is made (0,0) are represented by the following equations.

$$\Delta V1+(\Delta V2-\Delta V1)+k/M \quad (3)$$

$$\Delta V1=\Delta Va+(\Delta Vb-\Delta Va)\times 1/N \quad (4)$$

$$\Delta V2=\Delta Vc+(\Delta Vd-\Delta Vc)\times 1/N \quad (5)$$

The compensation data for all of the bits calculated in this way is stored in the second memory 522*c*. When displaying images, at the same time that the image data signal is transferred, the difference data is sent from the second memory 522*c* to the voltage output device 502*e*, and the compensation voltage corresponding to this is added to the image data signal by the voltage output device 502*e*. In FIG. 45, as another compensation for the image data signal, V-T compensation was explained. However normally in addition to this, processing such as polarity inversion, or phase expansion is performed.

Figure 47:
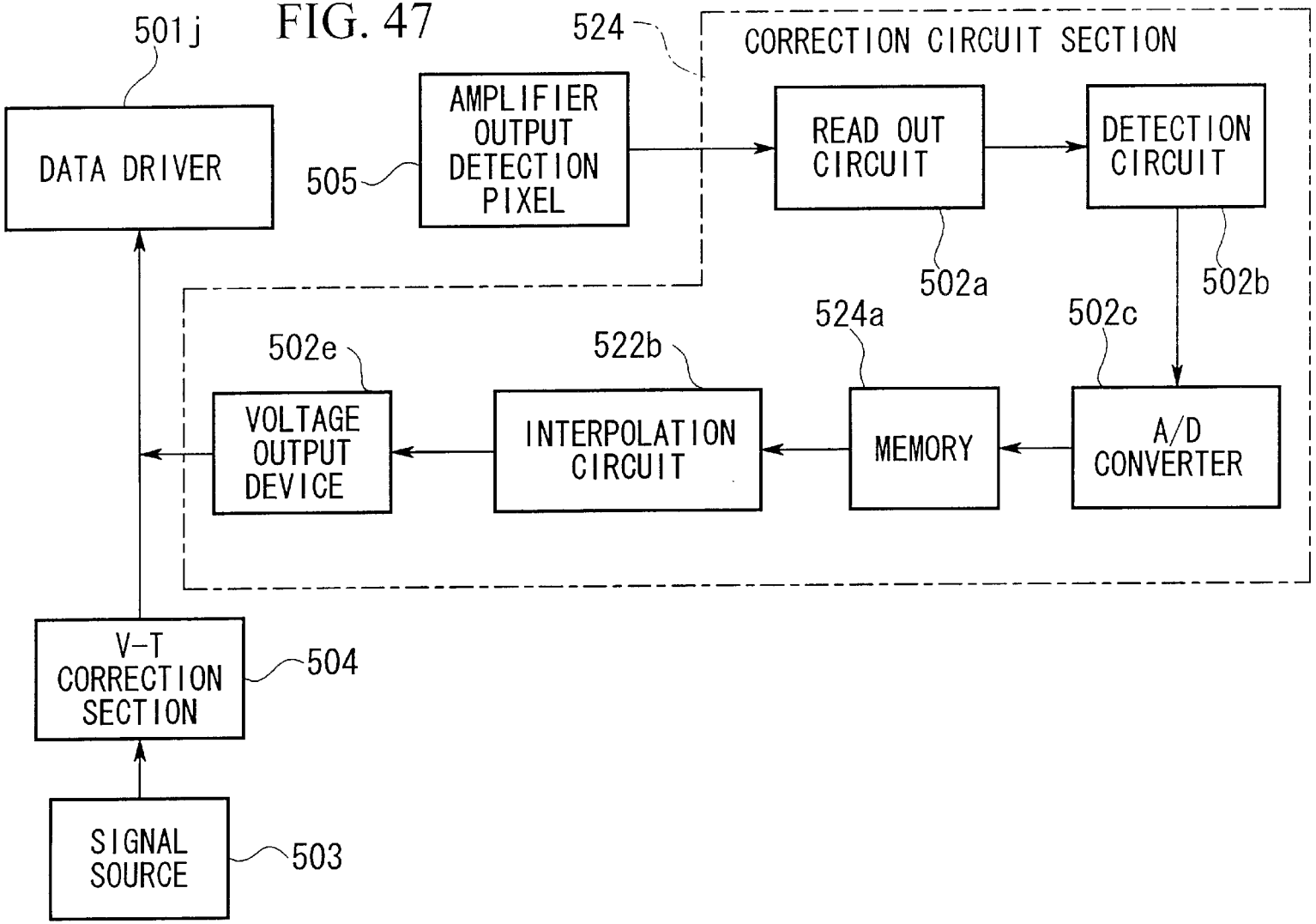
FIG. 47 is a block diagram showing another configuration example of a compensation circuit section of a liquid crystal display device according to the ninth embodiment of the present invention.

FIG. 47 is a block diagram showing another configuration example of a compensation circuit section of the liquid crystal display device according to the ninth embodiment of the present invention. In FIG. 47, in a compensation circuit section 524, an amplifier output voltage Vout sent from the amplifier output detection pixels 523 via the read out circuit 502*a* to the detection circuit 502*b* is converted to a difference with respect to the reference voltage Vref, and is further converted to digital data by the A/D converter 502*c* and stored in a memory 524*a*.

When displaying images, at the same time that the image data signal is transferred, compensation data is sent from the memory 524*a* to the interpolation circuit 522*b*, and interpolation processing is performed by the interpolation circuit 522*b*. The results are sent to the voltage output device 502*e*, and by means of the voltage output device 502*e*, the compensation voltages corresponding to these are added to the image data signals.

With the construction of the compensation circuit section 524 shown in FIG. 47, the memory 524*a* can be made to a small scale compared to the compensation circuit section 522. However, the interpolation processing of the image data must be performed in real time.

With the present embodiment, it is noted that the amplifier output detection bits are disposed at the four corners of the display screen. With this it is desirable to use dummy bits which are not used for display, however these may be bits used for display. Furthermore, in FIG. 45 with the amplifier monitor line, the same line is used for the amplifier output detection bits connected to the same data line. However the amplifier monitor line may be connected to the read out circuit 502*a* independently for each of the respective amplifier output detection bits.

Moreover, with the present embodiment, it was noted that the MOS type transistor 501*a* and the analog amplifier circuit 501*b* were respectively formed from p-Si TFTs. However these may be formed from other thin film transistors such as a-Si TFTs or cadmium-selenium thin film transistors. In this case, with the present embodiment, the gain of the analog amplifier circuit 501*b* is set to 1. However in order to make the pixel voltage different from the input voltage, the voltage amplification may be changed.

Furthermore, with the present embodiment, an n-type MOS transistor is employed for the pixel selection switch. However a p-type MOS transistor may be employed. In this case, for the gate scanning signal, a pulse signal which becomes a low level at the time of selection, and a high level at the time of non selection, is input. In the present embodiment, the output from the amplifier output detection pixels 523 can also be connected directly to the detection circuit 502*b* without using the read out circuit 502*a*.

With the present embodiment, it is noted that the amplifier output detection bits are disposed at the four corners (A, B, C, D) of the display screen. However amplifier output detection bits may be further provided at the four sides A-B-C-D, and ultimately all of the bits of a certain row and column can be used for amplifier output detection.

The interpolation processing in this case is performed the same as for the case of the interpolation method shown in FIG. 46, using the four points of the amplifier output detection bits closest to the bit performing the interpolation. As a result, the interpolation accuracy can be improved.

Also in the liquid crystal display device according to the ninth embodiment of the present invention, the same affect as for the liquid crystal display device according to the third embodiment of the invention is obtained. In addition, since the amplifier output detection bits are only present at the four corners, the amplifier output can be corrected without reducing the pixel aperture ratio. However, for the interpolation process, it is necessary to provide a special circuit. Furthermore, since interpolation processing is used in obtaining the compensation voltage, then compared to the liquid crystal display device according to the seventh embodiment of the invention, the compensation voltage is lacking in accuracy.

Figure 48:
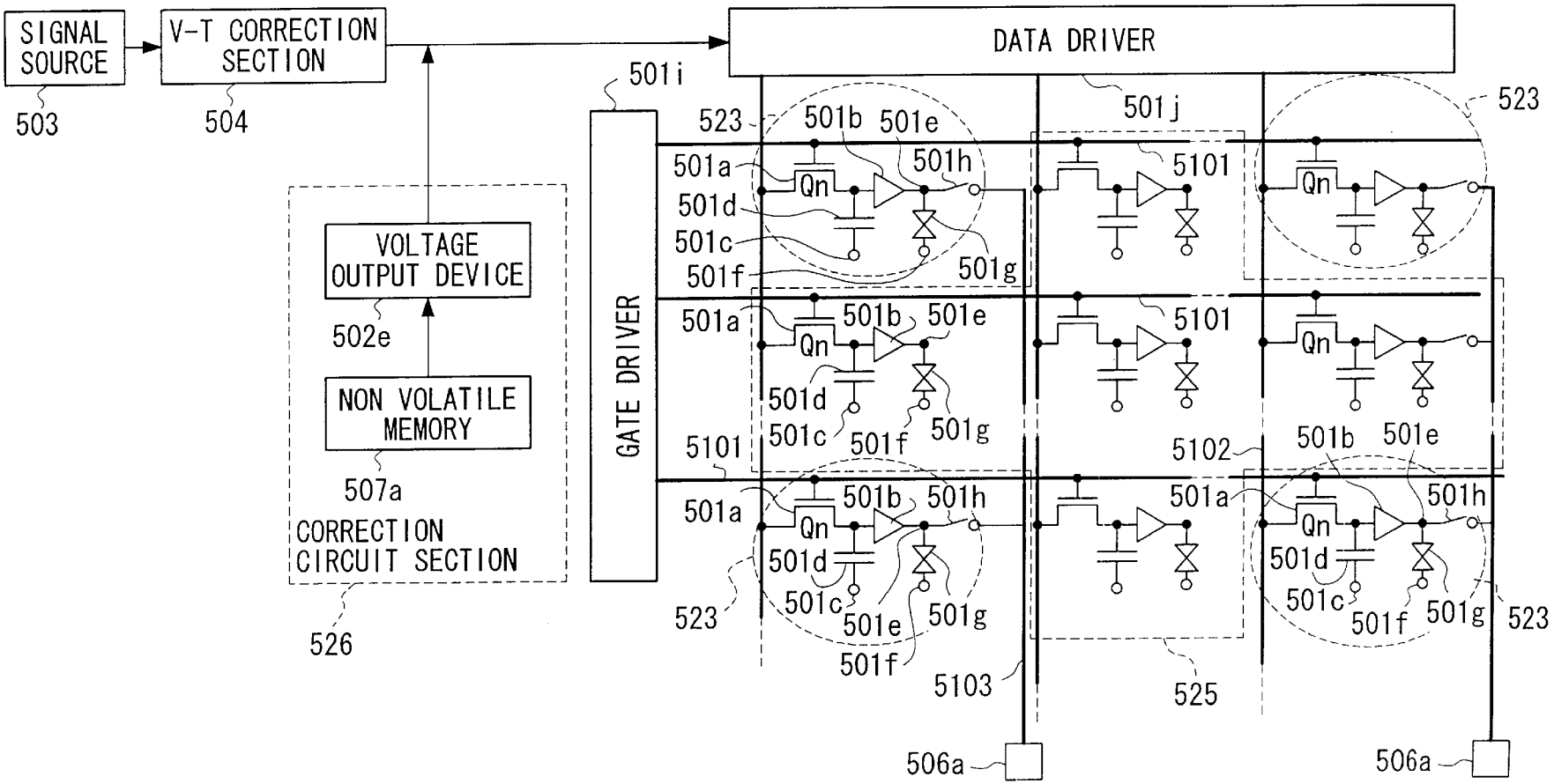
FIG. 48 is a diagram showing a schematic configuration of a liquid crystal display device according to a tenth embodiment of the present invention.

FIG. 48 is a diagram showing a schematic construction of a liquid crystal display device according to a tenth embodiment of the present invention. In FIG. 48, the liquid crystal display device according to the tenth embodiment of the invention comprises; a display section 525, a compensation circuit section 526, an amplifier output detection pixel 523, a signal source 503, and a V-T compensation section 504.

The display section 525 is made up of display pixels each comprising: a MOS type transistor (Qn) 501*a* in the vicinity of respective intersection points of a plurality of scanning lines 5101 which are sequentially driven by a gate driver 501*i*, and a plurality of data lines 5102 for sequentially transferring data signals by means of a data driver 501*j*, with a gate electrode connected to a scanning line 5101 and one of a source electrode and a drain electrode connected to a data line 5102; an analog amplifier circuit 501*b* with an input electrode connected to the other of the source electrode and the drain electrode of the MOS type transistor 501*a*, and an output electrode connected to a pixel electrode 501*e*; a voltage holding capacitor 501*d* formed between the input electrode of the analog amplifier circuit 501*b* and a voltage holding capacitor electrode 501*c*; and a liquid crystal 501*g*, the orientation of which is to be changed, disposed between the pixel electrode 501*e* and an opposing electrode 501*f*.

Four amplifier output detection pixels 523 are disposed at the four comers of the pixel, and respectively comprise: a MOS type transistor (Qn) 501*a* with a gate electrode connected to a scanning line 5101 and one of a source electrode and a drain electrode connected to a data line 5102; an analog amplifier circuit 501*b* with an input electrode connected to the other of the source electrode and the drain electrode of the MOS type transistor 501*a*, and an output electrode connected to a pixel electrode 501*e*; a voltage holding capacitor 501*d* formed between the input electrode of the analog amplifier circuit 501*b* and a voltage holding capacitor electrode 501*c*; a liquid crystal 501*g*, the orientation of which is to be changed, disposed between the pixel electrode 501*e* and an opposing electrode 501*f*; and a switch 501*h* with an input electrode connected to an output electrode of the analog amplifier circuit 501*b* and an output electrode connected to an amplifier monitor line 5103 or a data line 5102.

Moreover, there is a terminal electrode 506*a* so that one end of the amplifier monitor line 5103 can be measured by an external measuring device (omitted from the figure). The compensation circuit section 526 comprises a non volatile memory 507*a*, and a voltage output device 502*e* for applying a voltage corresponding to the storage contents of the non volatile memory 507*a*, to the data data line.

The construction of the amplifier output detection pixels in the liquid crystal display device according to the tenth embodiment of the present invention is the same as the construction shown in FIG. 35 and FIG. 37. However, instead of the switch selection line in FIG. 35, the scanning line which is not used for display may be used. Similarly, instead of the amplifier monitor line in FIG. 37, the data line which is not used for display may be used.

Figure 49:
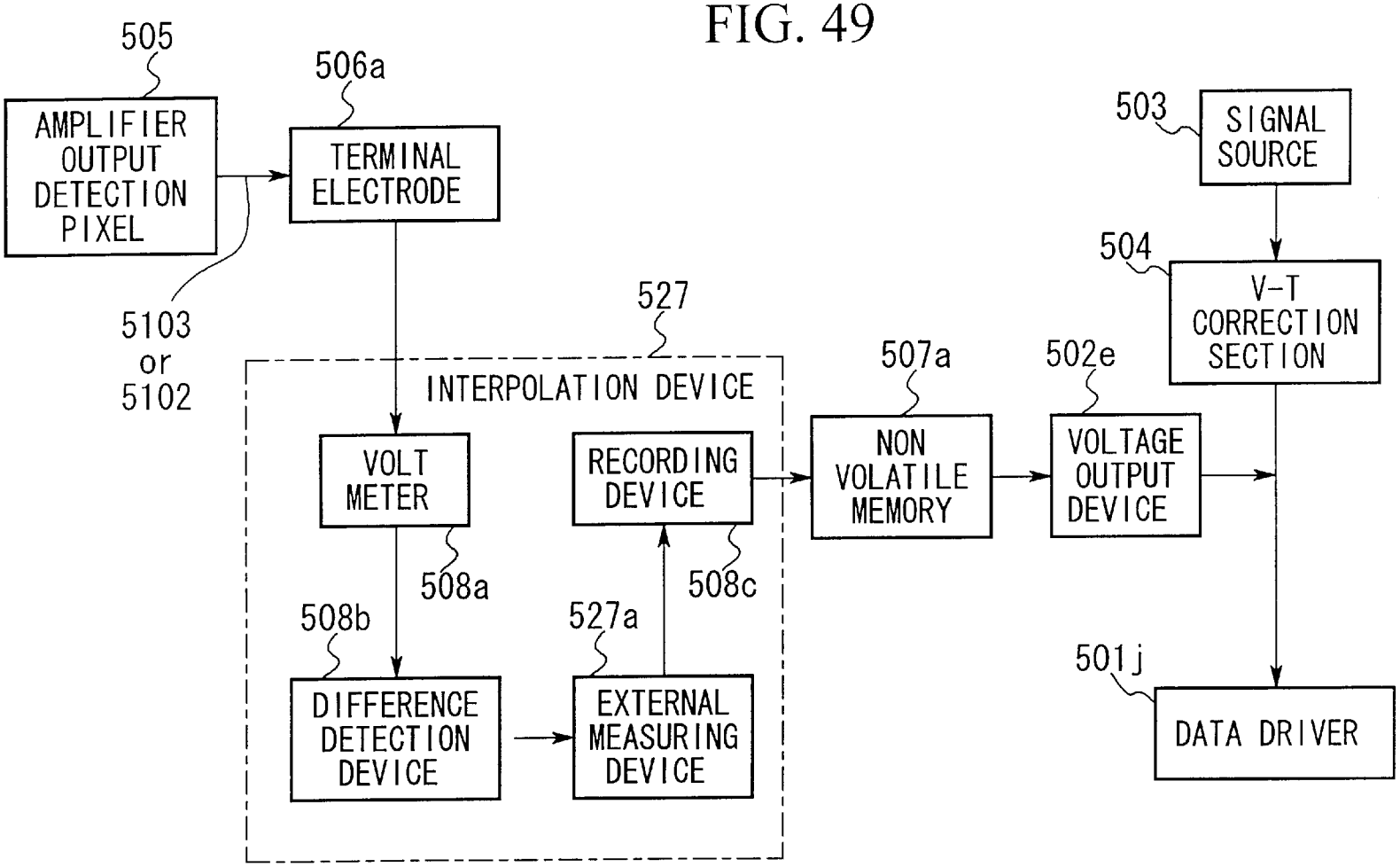
FIG. 49 is a block diagram for explaining the operation of the liquid crystal display device according to the tenth embodiment of the present invention.
Figure 50:
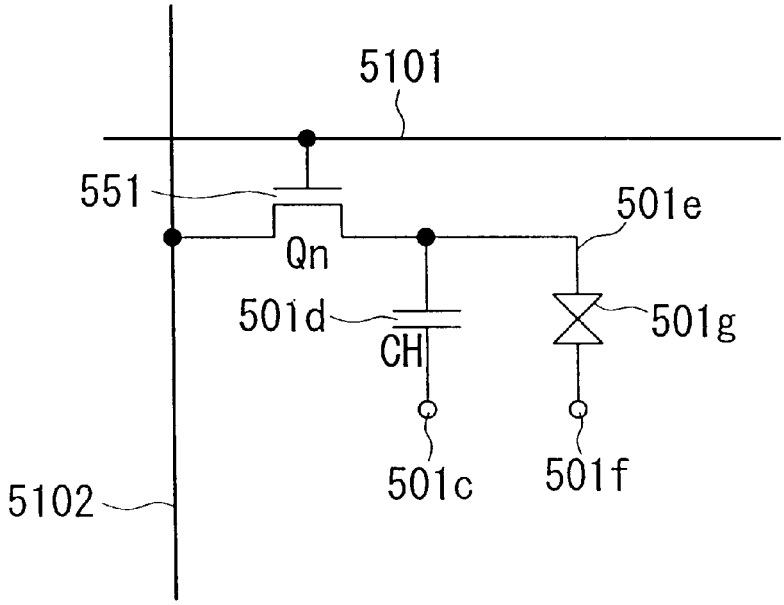
FIG. 50 PRIOR ART
FIG. 50 is a diagram showing a configuration of a liquid crystal display device according to a conventional example.
Figure 51:
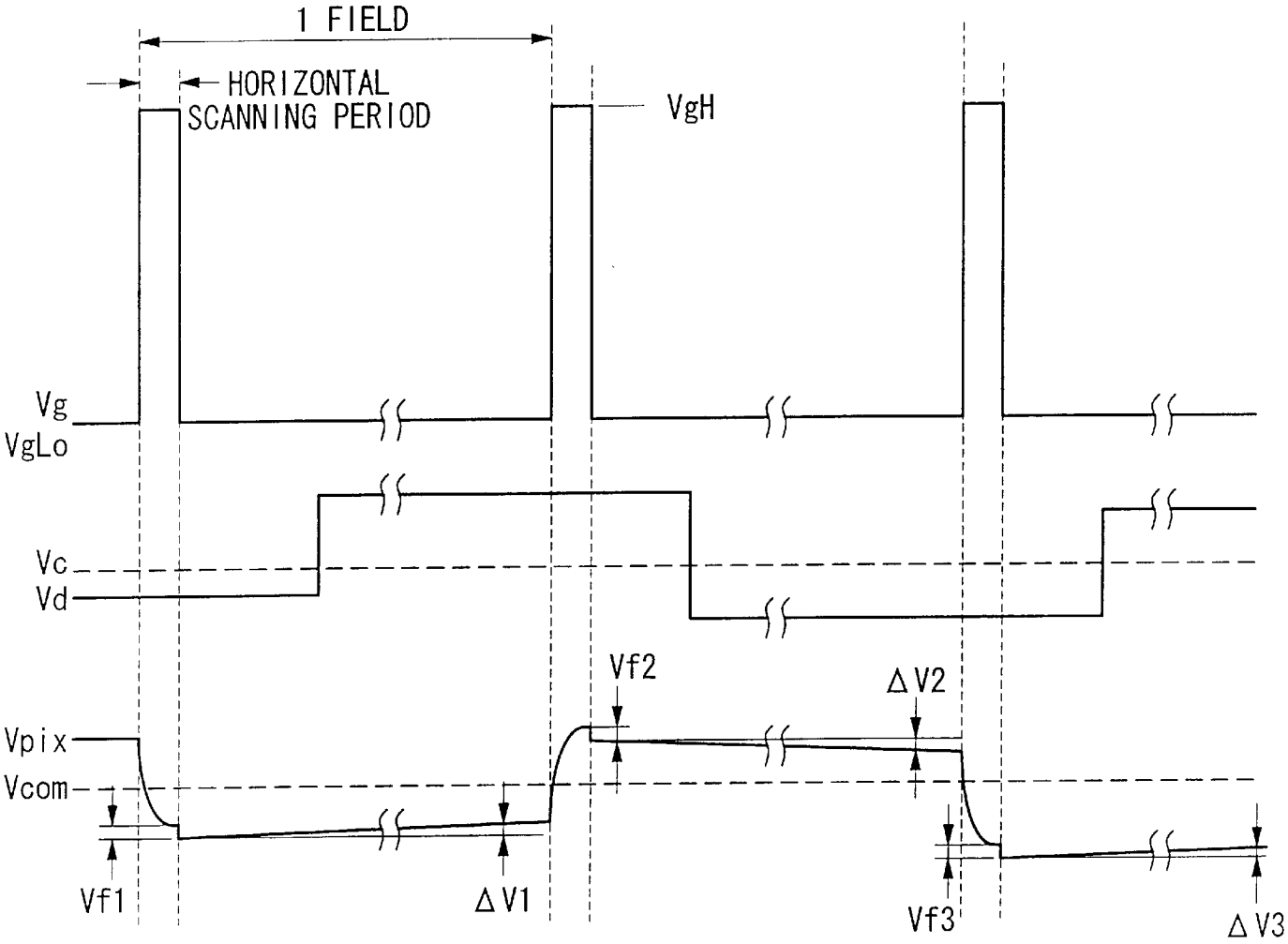
FIG. 51 PRIOR ART
FIG. 51 is a diagram showing a drive method of a liquid crystal display device according to a conventional example.

FIG. 49 is a diagram for explaining the operation of a mode of the liquid crystal display device according to the tenth embodiment of the present invention. FIG. 49 shows the procedures for amplifier output compensation in the liquid crystal display device according to the tenth embodiment of the present invention.

The amplifier output voltage Vout is output to the terminal electrode 506*a* by the amplifier monitor line 5103 or the data line 5102. An external measuring device 527 comprises; a volt meter 508*a* for reading out the voltage Vout of the terminal electrode 506*a*, a difference detection device 508*b* for detecting a difference voltage between the amplifier output voltage Vout and the reference voltage Vref, an interpolation device 527*a* for interpolating difference data and calculating compensation voltages for all of the bits, and a recording device 508*c* for recording the compensation voltages for all of the bits, in the non volatile memory 507*a*.

The interpolation processing performed by the interpolation device 527*a* involves the same as the interpolation method shown in FIG. 46. In this way, the amplifier output characteristics for each pixel are recorded in the non volatile memory 507*a*. When displaying images, at the same time that the image data signal is transferred, the difference data is sent from the non volatile memory 507*a* to the voltage output device 502*e*, and the compensation voltage corresponding to this is added to the image data signal by the voltage output device 502*e*.

With the present embodiment, it is noted that the amplifier output detection bits are disposed at the four corners of the display screen. With this it is desirable to use dummy bits which are not used for display, however these may be display.

Moreover, with the present embodiment, it was noted that the MOS type transistor 501*a* and the analog amplifier circuit 501*b* were respectively formed from p-Si TFTs. However these may be formed from other thin film transistors such as a-Si TFTs or cadmium-selenium thin film transistors. In this case, with the present embodiment, the gain of the analog amplifier circuit 501*b* is set to 1. However in order to make the pixel voltage different from the input voltage, the voltage amplification may be changed.

Furthermore, in FIG. 48 with the amplifier monitor line, the same line is used for the amplifier output detection bit connected to the same data line. However the amplifier monitor line may be taken out independently for each of the respective amplifier output detection bits, and the end thereof made the terminal electrode 506*a*.

Furthermore, with the present embodiment, an n-type MOS transistor is employed for the pixel selection switch. However a p-type MOS transistor may be employed. In this case, for the gate scanning signal, a pulse signal which becomes a low level at the time of selection, and a high level at the time of non selection, is input.

In the present embodiment, it is noted that the amplifier output detection bits are disposed at the four corners (A, B, C, D) of the display screen. However amplifier output detection bits may be further provided at the four sides A-B-C-D, and ultimately all of the bits of a certain row and column can be used for amplifier output detection. The interpolation processing in this case is performed the same as for the interpolation method shown in FIG. 46, using the four points of the amplifier output detection bits closest to the bit performing the interpolation. As a result, the interpolation accuracy can be improved.

Also in the liquid crystal display device according to the tenth embodiment of the present invention, the same affect as for the liquid crystal display device according to the ninth embodiment of the invention is obtained. In addition, since circuits such as the detection circuit 502*b*, the A/D converter 502*c*, and the interpolation circuit 522*b* become unnecessary, this has the effect that the circuit construction is simplified.

In this way, in the liquid crystal display devices according to the third through tenth embodiments of the present invention, the data stored in the memories 502*d*, 524*a*, in the non volatile memory 507*a*, in the first memory 522*a*, and in the second memory 522*c* may be the difference voltage between the amplifier output voltage Vout and the reference voltage Vref, and this may be the voltage which is converted to the compensation voltage.

Furthermore, if the liquid crystal display devices according to the third through tenth embodiments of the present invention are voltage drive types, then these are not limited to liquid crystal elements but may be applied to other display elements.

In the above manner, with the liquid crystal display device according to the third through tenth embodiments of the invention, a decrease in the flickering or contrast of the TN liquid crystal can be prevented, and also liquid crystals such as high polymer liquid crystals with a small resistivity, or ferroelectric or antiferroelectric liquid crystal materials having polarization may be used for the display material. This is because the voltage fluctuations can be suppressed by the analog amplifier circuit 501*b* attached to the pixels.

Furthermore, with the liquid crystal display device according to the third through tenth embodiments of the invention, the display unevenness between pixels to which the analog amplifier circuit 501*b* is attached can be reduced. This is because by providing the amplifier output detection device and the compensation device for the reference voltage, compensation of the amplifier outlet can be accurately performed over the whole screen.

Next is a description of an eleventh embodiment of the present invention. At first the liquid crystal display device according to the eleventh embodiment will be fundamentally explained. FIG. 74 is a diagram showing the configuration of a liquid crystal display device having a pixel structure where one of the power supply lines of the analog amplifier circuit is connected to a gate scanning line, while FIG. 73 is a diagram showing an equivalent circuit with the one scanning line of FIG. 74 as a current source.

Figure 73:
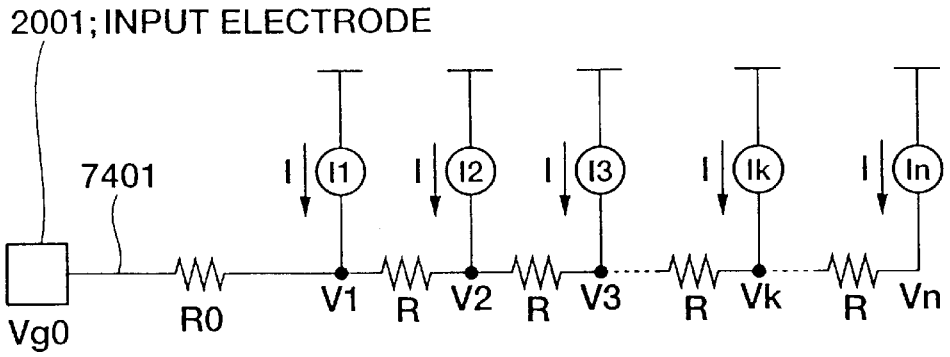
FIG. 73 is a configuration diagram showing an equivalent circuit which uses a current source, for theoretically explaining the liquid crystal display devices in the eleventh through thirteenth embodiments.
Figure 74:
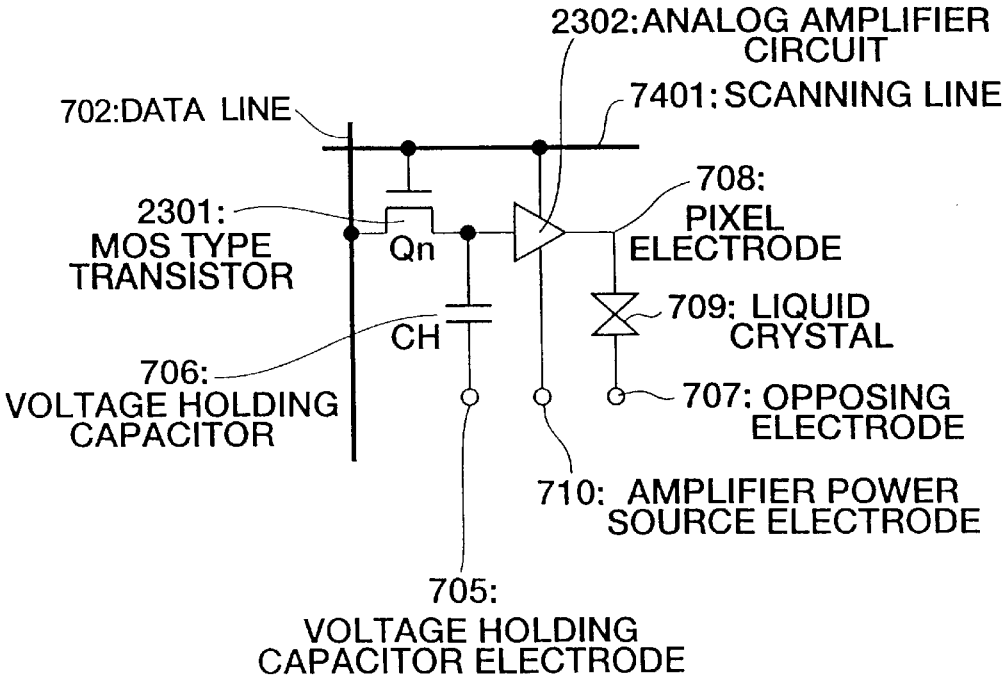
FIG. 74 PRIOR ART
FIG. 74 is a configuration diagram of a conventional liquid crystal display device with an analog amplifier added thereto.

In FIG. 73, the current supplied to the gate scanning line is replaced by current sources (I1, I2, I3 . . . . . In). The resistance per bit pitch of the scanning line 7401 is R, the total number of bits is n, the voltage input to the input electrode 2001 is Vg0 (corresponding to the gate driver power source voltage. In the case where the switching driver is an n-type MOS, this becomes the low level side power source voltage, while in the case of a p-type MOS, this becomes the high level side power source voltage), the voltage at the connection point Xk between the k th current source Ik from the input electrode 2001 side and the scanning line 7401 is Vk (corresponding the gate scanning voltage in the k th bit), and the resistance between the input electrode 2001 and the first current input contact point X1 is R0.

Here, even if it is assumed that the currents supplied from the current sources are all constant values I, the essence of the phenomena does not change. In this case, the gate scanning line voltage Vk in the k th bit is represented by the following equation (6).

$$Vk=-(I\times R\times k^2)/2+[I\times R\times(n-0.5)\times k]+(I\times R\times n)+(I\times R0\times n)+Vg0 \quad (6)$$

In the case where the switching driver is an n-type MOS, I>0, and hence the scanning line voltage Vk is continuously increased with respect to the increase in the bit number k until the total bit number n. In the case of a p-type MOS, I<0, and hence conversely this is continuously reduced. When k=n, equation (6) becomes the following equation (7).

$$Vn=[I\times R\times(n+1)/2]+(I\times R0\times n)+Vg0 \quad (7)$$

In FIG. 74, the case where a switching transistor (Qn) 2301 is an n-type MOS is considered. In performing normal switching operation with this circuit, then between the low level VgL of the gate scanning voltage, the low level VdL of the data data line, and the threshold value Vt of the transistor 2301, at least the following equation (8) must be satisfied.

$$VgL-VdL<Vt \quad (8)$$

Here as mentioned before VgL<Vn, and hence in the case where VgL=Vn, then if equation (8) is satisfied, then equation (8) is satisfied for all of the bits. Vn from equation (7) is continuously increased corresponding to the resistance R per bit pitch of the gate scanning line, and hence this is effective in lowering the resistance of the gate scanning line. Furthermore, there is also the effect that Vg0 is reduced.

In the case where the switching transistor 2301 is a p-type MOS, then for a normal switching operation with a high level VgH for the gate scanning voltage and a high level VdH for the data signal voltage, at least the following equation (9) must be satisfied.

$$Vt<VgH-VdH \quad (9)$$

Here since Vn<VgH, then in the case where VgH=Vn, it is sufficient if equation (9) is satisfied. It can be seen from equation (7) that reducing the wiring resistance and increasing Vg0 is effective.

With this embodiment, a part or all of the constituent material of the gate scanning line uses metal or a metal silicide with a low resistance value. Therefore, the fluctuation amount of the gate scanning voltage at the time of non selection is reduced, enabling normal switching operation to be performed.

Furthermore, in the case where the switching transistor is an n-type MOS, since a negative power source is used for the low level side power source of the gate driver, the maximum value of the low level of the gate scanning voltage is reduced, enabling an even more accurate switching operation to be performed.

Furthermore, in the case where the switching transistor is a p-type MOS, the high level power source voltage of the gate driver, is shifted to the high output side in anticipation of a voltage drop of the gate scanning voltage. Therefore the minimum value of the high level of the gate scanning voltage is increased and again an accurate switching operation can be performed.

Next is a detailed description with reference to the drawings, of the liquid crystal display device according to the eleventh through thirteenth embodiments of the present invention.

Figure 54:
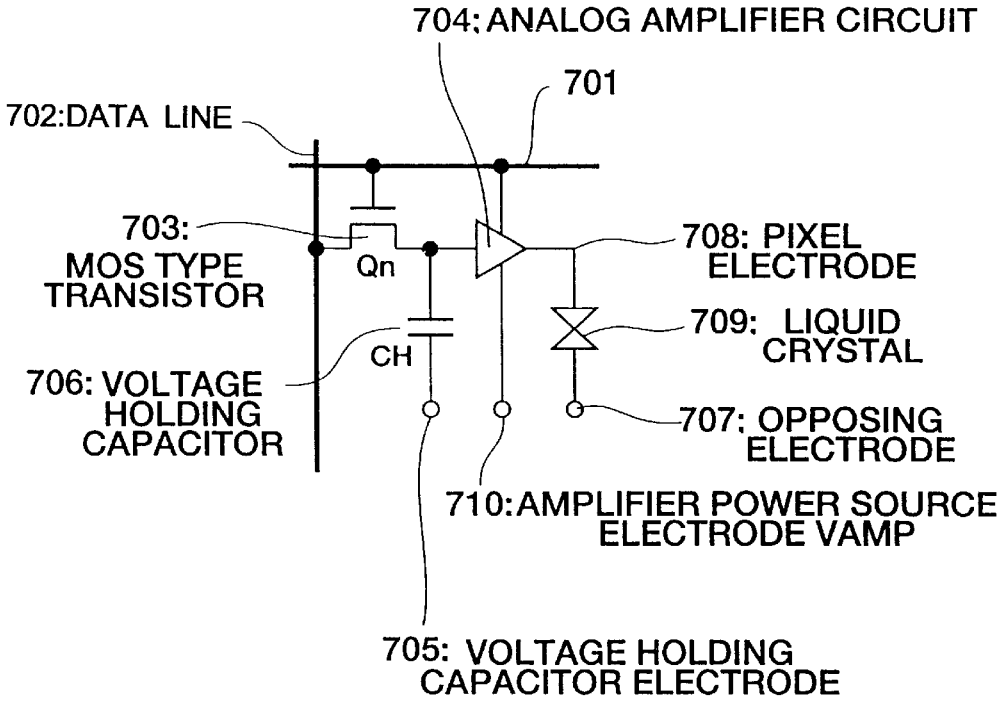
FIG. 54 is a configuration diagram showing an eleventh embodiment of a liquid crystal display device according to the present invention.

FIG. 54 shows a configuration of a liquid crystal display device according to the eleventh embodiment of the invention.

As shown in the figure, the liquid crystal display device of this embodiment comprises: a MOS type transistor (Qn) 703 with a gate electrode connected to a scanning line 701 formed from a material containing at least a metal or a metal silicide, and one of a source electrode and a drain electrode connected to a data line 702; an analog amplifier circuit 704 with an input electrode connected to the other of the source electrode and the drain electrode of the transistor (Qn) 703, and an output electrode connected to a pixel electrode 708, and one of a positive and negative power source line connected to the scanning line 701 and the other of the power source line connected to an amplifier power source electrode Vamp 710; a voltage holding capacitor 706 formed between an input electrode of the analog amplifier circuit 704 and the voltage holding capacitor electrode 705; and a liquid crystal 709, the orientation of which is to be changed, disposed between the pixel electrode 708 and an opposing electrode 707.

Here the MOS type transistor (Qn) 703 and the analog amplifier circuit 704 are constituted by p-Si TFTs. Furthermore, the gain of the analog amplifier circuit 704 is set to 1.

Figure 55:
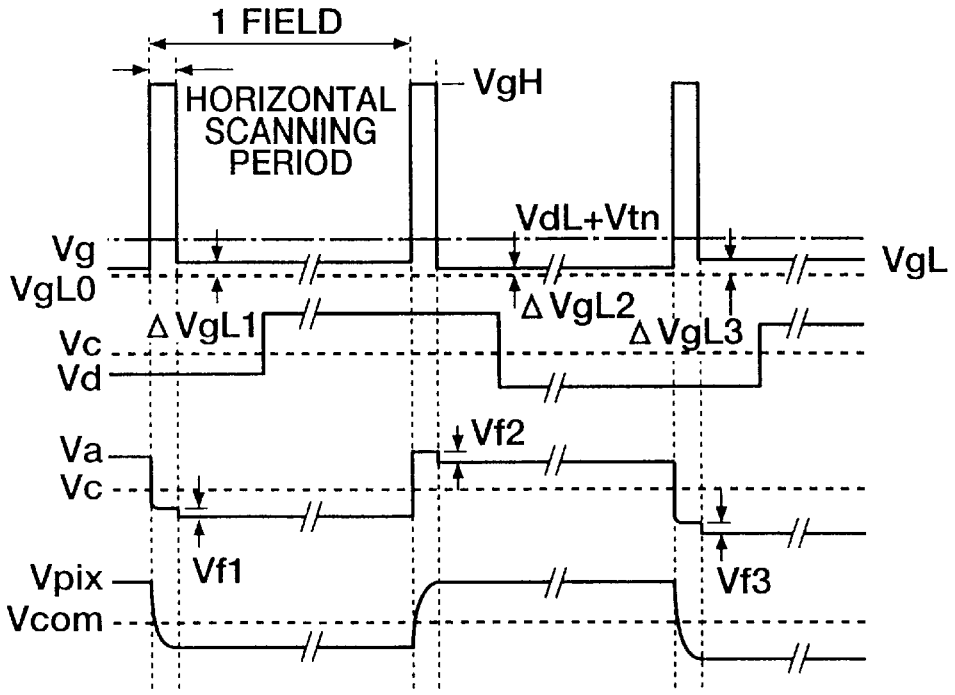
FIG. 55 is a timing chart showing a drive method for the liquid crystal display device of the eleventh embodiment.

As follows is a description of the drive method for the liquid crystal display device using this pixel construction, with reference to FIG. 55. FIG. 55 shows the timing chart for the gate scanning voltage Vg, a data signal voltage Vd, an amplifier output voltage Va and a pixel voltage Vpix, for the case where a liquid crystal is driven by the pixel construction shown in FIG. 54. The negative power source voltage of the gate driver is VgL0, and the low level voltage of the gate scanning voltage is VgL.

As shown in FIG. 55, due to the gate scanning voltage Vg in the horizontal scanning period becoming a high level VgH, the transistor (Qn) 703 comes on and the data signal Vd input to the data line is transferred to the input electrode of the analog amplifier circuit 704 via the transistor 703. When the horizontal scanning period is completed, and a low level voltage VgL0 is output from the gate driver to the scanning line 701, the transistor (Qn) 703 goes off, and the data signal transferred to the input electrode of the analog amplifier circuit is held by the voltage holding capacitor 706.

At this time, with the amplifier input voltage Va, at the time when the transistor (Qn) goes off, a voltage shift referred to a feed-through voltage occurs via the capacitance between the gate and source of the transistor (Qn). In FIG. 55, this is shown by Vf1, Vf2 and Vf3.

The amplifier input voltage Va is held until the gate scanning voltage Vg again becomes a high level in the subsequent field period and the transistor (Qn) 703 is selected. The analog amplifier circuit 704, during the period in the subsequent field up until the amplifier input voltage changes, can output an analog gray scale voltage corresponding to the held amplifier input voltage Va. During this holding period, a current is continually input to the scanning line 701 from the positive power source line of the analog amplifier circuit via the negative power source line, so that the low level voltage VgL of the gate scanning voltage Vg is shifted. In FIG. 55, this is shown as Δ VgL1, ΔVgL2 and ΔVgL3.

As a result, VgL, with ΔVgL positive becomes:

$$VgL=VgL0+\Delta VgL \text{ (1 or 2 or 3)} \quad (10)$$

Here ΔVgL differs for each pixel even though on the same scanning line. Moreover, in the same pixel, this changes with the value of the data signal voltage Vd. In the eleventh embodiment of the present invention, the wiring resistance of the scanning lines which use a low resistant metal or metal silicide for the material thereof is reduced. Hence, the absolute value of ΔVgL is small, and the maximum value of VgL is small. Therefore the relationship:

$$VgL-VdL<Vt \quad (8)$$

being the necessary condition for normal switching, is satisfied.

Next is a description of the effect of the liquid crystal display device according to the eleventh embodiment of the present invention.

With the liquid crystal display device in this embodiment, current is continuously input to the scanning line 701 from the positive power source line of the analog amplifier circuit 704 via the negative power source line. Therefore, the low level of the gate scanning voltage Vg is raised. However this increased amount is increased in accordance with the scanning line resistance. With respect to this, as with this embodiment, by forming these from a material containing a metal or a metal silicide, a low resistance of the scanning line results. Hence the low level voltage fluctuations of the scanning voltage Vg can be kept small, so that defective operation of the switching MOS type transistor 703 can be prevented.

As a result, also after completion of the horizontal scanning period, the pixel electrode 708 is driven by the analog amplifier circuit 704. Hence the fluctuations in the pixel voltage Vpix accompanying the response of the liquid crystal as discussed for the conventional technology, can be eliminated. Therefore, it is also possible to use liquid crystal materials in which voltage fluctuations occur during the holding period as with the conventional technology, such as a polymer liquid crystal, a ferroelectric liquid crystal or antiferroelectric liquid crystal having polarization, or an OCB liquid crystal.

Furthermore, also in the case where another liquid crystal such as a TN liquid crystal is driven, a more accurate gray scale display is realized, and an affect of reducing flicker of the screen or a decrease in contrast is obtained.

Moreover, since one of the power source lines of the analog amplifier circuit 704 is used together with the scanning line, simplification of the circuit can be realized, and the aforementioned effect can be obtained with practically no decrease in the pixel aperture ratio.

Figure 56:
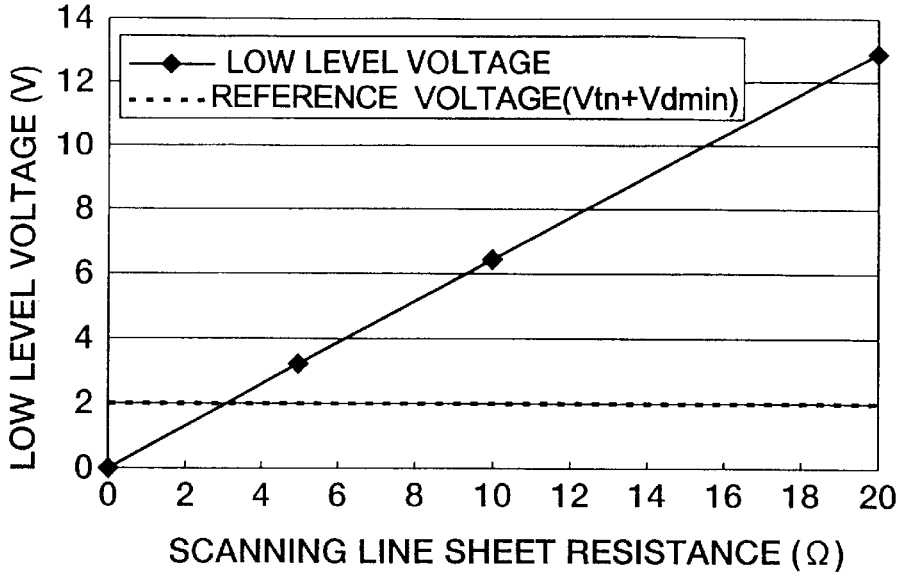
FIG. 56 is a characteristic diagram showing the effect of the liquid crystal display device of the eleventh embodiment.
Figure 56:
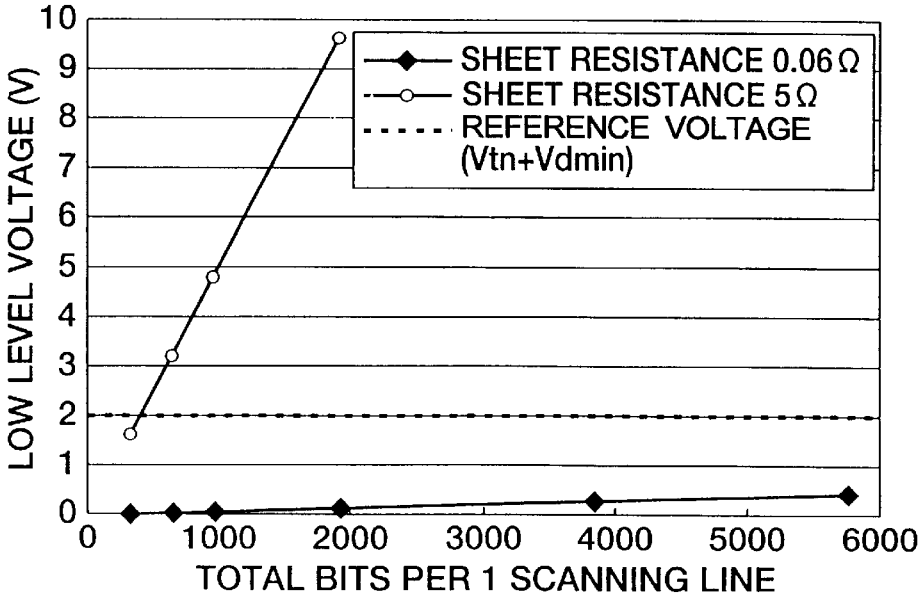

Part (a) shown in FIG. 56 is a correlation diagram of the wiring resistance of the scanning line and the low level voltage of the scanning line, illustrating the effect of this embodiment. With the high level side power source voltage of the gate driver as 16 V, the low level side power source voltage as 0 V, the high level of the data signal voltage as 11 V, the low level as 1 V, and the bit number per scanning line as 640, the value of the scanning line low level voltage in the 640th bit for the case where the sheet resistance of the scanning line was changed, was obtained by simulation. The threshold value Vtn of the switching MOS type transistor used in the calculation was 1 V.

The low level of the gate scanning voltage continuously reduces with the reduction of the sheet resistance, showing the effectiveness according to the present embodiment where the low resistance scanning lines are formed by using a metal or a metal silicide. Furthermore, in order to normally perform the switching operation, it is necessary to make the low level of the gate scanning voltage at least less than the sum of the low level voltage of the data signal and the threshold value (2 V in the example of FIG. 56). With the example of part (a) shown in FIG. 56, the sheet resistance is at least less than 3 Ω. If it is assumed that the wiring height is from 500 nm~1 μm approximately, then this corresponds to a resistivity of less than $1.5\times10^{-4}$~$3\times10^{-4}$ (Ω·cm). With the metal or metal silicide forming the scanning lines, the resistivity should be at least less than this value.

Part (b) shown in FIG. 56 is a correlation diagram of the total bit number per one scanning line and the scanning line low level voltage, illustrating the effect of this embodiment. The simulation conditions are the same as for the case of part (a) shown in FIG. 56, and the value of the scanning line low level voltage in the maximum bit in the case where the sheet resistance of the scanning line is made constant and the total bit number per one scanning line is changed, is obtained by simulation. Computation is performed for two types of scanning line sheet resistances, namely 0.06 Ω and 5 Ω.

If the wiring height is assumed to be 500 nm, the sheet resistance 0.06 Ω corresponds to a resistivity of $3\times10^{-6}$ (Ω·cm). This corresponds approximately to the resistivity of Al. In this way, as an example of the present embodiment, in the case where the gate scanning line is formed from Al, even if the bit number is approximately 6000 (=2000×RGB), normal switching is possible.

On the other hand, in the case where the sheet resistance is 5 Ω, this corresponds to a resistivity of $2.5\times10^{-4}$ (Ω·cm), and the bit number for where it can be supposed that normal switching operation is possible is when the bit number is up to 320 at the most. As with the present embodiment, by using at least a metal or a metal silicide for the material forming the scanning line, even if the bit number increases, normal switching can be performed.

With the wiring resistance, even in the case of the same material, this changes with the wiring height and the wiring width. However making the wiring height or the wiring width excessively large in order to reduce the resistance causes disconnection or defective orientation of the liquid crystal, or causes a reduction in the aperture ratio, and hence this is best avoided. From this point also, the liquid crystal display device according to the present embodiment is effective.

Figure 57:
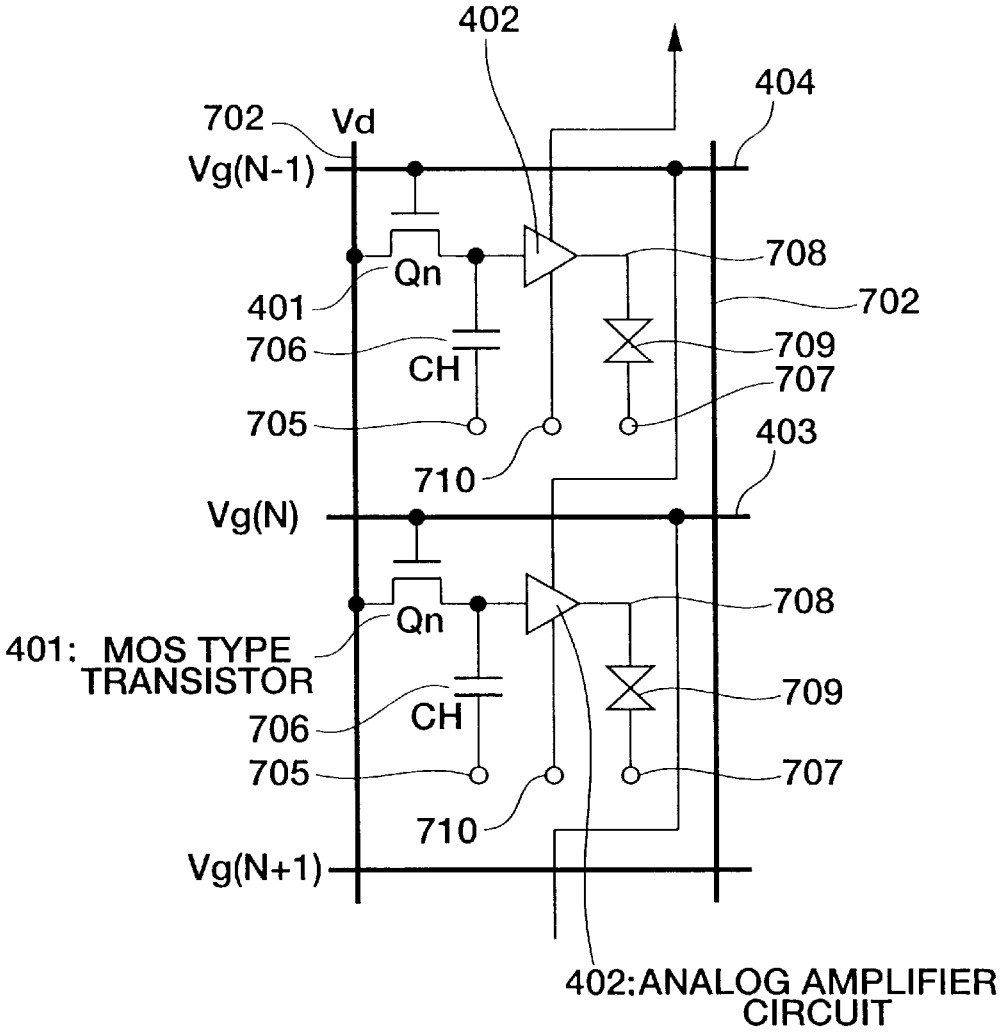
FIG. 57 is a configuration diagram showing a modified example of the liquid crystal display device of the eleventh embodiment.

FIG. 57 is a circuit configuration diagram of one pixel section showing a modified example of a liquid crystal display device according to the eleventh embodiment.

As shown in the figure, the liquid crystal display device of this example comprises: a MOS type transistor 401 with a gate electrode connected to an Nth (where N is an integer of two or more) scanning line 403 formed from a material containing at least a metal or a metal silicide, and one of a source electrode and a drain electrode connected to a data line 702; an analog amplifier circuit 402 with an input electrode connected to the other of the source electrode and the drain electrode of the MOS type transistor 401, and one of a positive and negative power source line connected to an (N−1)th scanning line 404 formed from a material containing at least a metal or a metal silicide, and the other power source line connected to the amplifier power source electrode Vamp 710, and the output electrode connected to the pixel electrode 708; a voltage holding capacitor 706 formed between the input electrode of the analog amplifier circuit 402 and a voltage holding capacitor electrode 705; and a liquid crystal 709, the orientation of which is to be changed, disposed between the pixel electrode 708 and an opposing electrode 707.

Also in the modified example of FIG. 57, the same effect as for the case of FIG. 54 is obtained.

Figure 58:
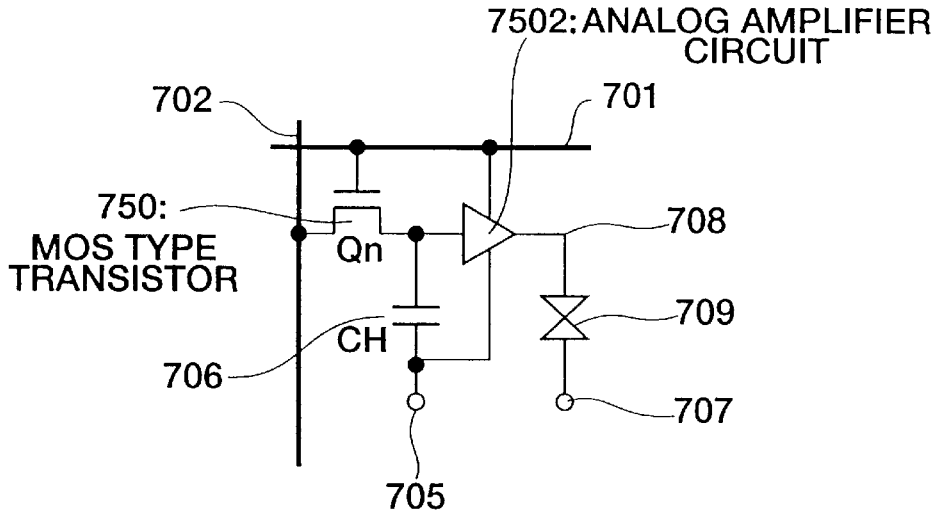
FIG. 58 is a configuration diagram showing another modified example of the liquid crystal display device of the eleventh embodiment.

FIG. 58 is a circuit configuration diagram of one pixel section showing another modified example of a liquid crystal display device according to the eleventh embodiment. As shown in the figure, the liquid crystal display device of this example comprises: a MOS type transistor (Qn) 750 with a gate electrode connected to a scanning line 701 formed from a material containing at least a metal or a metal silicide, and one of a source electrode and a drain electrode connected to a data line 702; an analog amplifier circuit 755 with an input electrode connected to the other of the source electrode and the drain electrode of the transistor (Qn) 750, and an output electrode connected to a pixel electrode 708, and one of a positive and negative power source line connected to the scanning line 701 and the other of the power source line connected to a voltage holding capacitor electrode 705; a voltage holding capacitor 706 formed between an input electrode of the analog amplifier circuit 755 and the voltage holding capacitor electrode 705; and a liquid crystal 709, the orientation of which is to be changed, disposed between the pixel electrode 708 and an opposing electrode 707.

In this modified example, special wiring is also not required in either of the positive or negative power source lines of the analog amplifier circuit 755. Hence the circuit configuration for the pixels can be further simplified, and the aperture ratio can be increased.

In the modified example of FIG. 58, in addition to the effect of FIG. 54, this also has the affect that the circuit configuration for the pixels can be further simplified, and the aperture ratio can be improved.

Here the power source line connected to the scanning line of the analog amplifier circuit 755 may be of a form as with the modified example of FIG. 57, where this is connected to the adjacent scanning line.

With the respective modified examples of FIG. 54, FIG. 57 and FIG. 58, it was noted that the MOS type transistors (Qn) 703, 401 and 750 and the analog amplifier circuits 704, 402 and 755 were formed from poly-SiTFTs. However these may be formed from other thin film transistors such as a-Si TFTs or cadmium-selenium thin film transistors. Moreover these may be formed from single crystal silicon transistors.

Furthermore, with the aforementioned respective modified examples of FIG. 54, FIG. 57 and FIG. 58, an n-type MOS transistor is employed for the pixel selection switch. However a p-type MOS transistor may be employed. In this case, for the gate scanning signal, a pulse signal which becomes a low level at the time of selection and a high level at the time of non selection is input.

Furthermore, with the respective modified examples of FIG. 54, FIG. 57 and FIG. 58, the gain of the analog amplifier circuit is set to 1. However in order to make the pixel voltage different from the input voltage, the voltage amplification may be changed.

Figure 59:
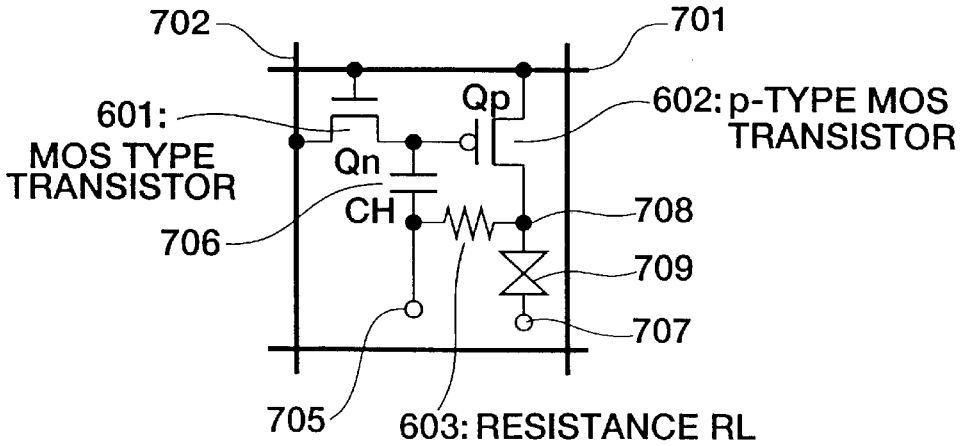
FIG. 59 is a configuration diagram showing yet another modified example of the liquid crystal display device of the eleventh embodiment.

FIG. 59 is a circuit configuration diagram of one pixel section showing yet another modified example of a liquid crystal display device according to the eleventh embodiment, being a specific configuration example for the case where the analog amplifier circuit 704 of FIG. 54 is constituted by a transistor.

As shown in the figure, the liquid crystal display device of this example comprises: an n-type MOS type transistor (Qn) 601 with a gate electrode connected to a scanning line 701 formed from a material containing at least a metal or a metal silicide, and one of a source electrode and a drain electrode connected to a data line 702; a p-type MOS transistor (Qp) 602 with a gate electrode connected to the other of the source electrode and the drain electrode of the n-type transistor (Qn) 601, and one of a source electrode and a drain electrode connected to the scanning line 701, and the other of the source electrode and the drain electrode connected to a pixel electrode 708; a voltage holding capacitor 706 formed between the gate electrode of this p-type MOS transistor (Qp) 602 and the voltage holding capacitor electrode 705; a resistor (RL) 603 connected between the pixel electrode 708 and the voltage holding capacitor electrode 705; and a liquid crystal 709, the orientation of which is to be changed, disposed between the pixel electrode 708 and an opposing electrode 707.

The resistor (RL) 603 is formed from a semiconductor thin film or an impurity doped semiconductor thin film.

As follows is a description of the drive method for the liquid crystal display device using the pixel construction shown in FIG. 59.

Figure 60:
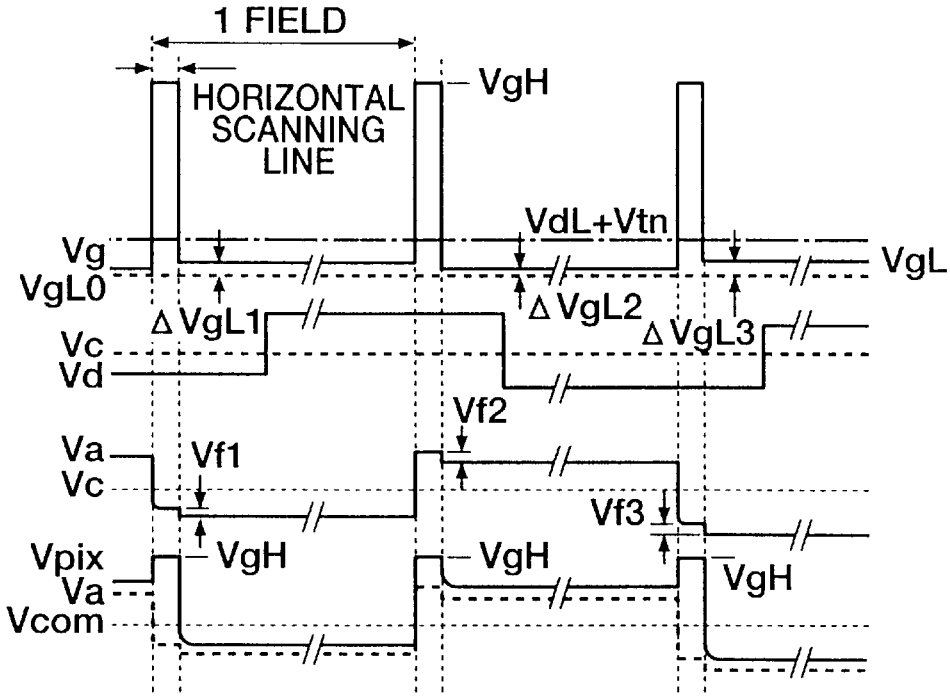
FIG. 60 is a timing chart showing a drive method of the liquid crystal display device of FIG. 59.

FIG. 60 shows the timing chart for the gate scanning voltage Vg, a data signal voltage Vd, a gate voltage Va for the p-type MOS transistor (Qp) 602, and a pixel voltage Vpix, for the case where a liquid crystal is driven by the pixel construction shown in FIG. 59. The negative power source voltage of the gate driver is VgL0, and the low level voltage of the gate scanning voltage is VgL.

As shown in the figure, due to the gate scanning voltage Vg in the horizontal scanning period becoming a high level VgH, the n-type MOS transistor (Qn) 601 comes on, and the data signal Vd input to the data line is transferred to the gate electrode of the p-type MOS transistor (Qp) 602 via the n-type MOS transistor (Qn) 601.

On the other hand, in the horizontal scanning period, the pixel electrode 708 attains the reset state due to the gate scanning voltage VgH being transferred via the p-type MOS transistor (Qp) 602. Here as described below, the p-type MOS transistor (Qp) 602 operates as a source-follower type analog amplifier, after the horizontal scanning period is completed. However due to the pixel voltage Vpix becoming VgH in the horizontal scanning period, the resetting of the p-type MOS transistor (Qp) 602 is performed at the same time.

When the horizontal scanning period is completed and the gate scanning voltage Vg becomes a low level, the n-type MOS transistor (Qn) 601 goes off, and the data signal transferred to the gate electrode of the p-type MOS transistor (Qp) 602 is held by the voltage holding capacitor 706. At this time, with the gate input voltage Va of the p-type MOS transistor (Qp) 602, at the time when the n-type MOS transistor (Qn) 601 goes off, a voltage shift referred to as a feed-through voltage occurs via the capacitance between the gate and the source of the n-type MOS transistor (Qn) 601. In FIG. 60 this is shown by Vf1, Vf2 and Vf3.

The gate input voltage Va of the p-type MOS transistor (Qp) 602 is held until the gate scanning voltage Vg again becomes a high level in the subsequent field period and the n-type MOS transistor (Qn) 601 is selected.

On the other hand, the p-type MOS transistor (Qp) 602, on completion of resetting in the horizontal scanning period, operates as a source-follower type analog amplifier with the pixel electrode 708 as the source electrode. At this time, in order to operate the p-type MOS transistor (Qp) 602 as an analog amplifier, a voltage at least higher than (Vdmax-Vtp) is supplied to the voltage holding capacitor electrode 705. Here Vdmax is the maximum value of the data signal voltage Vd, while Vtp is the threshold value voltage of the p-type MOS transistor (Qp) 602.

The p-type MOS transistor (Qp) 602, during the period in the subsequent field up until the gate scanning voltage becomes VgH to thus execute reset, can output an analog gray scale voltage corresponding to the held gate input voltage Va. This output voltage changes depending on the transconductance gmp of the p-type MOS transistor, and the value of the resistor (RL) 603, however it is generally represented by the following equation:

$$Vpix \approx Va - Vtp \tag{11}$$

Here Vtp is normally a negative value, and hence as shown in FIG. 60, the pixel voltage Vpix becomes a voltage which is higher than Va by the absolute value of the threshold value voltage of the p-type MOS transistor (Qp) 602. During this holding period, a current is continually input to the scanning line 701 from the positive power source line of the analog amplifier circuit via the negative power source line, so that the low level voltage VgL of the gate scanning voltage Vg is shifted. In FIG. 60, this is shown as ΔVgL1, ΔVgL2 and ΔVgL3. As a result, VgL, with ΔVgL positive becomes:

$$VgL = VgL0 + \Delta VgL(1 \text{ or } 2 \text{ or } 3) \tag{10}$$

Here ΔVgL differs for each pixel even though on the same scanning line. Moreover, in the same pixel, this changes with the value of the data signal voltage Vd. In the eleventh embodiment, the wiring resistance of the scanning lines which use a low resistant metal or metal silicide for the material thereof is reduced. Hence, the absolute value of ΔVgL is small, and the maximum value of VgL is small. Therefore the relationship:

$$VgL = VdL < V \tag{8}$$

being the necessary condition for normal switching, is satisfied. In this way, the liquid crystal can be driven without fluctuations in the pixel voltage Vpix.

Also in the modified example of FIG. 59, the same effect as for the case of FIG. 54 is obtained.

Figure 61:
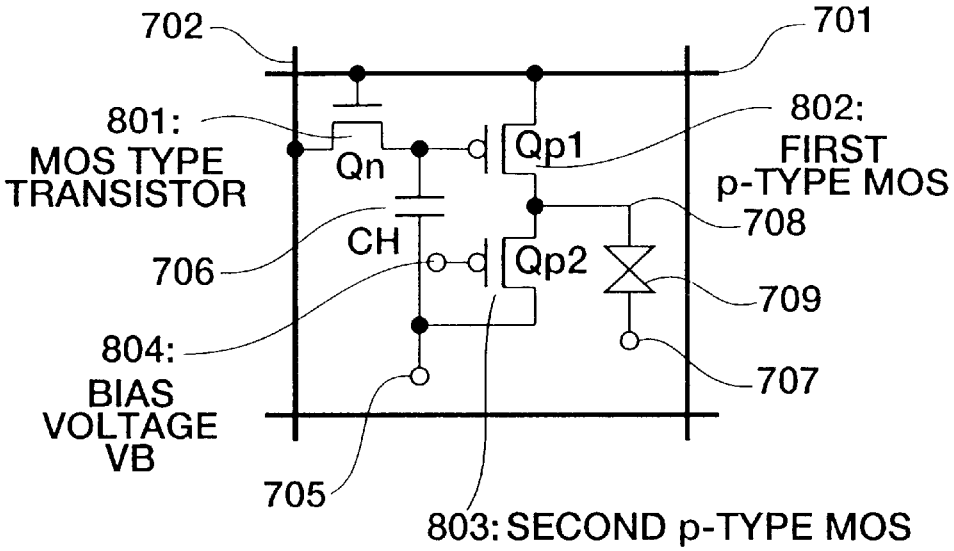
FIG. 61 is a configuration diagram showing yet another modified example of the liquid crystal display device of the eleventh embodiment.

FIG. 61 is a circuit configuration diagram of one pixel section showing yet another modified example of a liquid crystal display device in the eleventh embodiment, being an example where the analog amplifier circuit 704 of FIG. 54 is executed by two transistors.

As shown in the figure, the liquid crystal display device of this example comprises: an n-type MOS type transistor (Qn) 801 with a gate electrode connected to a scanning line 701 formed from a material containing at least a metal or a metal silicide, and one of a source electrode and a drain electrode connected to a data line 702; a first p-type MOS transistor (Qp1) 802 with a gate electrode connected to the other of the source electrode and drain electrode of the n-type transistor (Qn) 801, and one of a source electrode and a drain electrode connected to the scanning line 701, and the other of the source electrode and the drain electrode connected to a pixel electrode 708; a voltage holding capacitor 706 formed between the gate electrode of this first p-type MOS transistor (Qp1) 802 and the voltage holding capacitor electrode 705; a second p-type MOS transistor (Qp2) 803 with a gate electrode connected to a bias power source (VB) 804, and a source electrode connected to the voltage holding capacitor electrode 705; and drain electrode connected to a pixel electrode 708; and a liquid crystal 709, the orientation of which is to be changed, disposed between the pixel electrode 708 and an opposing electrode 707.

The second p-type MOS transistor (Qp2) 803, in the case where the first p-type MOS transistor (Qp1) 802 is operated as an analog amplifier, operates as a bias current source.

The drive method of the liquid crystal display device of the modified embodiment of FIG. 61 is the same as the drive method of the liquid crystal display device of FIG. 59.

In the modified example of FIG. 61 also, effects the same as for the case of FIG. 59 can be expected. In addition, with the modified example of FIG. 61, since the gate electrode of the second p-type MOS transistor (Qp2) 803 is connected to the bias power source (VB) 804, and the source electrode is connected to the voltage holding capacitor electrode 705, then the operating range of the second p-type MOS transistor (Qp2) 803 can be controlled by adjusting the voltage of both. Hence this has the effect in that the controllability of the analog amplifier circuit is higher than for the case of FIG. 59.

Figure 62:
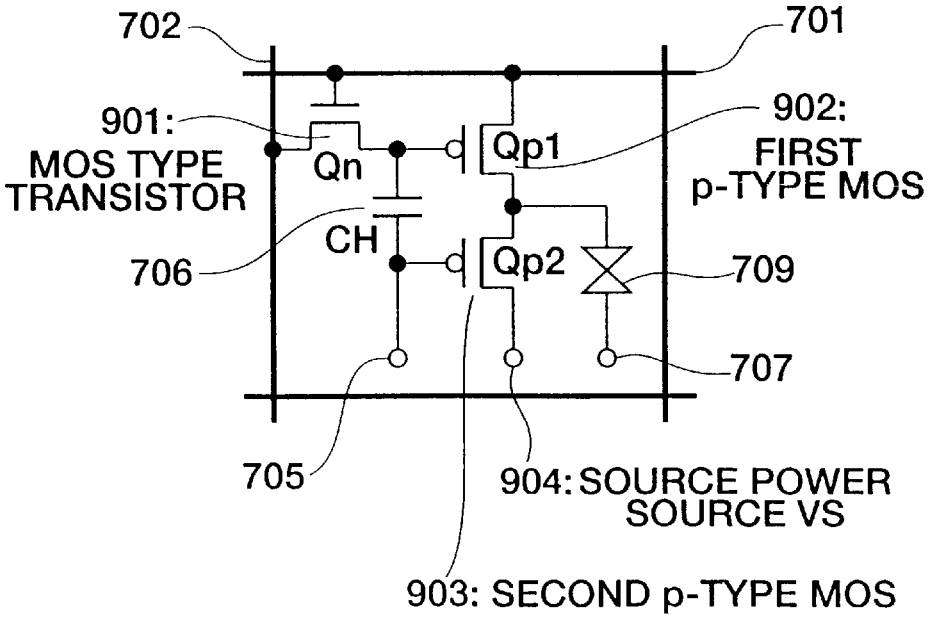
FIG. 62 is a configuration diagram showing yet another modified example of the liquid crystal display device of the eleventh embodiment.

FIG. 62 is a circuit configuration diagram of one pixel section showing yet another modified example of a liquid crystal display device in the eleventh embodiment, being another example where the analog amplifier circuit 704 of FIG. 54 is executed by two transistors.

As shown in the figure, the liquid crystal display device of this example comprises: an n-type MOS type transistor (Qn) 901 with a gate electrode connected to a scanning line 701 formed from a material containing at least a metal or a metal silicide, and one of a source electrode and a drain electrode connected to a data line 702; a first p-type MOS transistor (Qp1) 902 with a gate electrode connected to the other of the source electrode and drain electrode of the n-type transistor (Qn) 901, and one of a source electrode and a drain electrode connected to the scanning line 701, and the other of the source electrode and the drain electrode connected to a pixel electrode 708; a voltage holding capacitor 706 formed between the gate electrode of this first p-type MOS transistor (Qp1) 902 and the voltage holding capacitor electrode 705; a second p-type MOS transistor (Qp2) 903 with a gate electrode connected to the voltage holding capacitor electrode 705; and a source electrode connected to a source power source (VS) 904, and drain electrode connected to a pixel electrode 708; and a liquid crystal 709, the orientation of which is to be changed, disposed between the pixel electrode 708 and an opposing electrode 707.

The second p-type MOS transistor (Qp2) 903, in the case where the first p-type MOS transistor (Qp1) 902 is operated as an analog amplifier, operates as a bias current source.

The drive method of the liquid crystal display device of this modified embodiment is the same as the drive method of the liquid crystal display device of FIG. 59.

In the modified example of FIG. 62 also, effects the same as for the case of FIG. 59 can be expected. In addition, with the modified example of FIG. 62, since the gate electrode of the second p-type MOS transistor (Qp2) 903 is connected to the voltage holding capacitor electrode 705; and the source electrode is connected to the source power source (VS) 904, then the operating range of the second p-type MOS transistor (Qp2) 903 can be controlled by adjusting the voltage of both. Hence this has the effect in that the controllability of the analog amplifier circuit is higher than for the case of FIG. 59.

Figure 63:
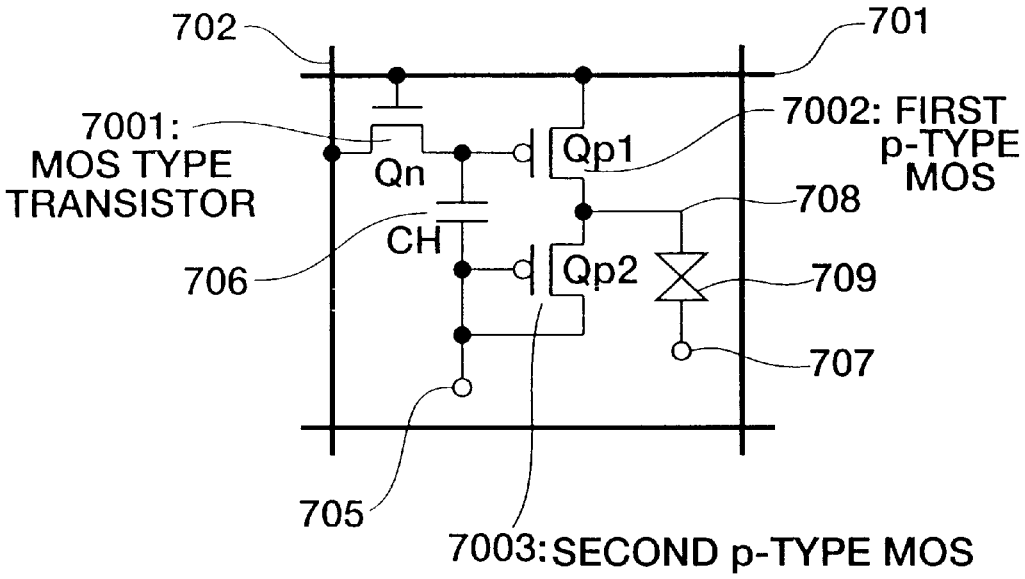
FIG. 63 is a configuration diagram showing yet another modified example of the liquid crystal display device of the eleventh embodiment.

FIG. 63 is a circuit configuration diagram of one pixel section showing yet another modified example of a liquid crystal display device in the eleventh embodiment, being another example where the analog amplifier circuit 704 of FIG. 54 is executed by two transistors.

As shown in the figure, the liquid crystal display device of this example comprises: an n-type MOS type transistor (Qn) 7001 with a gate electrode connected to a scanning line 701 formed from a material containing at least a metal or a metal silicide, and one of a source electrode and a drain electrode connected to a data line 702; a first p-type MOS transistor (Qp1) 7002 with a gate electrode connected to the other of the source electrode and drain electrode of the n-type transistor (Qn) 7001, and one of a source electrode and a drain electrode connected to the scanning line 701, and the other of the source electrode and the drain electrode connected to a pixel electrode 708; a voltage holding capacitor 706 formed between the gate electrode of this first p-type MOS transistor (Qp1) 7002 and the voltage holding capacitor electrode 705; a second p-type MOS transistor (Qp2) 7003 with a gate electrode and a source electrode connected to the voltage holding capacitor electrode 705; and a drain electrode connected to a pixel electrode 708; and a liquid crystal 709, the orientation of which is to be changed, disposed between the pixel electrode 708 and an opposing electrode 707.

Since the gate electrode and the source electrode of the second p-type MOS transistor (Qp2) 7003 are both connected to the voltage holding capacitor electrode 705, then the gate-source voltage Vgsp of the second p-type MOS transistor (Qp2) 7003 becomes 0 V. Under this bias condition, in order to appropriately operate the analog amplifier, the threshold value voltage of the second p-type MOS transistor (Qp2) 7003 is shift controlled by channel-dose. The second p-type MOS transistor (Qp2) 7003 is operated as the bias current power supply for the case where the first p-type MOS transistor (Qp1) 1002 is operated as an analog amplifier.

The drive method of the liquid crystal display device of this modified embodiment is the same as the drive method of the liquid crystal display device of FIG. 59.

In the modified example of FIG. 63 also, effects the same as for the case of FIG. 59 can be expected. In addition, with the modified example of FIG. 63, the bias power source (VB) 804, and the source power source (VS) 904 necessary in FIG. 61 and FIG. 62 are not necessary, thus having the effect that the circuit is simplified, and the aperture ratio increased. However, in order to perform threshold value control of the second p-type MOS transistor (Qp2) 7003, a channel dose process is necessary.

Figure 64:
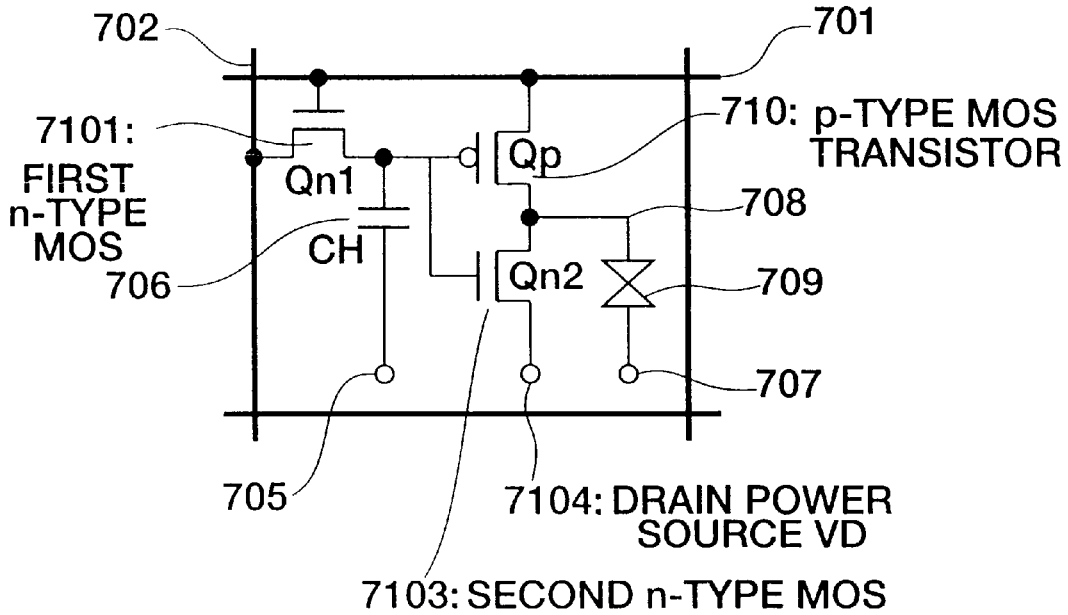
FIG. 64 is a configuration diagram showing yet another modified example of the liquid crystal display device of the eleventh embodiment.

FIG. 64 is a circuit configuration diagram of one pixel section showing yet another modified example of a liquid crystal display device in the eleventh embodiment, being another example where the analog amplifier circuit 704 of FIG. 54 is executed by two transistors.

As shown in the figure, the liquid crystal display device of this example comprises: a first n-type MOS type transistor (Qn1) 7101 with a gate electrode connected to a scanning line 701 formed from a material containing at least a metal or a metal silicide, and one of a source electrode and a drain electrode connected to a data line 702; a p-type MOS transistor (Qp) 7102 with a gate electrode connected to the other of the source electrode and drain electrode of the first n-type transistor (Qn1) 7101, and one of a source electrode and a drain electrode connected to the scanning line 701, and the other of the source electrode and the drain electrode connected to a pixel electrode 708; a voltage holding capacitor 706 formed between the gate electrode of this p-type MOS transistor (Qp) 7102 and the voltage holding capacitor electrode 705; a second n-type MOS transistor (Qn2) 7103 with a gate electrode connected to the gate electrode of the p-type MOS transistor (Qp) 7102, and a source electrode connected to a drain power source (VD) 7104, and a source electrode connected to a pixel electrode 708; and a liquid crystal 709, the orientation of which is to be changed, disposed between the pixel electrode 708 and an opposing electrode 707.

The second n-type MOS transistor (Qn2) 7103 is operated as the bias current power supply for the case where the p-type MOS transistor (Qp) 710 is operated as an analog amplifier.

In this modified example also, effects the same as for the case of FIG. 59 can be expected.

Figure 65:
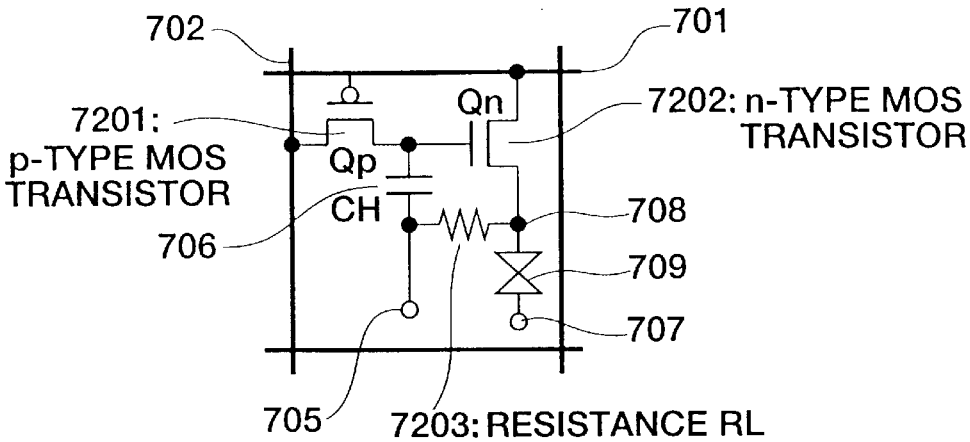
FIG. 65 is a configuration diagram showing yet another modified example of the liquid crystal display device of the eleventh embodiment.

FIG. 65 is a circuit configuration diagram of one pixel section showing yet another modified example of a liquid crystal display device in the eleventh embodiment, being another example where the analog amplifier circuit 704 of FIG. 54 is constituted by transistors.

As shown in the figure, the liquid crystal display device of this example comprises: a p-type MOS type transistor (Qp) 7201 with a gate electrode connected to a scanning line 701 formed from a material containing at least a metal or a metal silicide, and one of a source electrode and a drain electrode connected to a data line 702; an n-type MOS transistor (Qn) 7202 with a gate electrode connected to the other of the source electrode and drain electrode of the p-type transistor (Qp) 7201, and one of a source electrode and a drain electrode connected to the scanning line 701, and the other of the source electrode and the drain electrode connected to a pixel electrode 708; a voltage holding capacitor 706 formed between the gate electrode of this n-type MOS transistor (Qn) 7202 and the voltage holding capacitor electrode 705; a resistor (RL) 603 connected between the pixel electrode 708 and the voltage holding capacitor electrode 705; and a liquid crystal 709, the orientation of which is to be changed, disposed between the pixel electrode 708 and an opposing electrode 707.

The resistor (RL) 7203 is formed from a semiconductor thin film or an impurity doped semiconductor thin film.

As follows is a description of the drive method for the liquid crystal display device using the pixel construction of FIG. 65.

Figure 66:
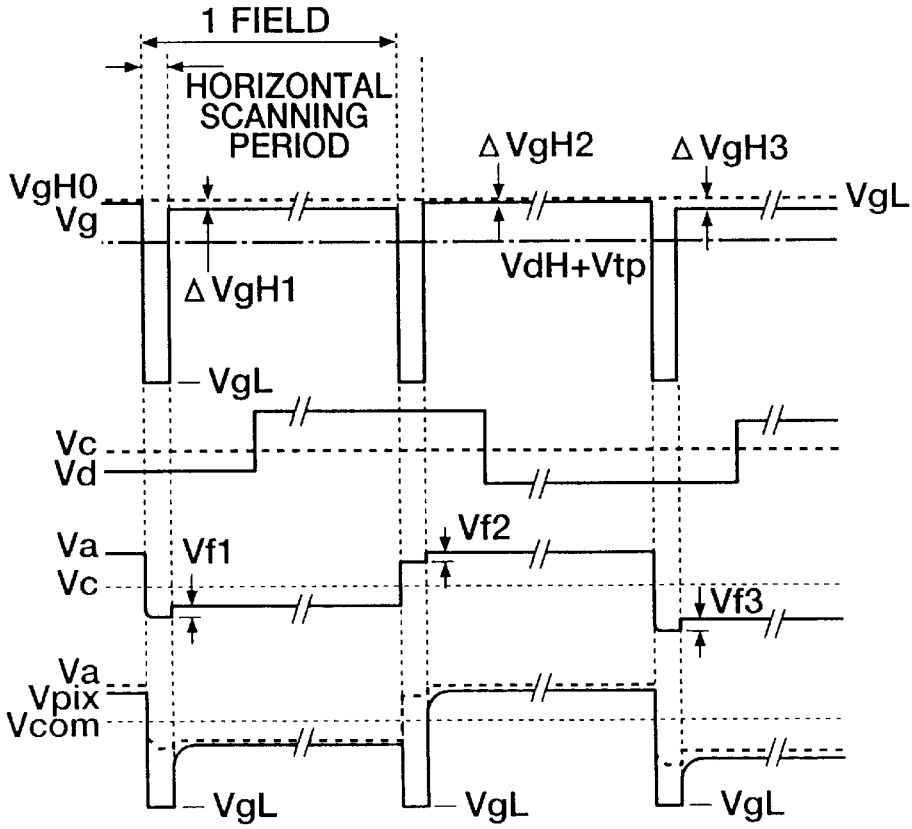
FIG. 66 is a timing chart showing a drive method of the liquid crystal display device of FIG. 65.

FIG. 66 shows the timing chart for the gate scanning voltage Vg, a data signal voltage Vd, a gate voltage Va for the n-type MOS transistor (Qn) 7202, and a pixel voltage Vpix, for the case where a liquid crystal is driven by the pixel construction of FIG. 65.

As shown in the figure, due to the gate scanning voltage Vg in the horizontal scanning period becoming a low level VgL, the p-type MOS transistor (Qp) 7201 comes on, and the data signal Vd input to the data line is transferred to the gate electrode of the n-type MOS transistor (Qn) 7202 via the p-type MOS transistor (Qp) 7201.

On the other hand, in the horizontal scanning period, the pixel electrode 708 attains the reset state due to the gate scanning voltage VgL being transferred via the n-type MOS transistor (Qn) 7202. Here as described below, the n-type MOS transistor (Qn) 7202 operates as a source-follower type analog amplifier, after the horizontal scanning period is completed. However due to the pixel voltage Vpix becoming VgL in the horizontal scanning period, the resetting of the n-type MOS transistor (Qn) 7202 is performed at the same time.

When the horizontal scanning period is completed and the gate scanning voltage Vg becomes a high level, the p-type MOS transistor (Qp) 7201 goes off, and the data signal transferred to the gate electrode of the n-type MOS transistor (Qn) 7202 is held by the voltage holding capacitor 706. At this time, with the gate input voltage Va of the n-type MOS transistor (On) 7202, at the time when the p-type MOS transistor (Qp) 7201 goes off, a voltage shift referred to as a feed-through voltage occurs via the capacitance between the gate and the source of the p-type MOS transistor (Qp) 7201. In FIG. 66 this is shown by Vf1, Vf2 and Vf3.

The gate input voltage Va of the n-type MOS transistor (On) 7202 is held until the gate scanning voltage Vg again becomes a low level in the subsequent field period and the p-type MOS transistor (Qp) 7201 is selected. On the other hand, the n-type MOS transistor (Qn) 7202, on completion of resetting in the horizontal scanning period, operates as a source-follower type analog amplifier with the pixel electrode 708 as the source electrode.

At this time, in order to operate the n-type MOS transistor (On) 7202 as an analog amplifier, a voltage at least lower than (Vdmin-Vtn) is supplied to the voltage holding capacitor electrode 705. Here Vdmin is the minimum value of the data signal voltage Vd, while Vtn is the threshold value voltage of the n-type MOS transistor (Qn) 7202.

The n-type MOS transistor (On) 7202, during the period in the subsequent field up until the gate scanning voltage becomes VgL to thus execute reset, can output an analog gray scale voltage corresponding to the held gate input voltage Va. This output voltage Vpix changes depending on the transconductance gmn of the n-type MOS transistor (On), and the value of the resistor (RL) 7203, however it is generally represented by the following equation:

$$Vpix \approx Va - Vtn \tag{12}$$

Here Vtn is normally a positive value, and hence as shown in FIG. 66, the pixel voltage Vpix becomes a voltage which is lower than Va by the absolute value of the threshold value voltage of the n-type MOS transistor (Qn) 7202. During this holding period, a current is continually output from the scanning line 701 to the negative power source line of the analog amplifier circuit via the positive power source line, so that the high level voltage VgH of the gate scanning voltage Vg is shifted. In FIG. 60, this is shown as ΔVgH1, ΔVgH2 and ΔVgH3.

As a result, VgH, with A VgH positive becomes:

$$VgH = VgH0 - \Delta VgH(1 \text{ or } 2 \text{ or } 3) \tag{13}$$

Here Δ VgH differs for each pixel even though on the same scanning line. Moreover, in the same pixel, this changes with the value of the data signal voltage Vd.

In the liquid crystal device according to the eleventh embodiment, the wiring resistance of the scanning lines which use a low resistant metal or metal silicide for the material thereof is reduced. Hence, the absolute value of A VgH is small, and the minimum value of VgH is large. Therefore the relationship:

$$Vt < VgH = VdH \tag{9}$$

being the necessary condition for normal switching, is satisfied. Here, VdH is the high level of the data signal. In this way, the liquid crystal can be driven without fluctuations in the pixel voltage Vpix.

Also in the modified example of FIG. 65, the same effect as for the case of FIG. 59 is obtained.

With the aforementioned respective modified examples of FIG. 59 to FIG. 64, an n-type MOS transistor is employed for the pixel selection switch. However a p-type MOS transistor may be employed. In this case, for the gate scanning signal, a pulse signal which becomes a low level at the time of selection and a high level at the time of non selection is input, and with the one or two the transistors constituting the analog amplifier circuit, the p-type in the respective modified examples is changed to an n-type, and the n-type changed to a p-type.

FIG. 65 shows a modified example for the case where in this way, the switching n-type MOS transistor in FIG. 59 is replaced by a p-type MOS transistor, and the amplifier p-type MOS transistor is replaced by an n-type MOS transistor. With the modified example of FIG. 65, the same affect as for the modified example of FIG. 59 is obtained. Also with the other modified examples of FIG. 61 through FIG. 64, the switching transistor may be changed to a p-type.

Here with the aforementioned respective modified examples of FIG. 59 through FIG. 65, it was noted that the n-type MOS transistors (Qn, Qn1, Qn2) and the p-type MOS transistors (Qp, Qp1, Qp2) were formed from poly-SiTFTs. However these may be formed from other thin film transistors such as a-Si TFTs or cadmium-selenium thin film transistors. Moreover these may be formed from single crystal silicon transistors. Furthermore, the gain of the analog amplifier circuit is set to 1. However in order to make the pixel voltage different from the input voltage, the voltage amplification may be changed.

In all of the above modified examples, the scanning lines (701, 403, 404) were formed from a low resistance wiring formed from a material containing at least a metal or a metal silicide, enabling the voltage shift amount of the gate scanning voltage at the time of non selection to be reduced.

With the scanning line resistance, this must be a low value to the extent that normal switching operation is performed. That is to say, in the case where the switching transistor is an n-type, this must be a resistance value such that the low level of the gate scanning voltage becomes at least less than the sum of the low level voltage of the data signal and the threshold value, while in the case where the switching transistor is a p-type, this must be a value such that the high level of the gate scanning voltage becomes greater than the sum of the high level voltage of the data signal and the threshold value.

To mention the example of FIG. 56(*a*), this is the case where the sheet resistance of the scanning line is at least less than 3Ω, and considering the wiring height to be around 1 μm, then this corresponds to a resistivity of less than $3\times10^{-4}$ (Ω·cm). With the metal or the metal silicide forming the scanning wire, the resistivity (for the case where the wiring height is 1 μm) should be at least less than this value. However, this is only one example, and depending on the conditions, the required maximum value of the resistivity differs. For example, as with part (b) shown in FIG. 56, the shift amount of the gate low level voltage is increased due to the increase in the number of pixels. Hence in this case the resistance value of the metal or metal silicide should be such that the magnitude is approximately inversely proportional to the number of pixels.

Furthermore, with the material for forming the scanning lines, this is more desirably a high melting point metal or a high melting point metal silicide. More specifically, this is for example Al and Al alloy, Mo and Mo alloy, W and W alloy, MoSi2, WSi2, TiSi2, or TaSi2. An Al alloy contains at least one transition metal element of transition metal elements such as for example Pd, Ti, Ta, Nb, Co, Cr, Mo, V, Ni, Cu, Fe and Mn. These materials may be used as simple substances, or may be used in multi-layers with two or more combined. Moreover, even if this is a high resistance material such as a semiconductor film which has been doped with an impurity, this can also be used combined together in a multi-layer with the materials given here.

Figure 67:
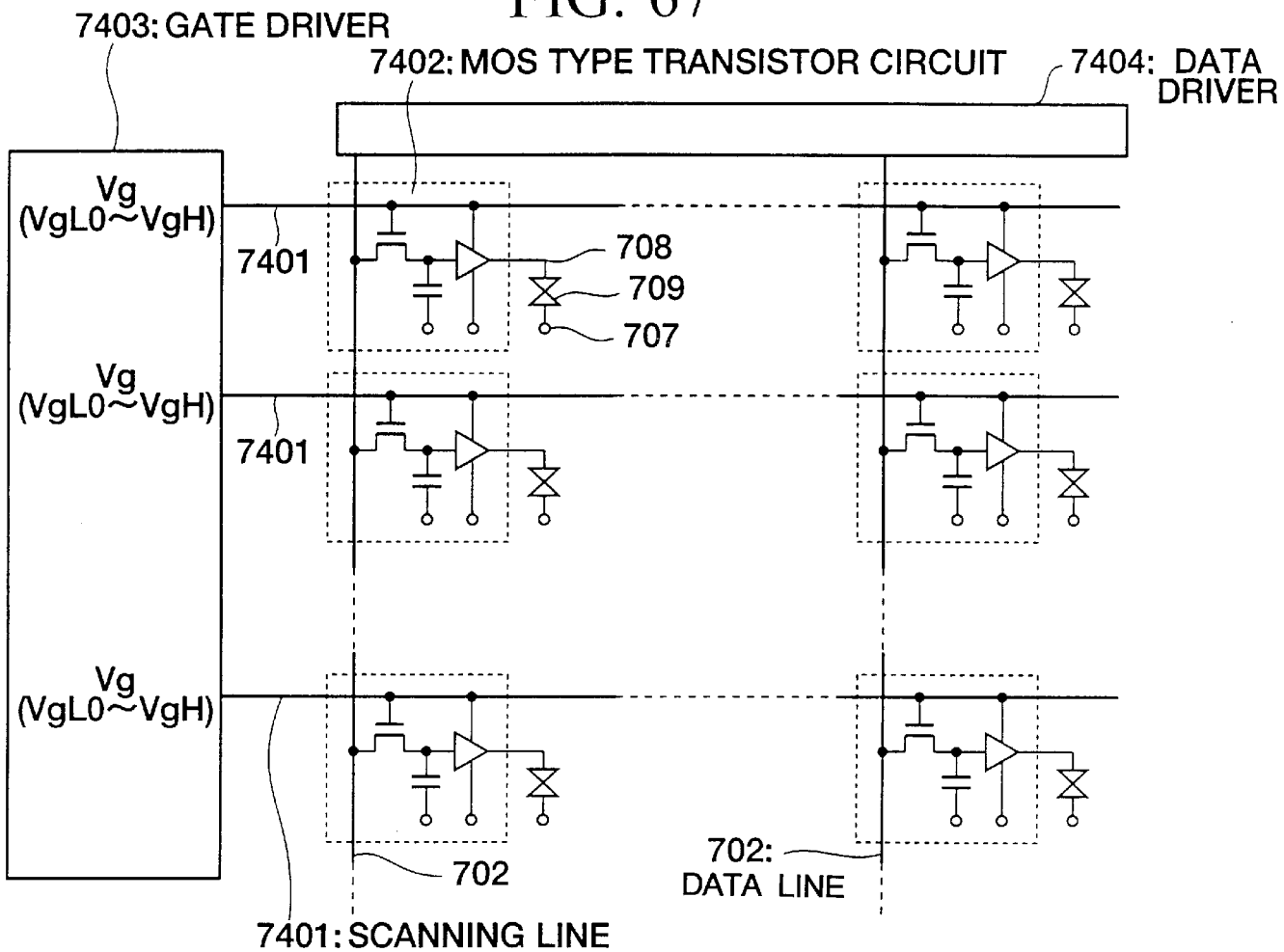
FIG. 67 is a configuration diagram showing a configuration of a liquid crystal display device according to a twelfth embodiment of the present invention.

FIG. 67 is a diagram schematically showing a configuration of a liquid crystal display device according to a twelfth embodiment of the present invention.

In this figure there is an active matrix liquid crystal display device with MOS type transistor circuits 7402 disposed in the vicinity of respective intersection points of a plurality of scanning lines 7401 which are successively driven by a gate driver 7403, and a plurality of data lines 702 for sequentially transferring data signals by means of a data driver 7404, and pixel electrodes 708 are driven by means of these MOS type transistor circuits 7402. A minimum value VgL0 of a gate scanning voltage for input from the gate driver 7403 to the scanning lines 7401 is a negative value.

Figure 68:
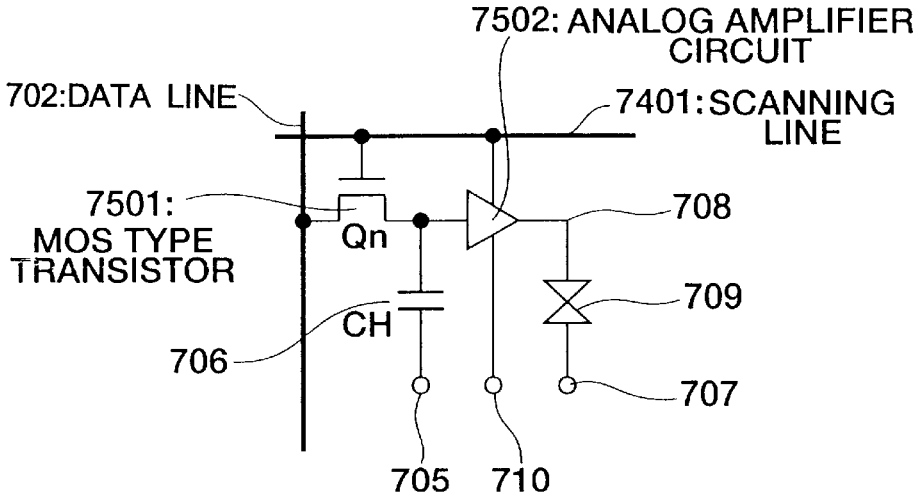
FIG. 68 is a configuration diagram showing a circuit configuration of one pixel section of the liquid crystal display device of the twelfth embodiment.

FIG. 68 is a diagram showing an example of one pixel circuit construction of the liquid crystal display device shown in FIG. 67.

As shown in FIG. 68, the liquid crystal display device of the twelfth embodiment comprises: a MOS type transistor (Qn) 7501 with a gate electrode connected to a scanning line 7401, and one of a source electrode and a drain electrode connected to a data line 702; an analog amplifier circuit 7502 with an input electrode connected to the other of the source electrode and the drain electrode of the transistor (Qn) 7501, and an output electrode connected to a pixel electrode 708, and one of a positive and negative power source line connected to the scanning line 7401 and the other of the power source line connected to an amplifier power source electrode Vamp 710; a voltage holding capacitor 706 formed between an input electrode of the analog amplifier circuit 7502 and the voltage holding capacitor electrode 705; and a liquid crystal 709, the orientation of which is to be changed, disposed between the pixel electrode 708 and an opposing electrode 707.

Here the MOS type transistor (Qn) 7501 and the analog amplifier circuit 7502 are constituted by p-Si TFTs. Furthermore, the gain of the analog amplifier circuit 7502 is set to 1.

Figure 69:
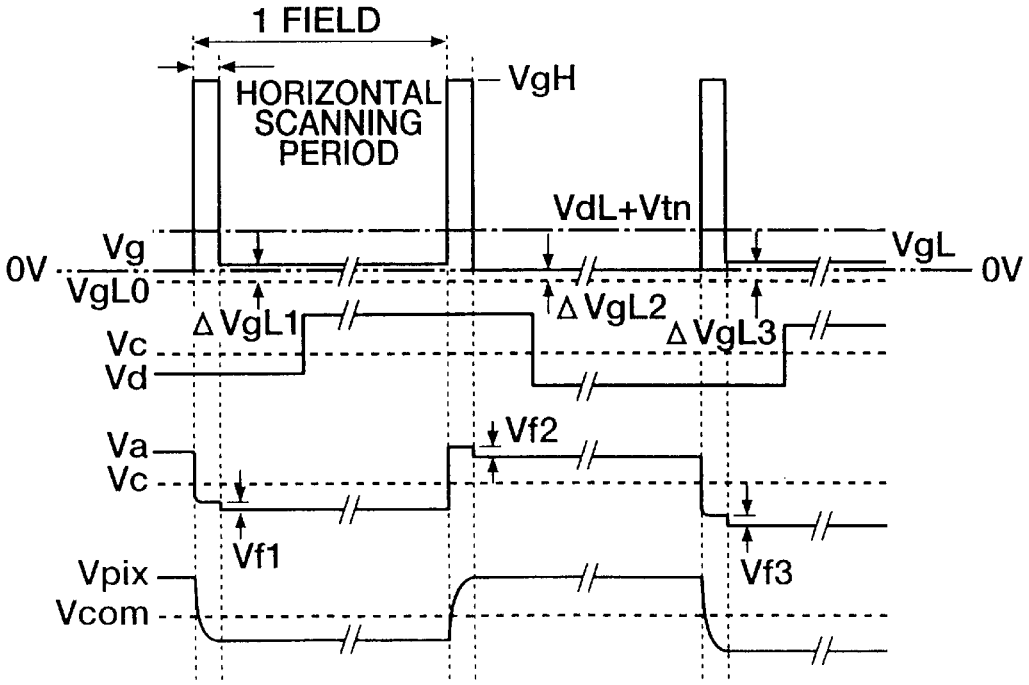
FIG. 69 is a timing chart.showing a drive method of the liquid crystal display device of FIG. 68.

As follows is a description of the drive method for the liquid crystal display device using this pixel construction, with reference to FIG. 69. FIG. 69 shows the timing chart for the gate scanning voltage Vg, a data signal voltage Vd, an amplifier output voltage Va and a pixel voltage Vpix, for the case where a liquid crystal is driven by the pixel construction shown in FIG. 68. The negative power source voltage of the gate driver is VgL0, the low level voltage of the gate scanning voltage in the pixel section is VgL, and the threshold value of the transistor (Qn) 7501 is Vt.

As shown in the figure, due to the gate scanning voltage Vg in the horizontal scanning period becoming a high level VgH, the transistor (Qn) 7501 comes on and the data signal Vd input to the data line 702 is transferred to the input electrode of the analog amplifier circuit 7502 via the transistor (Qn) 7501. When the horizontal scanning period is completed, and a low level voltage VgL0 is output from the gate driver to the scanning line 7401, the transistor (Qn) 7501 goes off, and the data signal transferred to the input electrode of the analog amplifier circuit 7502 is held by the voltage holding capacitor 706.

Here, VgL0 is a voltage where:

$$VgL0<0 \tag{14}$$

At this time, with the amplifier input voltage Va, at the time when the transistor (Qn) 7501 goes off, a voltage shift referred to a feed-through voltage occurs via the capacitance between the gate and source of the transistor (Qn) 7501. In FIG. 69, this is shown by Vf1, Vf2 and Vf3.

The amplifier input voltage Va is held until the gate scanning voltage Vg again becomes a high level in the subsequent field period and the transistor (Qn) 7501 is selected. The analog amplifier circuit 7502, during the period in the subsequent field up until the amplifier input voltage changes, can output an analog gray scale voltage corresponding to the held amplifier input voltage Va. During this holding period, a current is continually input to the scanning line 7401 from the positive power source line of the analog amplifier circuit via the negative power source line, so that the low level voltage VgL of the gate scanning voltage Vg is raised by ΔVgL.

As a result, VgL, with A VgL positive becomes:

$$VgL=VgL0+\Delta VgL \tag{15}$$

Here Δ VgL differs for each pixel even though on the same scanning line. Moreover, in the same pixel, this changes with the value of the data signal voltage Vd. In the twelfth embodiment, VgL0 is a negative value and the maximum value of VgL is small. Therefore the following relationship is satisfied:

$$VgL-VdL<Vt \tag{8}$$

Next is a description of the effect of the liquid crystal display device according to the twelfth embodiment.

Figure 70:
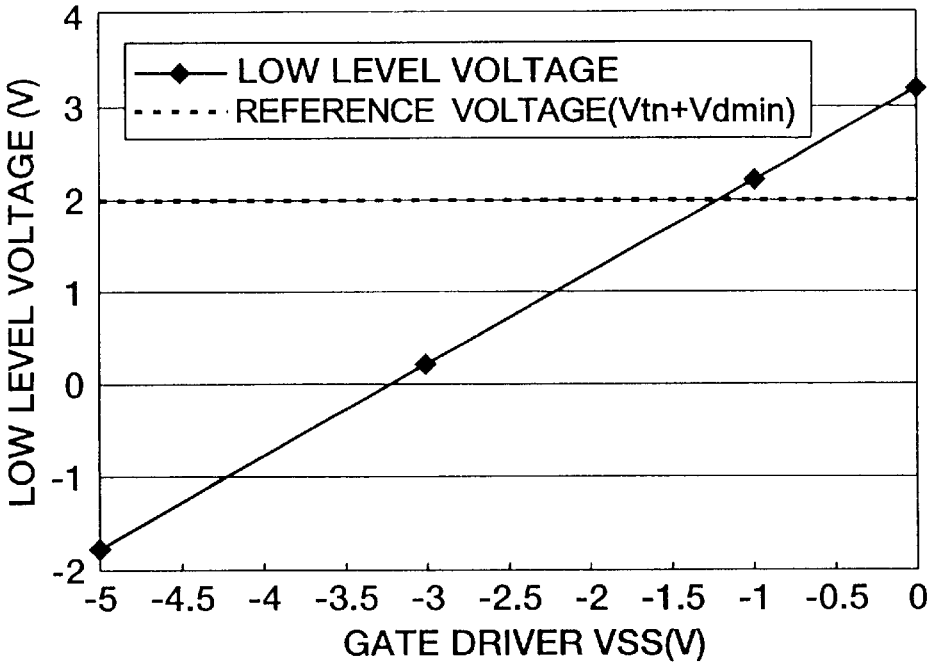
FIG. 70 is a characteristic diagram showing the effect of the twelfth liquid crystal display device.

FIG. 70 is a correlation diagram of the minimum value of the gate driver output and the scanning line low level voltage, illustrating the effect of the liquid crystal display device according to the twelfth embodiment. With the high level at the time of input of the gate scanning voltage as 16 V, the high level of the data signal voltage as 11 V, the low level as 1 V, the number of pixels per scanning line as 640, and the sheet resistance of the wiring as 5 Ω, the value of the scanning line low level voltage VgL (640) in the 640th pixel for the case where the minimum value VgL0 of the gate driver output was changed, was obtained by simulation. The threshold value Vt of the switching MOS type transistor used in the calculation was 1 V.

If the low level of the gate scanning voltage exceeds the sum of the data signal low level Vdmin and the threshold value Vt of the switching MOS transistor (in this case 2 V), the switching transistor does not perform normal switching. With the pixel circuit construction for which the calculation was made, in the case where the minimum output voltage VgL0 of the gate driver is 0 V for normal use, VgL (640) is 3.2 V, and the switching transistor does not operate normally.

If using the liquid crystal display device according to the twelfth embodiment, the minimum output voltage VgL0 of the gate driver is set below −1.5 V, then under conditions of a sheet resistance of 5 Ω, $$VgL(640)<2\text{V} \tag{16}$$

Hence normal operation of the switching MOS type transistor can be realized (taking margins into consideration, a value for VgL0 lower than −1.5 V is desirable). This can be realized in the example of part (a) shown in FIG. 56 with a sheet resistance less than 3 Ω, and even in the case where a material with a high sheet resistance is used, pixel switching can be operated normally.

In this way, with the liquid crystal display device according to the twelfth embodiment, this has the affect that a high resistance wiring material such as a poly-Si film for which ion doping has been performed, may be used for the material of the scanning line without using a metal or a metal silicide.

However, from the viewpoint of breakdown voltage and the like of the transistor used in the analog amplifier circuits 7502, VgL0 should be zero or a small negative voltage. Therefore, it is desirable to use a low resistance material for the wiring, and it is effective to use this combined with the eleventh embodiment.

Here with the liquid crystal display device according to the twelfth embodiment, it was noted that the MOS type transistor (Qn) 7501 and the analog amplifier circuit 7502 were formed from poly-SiTFTs. However these may be formed from other thin film transistors such as a-Si TFTs or cadmium-selenium thin film transistors. Moreover these may be formed from single crystal silicon transistors. Furthermore, the gain of the analog amplifier circuit 7502 is set to 1. However in order to make the pixel voltage different from the input voltage, the voltage amplification may be changed.

With the liquid crystal display device according to the twelfth embodiment, a metal or a metal silicide need not be included in the material for forming the scanning line, and if the value of the minimum output voltage VgL0 of the gate driver is specified to be negative, then all of the constructions of the various modified examples (FIG. 54, FIG. 57~FIG. 59, FIG. 61~FIG. 64) of the liquid crystal display device according to the eleventh embodiment can be used without restricting the material of the scanning lines.

Figure 71:
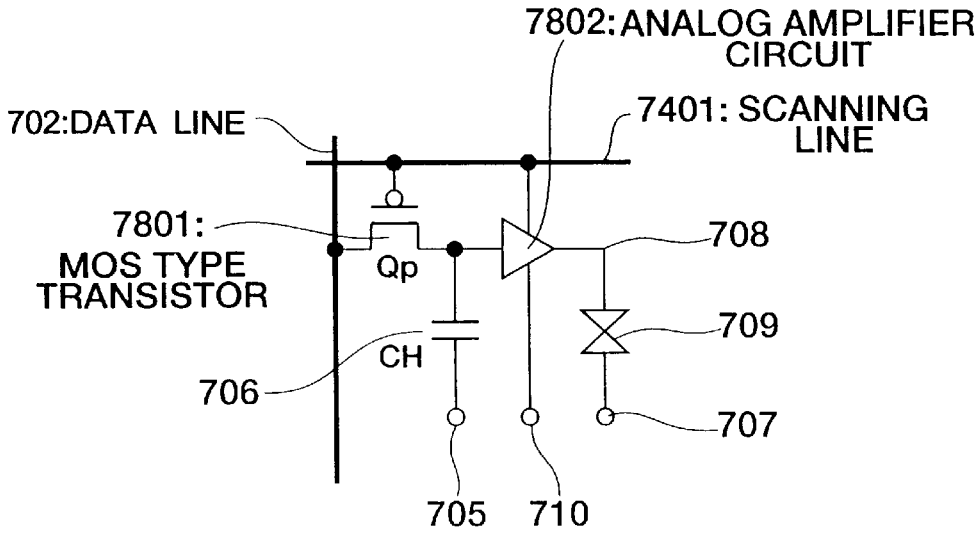
FIG. 71 is a configuration diagram showing a circuit configuration of one pixel section of the liquid crystal display device in a thirteenth embodiment according to the present invention.

FIG. 71 is a diagram showing a pixel circuit structure of a liquid crystal display device according to a thirteenth embodiment of the present invention.

As shown in the figure, the liquid crystal display device of this embodiment comprises: a MOS type transistor (Qp) 7801 with a gate electrode connected to a scanning line 7401, and one of a source electrode and a drain electrode connected to a data line 702; an analog amplifier circuit 7802 with an input electrode connected to the other of the source electrode and the drain electrode of the transistor (Qp) 7801, and an output electrode connected to a pixel electrode 708, and one of a positive and negative power source line connected to the scanning line 7401 and the other of the power source line connected to an amplifier power source electrode Vamp 710; a voltage holding capacitor 706 formed between an input electrode of the analog amplifier circuit 7802 and the voltage holding capacitor electrode 705; and a liquid crystal 709, the orientation of which is to be changed, disposed between the pixel electrode 708 and an opposing electrode 707.

Here the MOS type transistor (Qp) 7801 and the analog amplifier circuit 7802 are constituted by p-Si TFTs. Furthermore, the gain of the analog amplifier circuit 7802 is set to 1.

Figure 72:
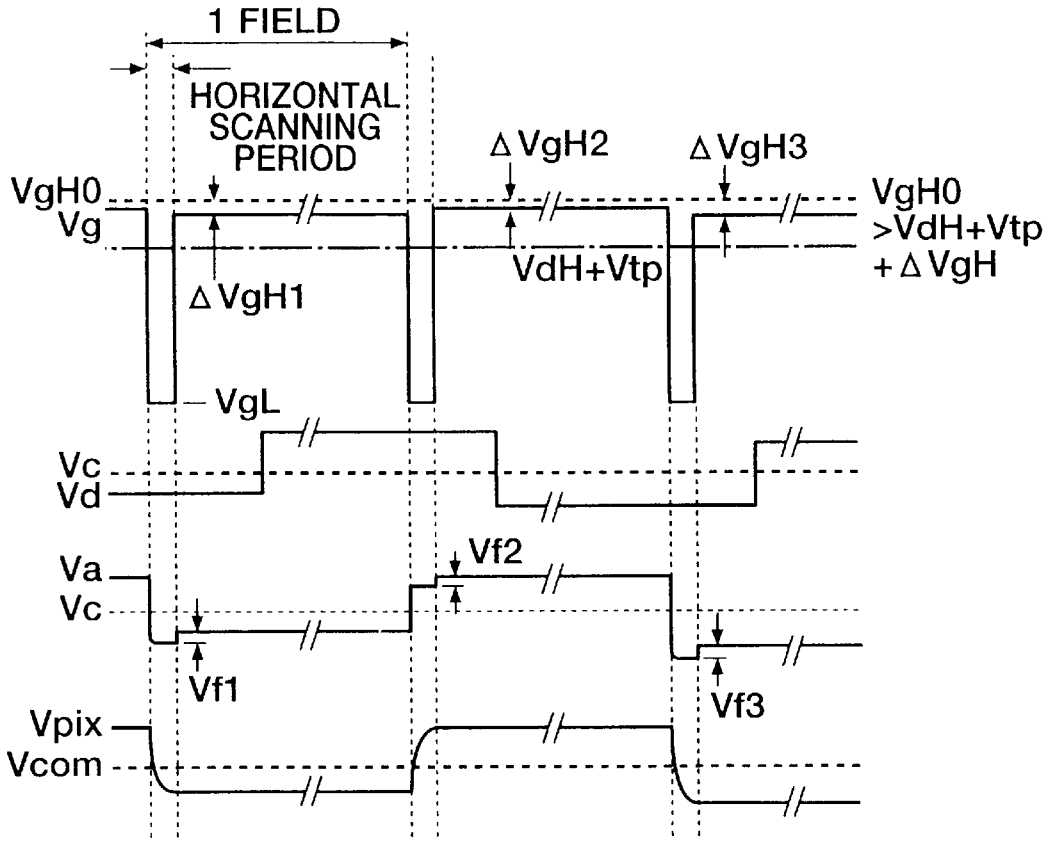
FIG. 72 is a timing chart showing a drive method of the liquid crystal display device of the thirteenth embodiment.

As follows is a description of the drive method for the liquid crystal display device using this pixel construction, with reference to FIG. 72. FIG. 72 shows the timing chart for the gate scanning voltage Vg, a data signal voltage Vd, an amplifier output voltage Va and a pixel voltage Vpix, for the case where a liquid crystal is driven by the pixel construction shown in FIG. 71. The positive power source voltage of the gate driver is VgH0, the high level voltage of the gate scanning voltage in the pixel section is VgH, and the threshold value of the transistor (Qp) 7801 is Vt.

As shown in the figure, due to the gate scanning voltage Vg in the horizontal scanning period becoming a low level VgL, the transistor (Qp) 7801 comes on and the data signal Vd input to the data line is transferred to the input electrode of the analog amplifier circuit 7802 via the transistor (Qp) 7801. When the horizontal scanning period is completed, and a high level voltage VgH0 is output from the gate driver to the scanning line 7401, the transistor (Qp) 7801 goes off, and the data signal transferred to the input electrode of the analog amplifier circuit 7802 is held by the voltage holding capacitor 706.

At this time, with the amplifier input voltage Va, at the time when the transistor (Qp) 7801 goes off, a voltage shift referred to a feed-through voltage occurs via the capacitance between the gate and source of the transistor (Qp) 7801. In FIG. 72, this is shown by Vf1, Vf2 and Vf3.

The amplifier input voltage Va is held until the gate scanning voltage Vg again becomes a low level in the subsequent field period and the transistor (Qp) 7801 is selected. The analog amplifier circuit 7802, during the period in the subsequent field up until the amplifier input voltage changes, can output an analog gray scale voltage corresponding to the held amplifier input voltage Va. During this holding period, a current is continually output from the scanning line 7401 to the negative power source line via the positive power source line of the analog amplifier circuit, so that the high level voltage VgH of the gate scanning voltage Vg is lowered. In FIG. 72, this is shown by ΔVgH 1, ΔVgH2 and ΔVgH3.

As a result, VgH, with A VgH positive becomes:

$$VgH=VgH0-\Delta VgH(1 \text{ or } 2 \text{ or } 3) \tag{17}$$

Here ΔVgH differs for each pixel even though on the same scanning line. Moreover, in the same pixel, this changes with the data signal voltage Vd.

With the liquid crystal display device according to the thirteenth embodiment, in all of the pixels, a VgH0 which at least satisfies the following equation can be supplied:

$$VgH>VdH+Vt \tag{18}$$

As a result, normal switching can be performed. Here VdH is the high level of the data signals.

If the liquid crystal display device according to the thirteenth embodiment is used, then in the case where the switching MOS transistor is a p-type, the same affect as for the twelfth embodiment can be obtained.

Here with the liquid crystal display device according to the thirteenth embodiment, it was noted that the MOS type transistor (Qp) 7801 and the analog amplifier circuit 7802 were formed from p-Si TFTs. However these may be formed from other thin film transistors such as a-Si TFTs or cadmium-selenium thin film transistors. Moreover these may be formed from single crystal silicon transistors. Furthermore, the gain of the analog amplifier circuit 7802 is set to 1. However in order to make the pixel voltage different from the input voltage, the voltage amplification may be changed.

With the liquid crystal display device according to the thirteenth embodiment, a metal or a metal silicide need not be included in the material for forming the scanning line, and if the positive power source voltage VgH0 of the gate driver is specified as a sufficiently high value, then the construction of the eleventh embodiment (the construction where as in FIG. 65, the switching transistor in FIG. 54 through FIG. 64 is changed to a p-type) can be used.

From the viewpoint of breakdown voltage and the like of the transistor used in the analog amplifier circuits 7802, VgH0 should be as low as possible. Therefore, it is desirable to use a low resistance material for the wiring, and it is effective to use this combined with the liquid crystal display device in the eleventh embodiment.

As described above, with the liquid crystal display device of the present invention, in the case where the power source is an en bloc lighting type, the scanning of each gate drive circuit block is started at approximately the same time. Consequently, there is the result that a liquid crystal display device is obtained with a long period which can be used in the display.

Furthermore, since the display period can be lengthened, and the liquid crystal display device and the light source can be linked by devising the drive method, there is the result that a liquid crystal display device is obtained with a high light utilization factor.

Moreover, since the drive circuit is divided and the respective drive circuit units are miniaturized, there is the result that a low cost simple construction drive circuit can be used.

Furthermore, since the synchronization of the drive method for the light source is optimized, there is the result that an extremely high resolution picture display is obtained.

Moreover with the present invention, in a liquid crystal display device for driving.pixel electrodes using MOS type transistor circuits incorporating an amplifier output transfer function and respectively disposed in the vicinity of respective intersection points of a plurality of scanning lines and a plurality of data lines, in pixels constructed with an attached analog amplifier circuit for detecting the output of the amplifier output transfer function for all of the pixels, and based on the detection results performing output compensation on the amplifier output transfer function for each pixel, to thereby suppress fluctuations in pixel voltage during a holding period, there is the effect that the display deviations for each pixel, attributable to fluctuations in amplifier output can be suppressed.

Furthermore, with the present invention, an output terminal of an analog amplifier circuit is connected to a liquid crystal display element, and the input terminal is connected to a data line via between a source and a drain of a switching transistor, and a gate scanning line to which the power source line of this analog amplifier is connected is formed from a material containing at least a metal or a metal silicide. As a result, fluctuations in the voltage at the time of non selection of the gate scanning line are suppressed and normal switching operation is achieved. Moreover in a simplified construction with the amplifier power source line omitted, deterioration of the image quality is prevented, and liquid crystals such as high polymer liquid crystals with a low resistivity, or ferroelectric or antiferroelectric liquid crystal materials having polarization can be used.

Moreover, in the case where the switching transistor is a p-type, the high level voltage of driver power source of the gate scanning line to which the analog amplifier is connected is made sufficiently high, while in the case where this is an n-type, the low level voltage of driver power source of the gate scanning line to which the analog amplifier circuit is connected is shifted to negative. As a result, the shift amount of the voltage at the time of non selection of the gate scanning line is reduced, and even with a high resistance wiring material, normal switching operation is achieved. Furthermore in a simplified construction with the amplifier power source line omitted, deterioration of the image quality is prevented, and liquid crystals such as high polymer liquid crystals with a low resistivity, or ferroelectric or antiferroelectric liquid crystal materials having polarization can be used.

What is claimed is:

1. A liquid crystal display device comprising a pixel electrode driver for each pixel, said driver using MOS type transistor circuits incorporating an amplifier output transfer function and respectively disposed in the vicinity of respective intersection points of a plurality of scanning lines and a plurality of data lines, said device having detection means for detecting the output of said amplifier transferred by a transfer function, for all bits, and compensation means for performing output compensation on said output of said amplifier transferred by a transfer function, for each pixel, based on the detection results of said detection means.

2. A liquid crystal display device according to claim 1, wherein said compensation means compensates an image data signal in accordance with the output of an amplifier transferred by a transfer function, for each pixel.

3. A liquid crystal display device comprising a pixel electrode driver using MOS type transistor circuits incorporating an amplifier output transfer function and respectively disposed in the vicinity of respective intersection points of a plurality of scanning lines and a plurality of data lines, wherein said MOS type transistor circuits comprise: a MOS transistor with a gate electrode connected to said scanning line and one of a source electrode and a drain electrode connected to said data line; a MOS type analog amplifier circuit with an input electrode connected to the other of the source electrode and the drain electrode of said MOS type transistor, and an output electrode connected to a pixel electrode; a voltage holding capacitor formed between the input electrode of said MOS type analog amplifier circuit and a voltage holding capacitor electrode; and a switch with an input electrode connected to an output electrode of said MOS type analog amplifier circuit and an output electrode connected to one of an amplifier monitor line and said data line, and has:

a read out circuit for reading out an output voltage of said analog amplifier circuit through one of said amplifier monitor line and data line, a detection circuit for detecting a difference between an output voltage from said analog amplifier circuit which has been transferred in a predetermined sequence by said read out circuit, and a previously set reference voltage; conversion means for converting the difference voltage from said detection circuit into digital data; a memory for storing said difference voltage which had been digitized; and voltage generating means for applying a compensation voltage corresponding to the storage data of said memory, to an input image signal.

4. A liquid crystal display device according to claim 3, wherein said MOS type transistor circuit incorporating an amplifier output transfer function comprises: a first MOS type transistor with a gate electrode connected to a scanning line and one of a source electrode and a drain electrode connected to an Nth data line; an analog amplifier circuit with an input electrode connected to the other of the source electrode and the drain electrode of said first MOS type transistor, and an output electrode connected to a pixel electrode; a second MOS type transistor with a gate electrode connected to a switch selection line and one of a source electrode and a drain electrode connected to an output electrode of said analog amplifier circuit, and the other of said source electrode and drain electrode connected to an N+1th data line; a voltage holding capacitor formed between the input electrode of said analog amplifier circuit and a voltage holding capacitor electrode; and a liquid crystal which is to be switched, disposed between said pixel electrode and an opposing electrode.

5. A liquid crystal display device according to claim 3, wherein said MOS type transistor circuit incorporating an amplifier output transfer function comprises: a first MOS type transistor with a gate electrode connected to a scanning line and one of a source electrode and a drain electrode connected to a data line; an analog amplifier circuit with an input electrode connected to the other of the source electrode and the drain electrode of said first MOS type transistor, and an output electrode connected to a pixel electrode; a second MOS type transistor with a gate electrode connected to said scanning line and one of a source electrode and a drain electrode connected to an output electrode of said analog amplifier circuit, and the other of said source electrode and drain electrode connected to an amplifier monitor line; a voltage holding capacitor formed between the input electrode of said analog amplifier circuit and a voltage holding capacitor electrode; and a liquid crystal which is to be switched, disposed between said pixel electrode and an opposing electrode.

6. A liquid crystal display device according to claim 3, wherein said memory comprises a volatile memory, and each time said device is started, output of difference data of said amplifier output voltage with respect to a reference voltage, and writing of said difference data to said memory is performed.

7. A liquid crystal display device according to claim 3, wherein said memory comprises a rewritable nonvolatile memory, and each time said device is started, output of difference data of said amplifier output voltage with respect to a reference voltage, and writing of said difference data to said memory is performed.

8. A liquid crystal display device according to claim 3, wherein said memory comprises a volatile memory, and by a predetermined operation with respect to said device at an optional timing, output of difference data of said amplifier output voltage with respect to a reference voltage, and writing of said difference data to said memory is performed.

9. A liquid crystal display device according to claim 3, wherein said memory comprises a rewritable nonvolatile memory, and by a predetermined operation with respect to said device at an optional timing, output of difference data of said amplifier output voltage with respect to a reference voltage, and writing of said difference data to said memory is performed.

* * * * *